US005470635A

United States Patent [19]

Shirai et al.

[11] Patent Number: 5,470,635

[45] Date of Patent: Nov. 28, 1995

[54] BLADE MEMBER HAVING A FLAT-SURFACE SIDE AND AN ANGLED-SURFACE SIDE

[75] Inventors: Hiroyuki Shirai, Tokyo; Kazumi Sekine, Kawasaki; Tadayuki Tsuda, Kawasaki; Isao Ikemoto, Kawasaki; Kazushi Watanabe, Yokohama; Yoshikazu Sasago, Tokyo; Takeo Shoji; Shinya Noda, both of Yokohama; Kazunori Kobayashi, Kawasaki; Hiroyuki Adachi, Tokyo, all of Japan

[73] Assignee: Canon Kabushiki Kaisha, Tokyo, Japan

[21] Appl. No.: 45,362

[22] Filed: Apr. 13, 1993

[30] Foreign Application Priority Data

| | | | |
|---|---|---|---|
| Apr. 16, 1992 | [JP] | Japan | 4-121131 |
| Jun. 30, 1992 | [JP] | Japan | 4-194660 |
| Jul. 24, 1992 | [JP] | Japan | 4-217423 |
| Jan. 28, 1993 | [JP] | Japan | 5-31175 |
| Apr. 12, 1993 | [JP] | Japan | 5-84679 |

[51] Int. Cl.[6] ..... G03G 21/00

[52] U.S. Cl. ..... 428/131; 428/130; 428/121; 428/81; 428/189; 428/192; 428/220; 428/425.8; 428/136; 428/338; 428/213; 428/344; 355/299; 118/652; 15/256.51

[58] Field of Search ..... 428/131, 130, 428/121, 81, 189, 192, 220, 425.8, 136, 338, 213, 344; 355/299; 118/652; 15/256.51

[56] References Cited

U.S. PATENT DOCUMENTS

| | | | |
|---|---|---|---|
| 3,552,850 | 1/1971 | Royka et al. | 355/299 |
| 3,660,863 | 5/1972 | Gerbasi | 15/256.51 |
| 3,848,992 | 11/1974 | Smith | 18/637 |
| 3,985,436 | 10/1976 | Tanaka et al. | 355/8 |
| 4,334,766 | 6/1982 | Sugiyama et al. | 355/15 |
| 4,500,195 | 2/1985 | Hosono | 355/3 R |
| 4,530,594 | 7/1985 | Adachi | 355/15 |
| 4,540,268 | 9/1985 | Toyono et al. | 355/3 R |
| 4,627,701 | 12/1986 | Onoda et al. | 355/3 CH |
| 4,639,123 | 1/1987 | Adachi et al. | 18/652 |
| 4,702,591 | 10/1987 | Tsuda et al. | 355/15 |
| 4,757,349 | 7/1988 | Toshimitsu et al. | 355/15 |
| 4,779,119 | 10/1988 | Kaieda | 18/632 |
| 4,866,483 | 9/1989 | Davis et al. | 355/299 |
| 4,939,551 | 7/1990 | Hashiyama et al. | 18/652 |
| 4,984,326 | 1/1991 | Horie et al. | 15/1.5 |
| 5,036,358 | 7/1991 | Yoshida | 355/203 |
| 5,040,030 | 8/1991 | Ziegelmuller | 18/652 |

(List continued on next page.)

FOREIGN PATENT DOCUMENTS

| | | |
|---|---|---|
| 0217173 | 4/1987 | European Pat. Off. . |
| 44-2034 | 1/1969 | Japan . |
| 56-138772 | 10/1981 | Japan . |
| 63-149669 | 6/1988 | Japan . |
| 1399057 | 6/1975 | United Kingdom . |
| 1415405 | 11/1975 | United Kingdom . |
| 1419874 | 12/1975 | United Kingdom . |
| 2135937 | 12/1984 | United Kingdom . |

*Primary Examiner*—William P. Watkins, III

*Attorney, Agent, or Firm*—Fitzpatrick, Cella, Harper & Scinto

[57] ABSTRACT

A blade member, mountable onto an electrophotographic image forming apparatus, such as copier, printer, facsimile, word processor, and the like, for removing residual matter from an electrophotographic photosensitive member, includes an elastic blade one side surface of which is flat in a longitudinal direction thereof and the other side surface of which has a vertical portion perpendicular to an end surface of the elastic blade, and an inclined portion inclined with respect to the vertical portion, the inclined portion having a larger thickness than the vertical portion, and a support member for supporting the elastic blade. A thickness (f) of a portion of the elastic blade, which is engaged by the support member at a side of the one side surface, is greater than a thickness (g) of a portion of the elastic blade which is engaged by the support member at a side of the other side surface.

31 Claims, 59 Drawing Sheets

U.S. PATENT DOCUMENTS

| | | | |
|---|---|---|---|
| 5,043,769 | 8/1991 | Osawa et al. | 355/299 |
| 5,134,960 | 8/1992 | Shirai | 118/653 |
| 5,145,724 | 9/1992 | Yanai et al. | 427/430.1 |
| 5,162,858 | 11/1992 | Shoji et al. | 355/299 |
| 5,204,034 | 4/1993 | Sasame et al. | 264/236 |
| 5,241,350 | 8/1993 | Bigelow | 355/299 |
| 5,303,010 | 4/1994 | Takano et al. | 355/245 |

| | PERMANENT DEFORMATION AMOUNT (mm) | |
|---|---|---|
| BLADE ENTRY AMOUNT / BLADE SHAPE | 0.8 | 1.1 |
| PRIOR ART | 0.080 | 0.110 |
| PRESENT INVENTION (EMBODIMENT) | 0.040 | 0.055 |

BLADE MEMBER HAVING A FLAT-SURFACE SIDE AND AN ANGLED-SURFACE SIDE

BACKGROUND OF THE INVENTION

Field of the Invention

The present invention relates to a blade member, a method for attaching a blade member, a process cartridge, a method for assembling a process cartridge and an image forming apparatus.

The image forming apparatus may be, for example, an electrophotographic copying machine, a laser beam printer, an LED printer, facsimile system, word processor and the like.

Related Background Art

In image forming apparatus such as copying machines, a latent image is formed by selectively exposing an image bearing member uniformly charged, the latent image is then visualized with toner, and then the toner image is transferred onto a recording sheet, thereby forming an image on the recording sheet. In such image forming apparatus, whenever the toner is used up, new toner must be replenished. The toner replenishing operation not only is troublesome, but also often causes the contamination of the surroundings. Further, since the maintenance of various elements or members cannot be performed only by an expert in the art, most of the users feel inconvenience.

In order to eliminate such drawback and inconvenience, an image forming apparatus wherein parts such as a developing device which toner therein has been used up or an image bearing member which a service life thereof has expired can easily be exchanged, thereby facilitating the maintenance, by assembling the image bearing member, a charger, the developing device and a cleaning device integrally as a process cartridge which can be removably mounted within the image forming apparatus has been proposed and put into practical use, for example, as disclosed in U.S. Pat. Nos. 3,985,436, 4,500,195, 4,540,268 and 4,627,701.

By the way, in order to make an image forming apparatus compact, it has recently been required for making a process cartridge and various parts used with such process cartridge small-sized. On the other hand, in order to improve the assembling ability for the process cartridge, it has been requested for facilitating the assembling and disassembling of the parts used with the process cartridge.

This is because recycling of the process cartridges has strongly been desired in order to use the resources effectively from the view point of the protection of the global environment. To this end, it is desired to propose a process cartridge which can be recycled more easily. Incidentally, recycling of the process cartridge means that, after a used process cartridge is collected and then is decomposed, damaged or worn parts are exchanged for new parts and the other parts are reused as they are, thereby re-assembling the process cartridge.

Although the above-mentioned U.S. Pat. No. 3,985,436 discloses the collection and recycle of a unit which has been used for a predetermined period, a preferred construction for the recycle is not disclosed concretely (refer to lines 38–62, column 16 in U.S. Pat. No. 3,985,436).

SUMMARY OF THE INVENTION

An object of the present invention is to provide a blade member, a method for attaching a blade member, a process cartridge, a method for assembling a process cartridge, and an image forming apparatus, which can be made compact and which can improve the positional accuracy in attaching and/or assembling operations.

Another object of the present invention is to provide a blade member, a method for attaching a blade member, a process cartridge, a method for assembling a process cartridge and an image forming apparatus which can minimize the permanent deformation amount of parts, can prevent the turn-up (turn-over) of the blade member, can minimize the undesirable noise and can maintain the excellent performance for a long time.

A further object of the present invention is to provide a method for attaching a blade support member, a method for assembling a process cartridge having a blade attached thereto and an image forming apparatus within which such process cartridge can be mounted, which can maintain the attaching accuracy for the blade and which can facilitate the attachment of the blade.

A still further object of the present invention is to provide a process cartridge, an image forming apparatus within which such process cartridge can be mounted and a method for assembling a cleaning device, which can be suitably recycled.

A further object of the present invention is to provide a process cartridge, an image forming apparatus within which such process cartridge can be mounted and a method for assembling a cleaning device, which can improve the assembling ability.

A still further object of the present invention is to provide a process cartridge, an image forming apparatus within which such process cartridge can be mounted and a method for assembling a cleaning device, which can improve the disassembling ability.

The other object of the present invention is to provide a process cartridge, an image forming apparatus within which such process cartridge can be mounted and a method for assembling a cleaning device, wherein a used process cartridge collected from a market can efficiently be decomposed and which can suitably be recycled.

According to the present invention, it is possible to provide a blade member, a method for attaching a blade member, a process cartridge, a method for assembling a process cartridge and an image forming apparatus which can be made compact.

DETAILED DESCRIPTION OF THE PREFERRED EMBODIMENTS

First of all, a process cartridge according to a first embodiment of the present invention, and an image forming system utilizing such a process cartridge will be explained with reference to the accompanying drawings.

Figure 2:
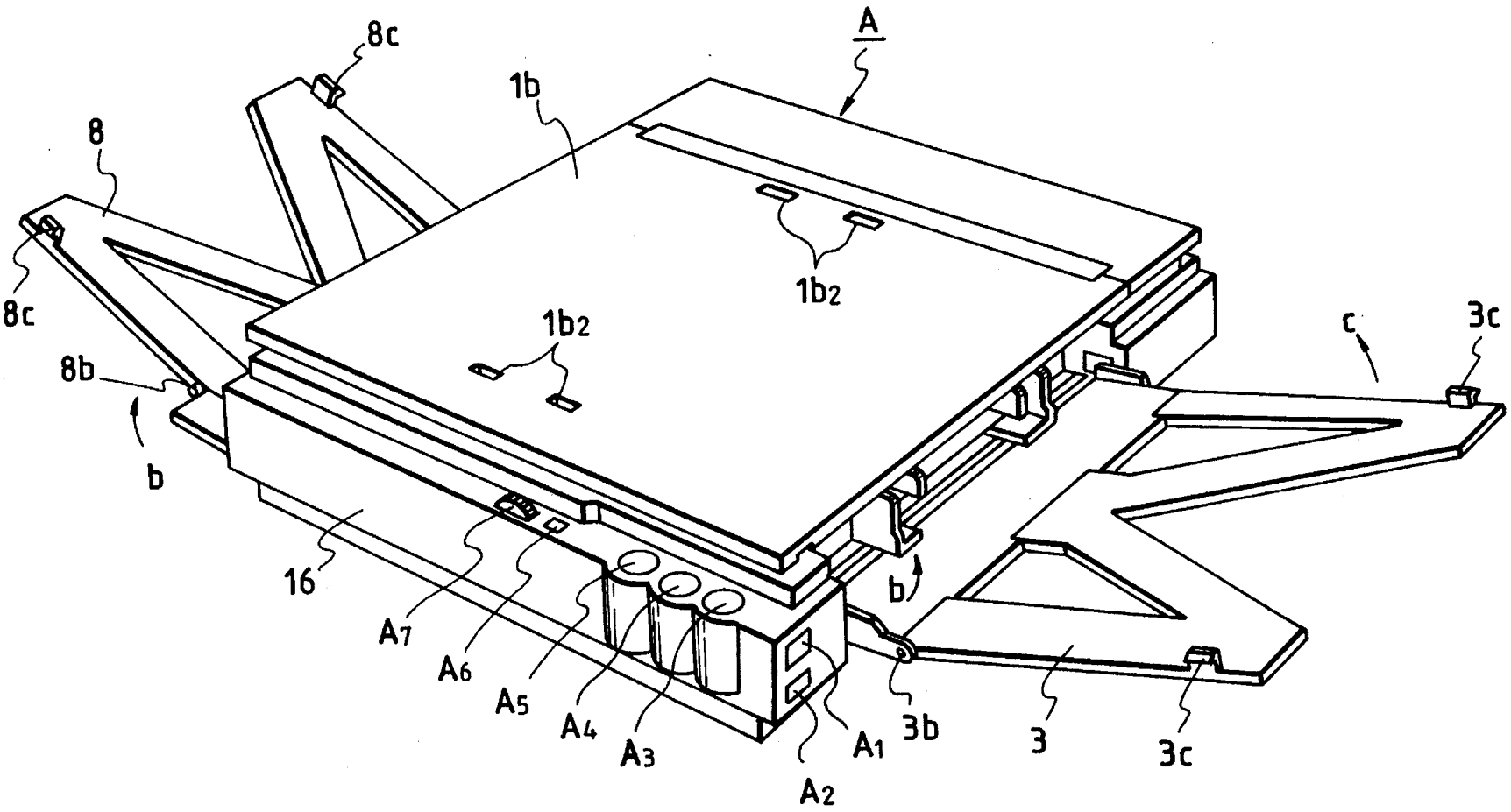
FIG. 2 is a perspective view of the copying machine in a condition that a tray is opened.
Figure 3:
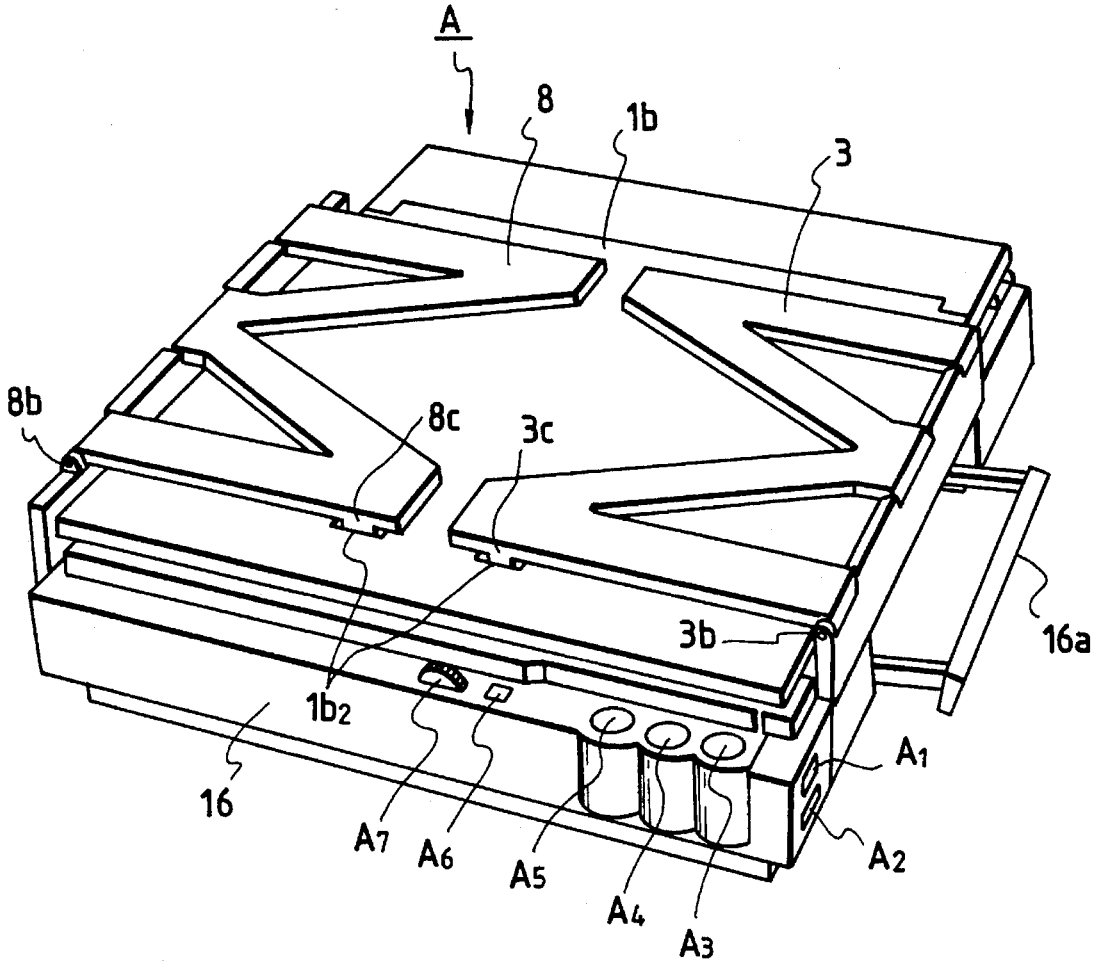
FIG. 3 is a perspective view of the copying machine in a condition that a tray is closed.
Figure 4:
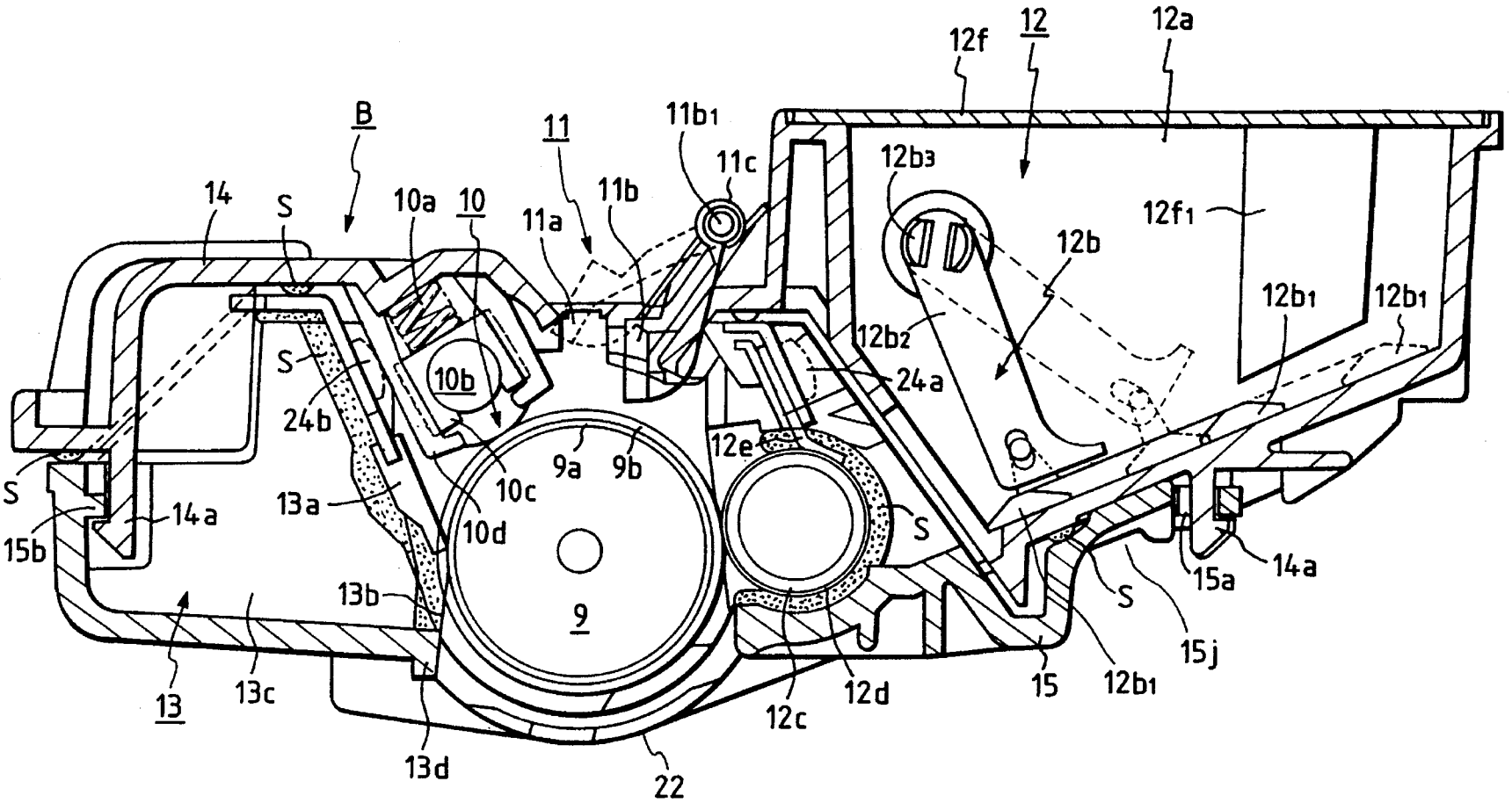
FIG. 4 is an elevational sectional view of the process cartridge.
Figure 5:
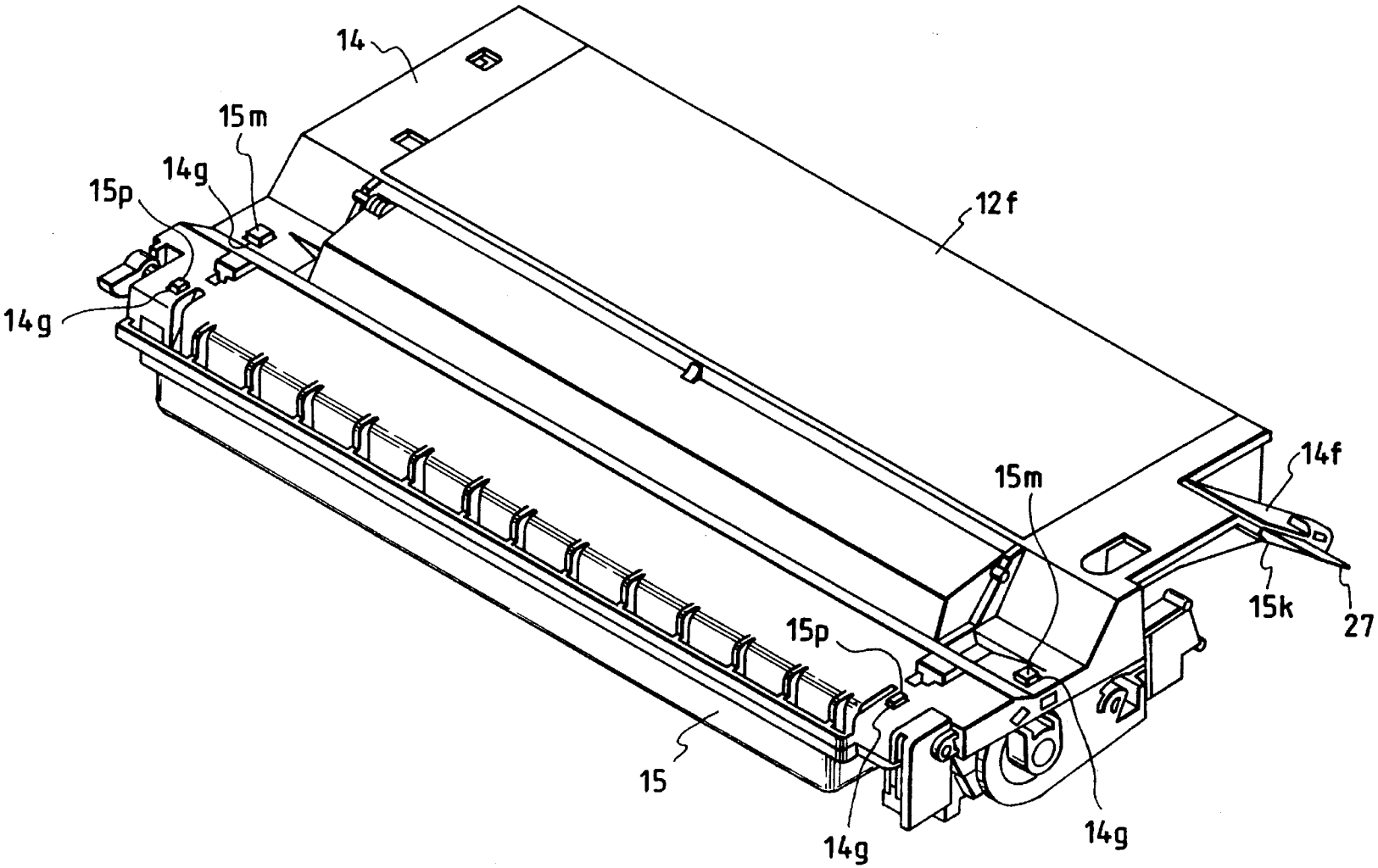
FIG. 5 is a perspective view of the process cartridge.
Figure 6:
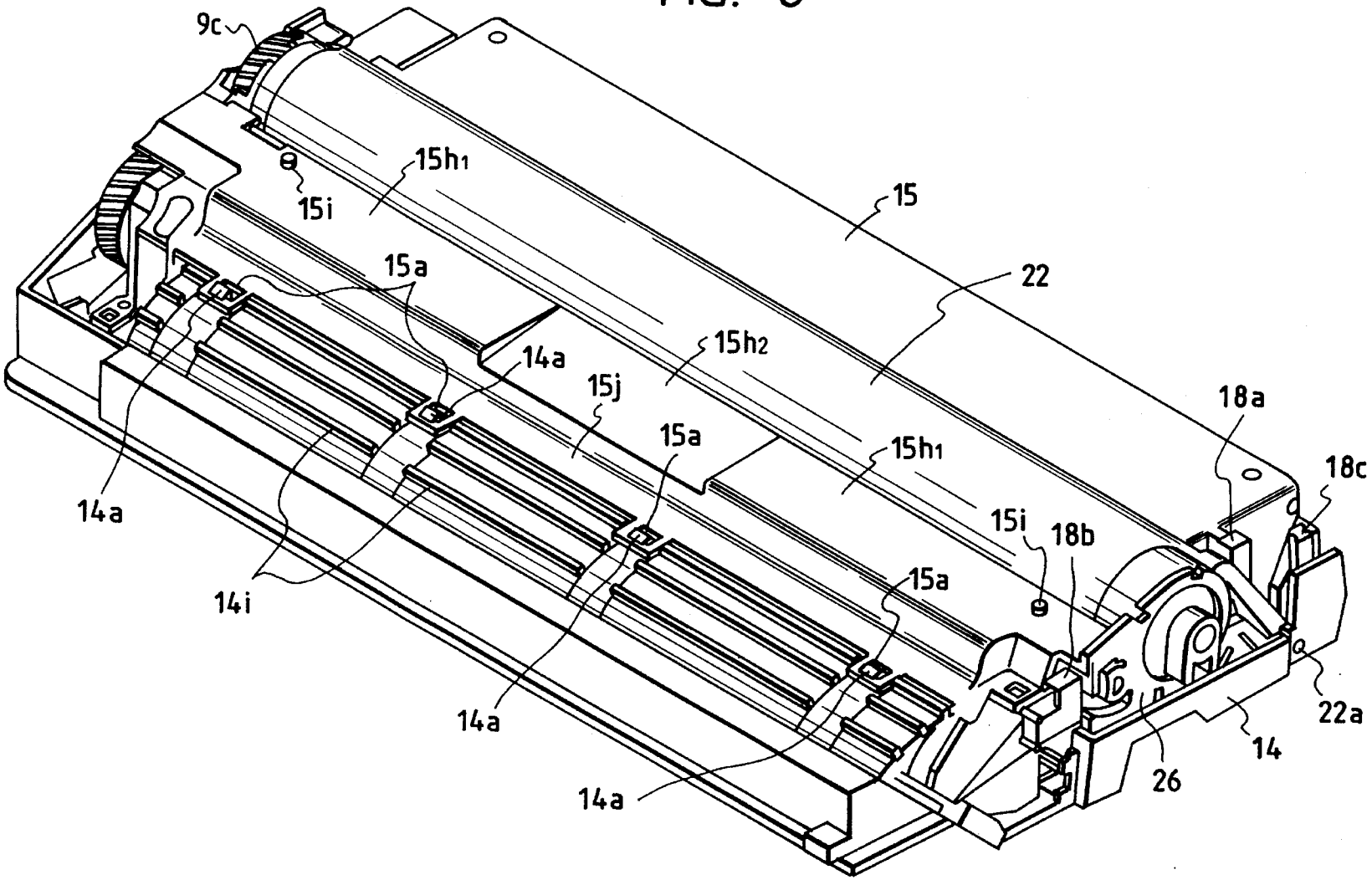
FIG. 6 is a perspective view of the process cartridge in an inverted condition.

The Whole Construction of a Process Cartridge and an Image Forming Apparatus Mounting the Process Cartridge thereon:

First of all, the whole construction of the image forming apparatus will briefly be described. Incidentally, FIG. 1 is an elevational sectional view of a copying machine as an example of the image forming system, within which the process cartridge is mounted, FIG. 2 is a perspective view of the copying machine with a tray opened, FIG. 3 is a perspective view of the copying machine with the tray closed, FIG. 4 is an elevational sectional view of the process cartridge, FIG. 5 is a perspective view of the process cartridge, and FIG. 6 is a perspective view of the process cartridge in an inverted condition.

Figure 1:
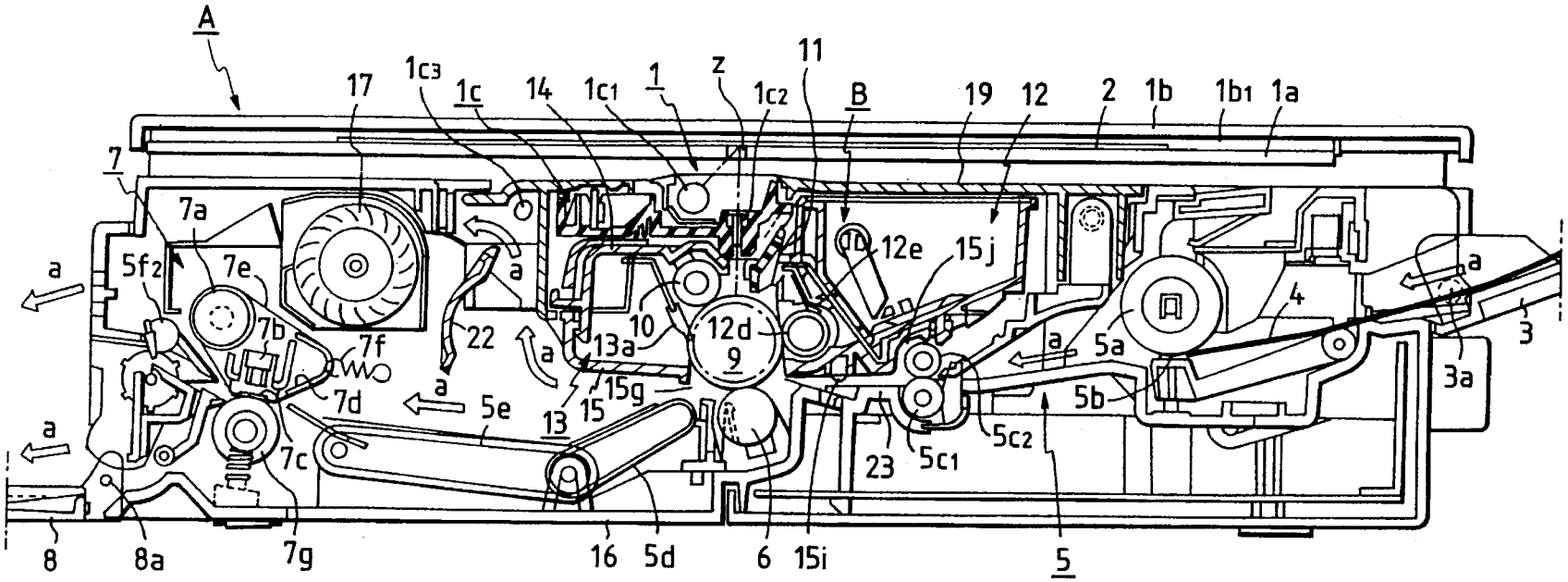
FIG. 1 is an elevational sectional view of a copying machine within which a process cartridge according to a preferred embodiment of the present invention is mounted.

As shown in FIG. 1, the image forming apparatus A operates to optically read image information on an original or document 2 by an original reading means 1. A recording medium supported on a sheet supply tray 3 or manually inserted from the sheet supply tray 3 is fed, by a feeding means 5, to an image forming station of the process cartridge B, where a developer (referred to as "toner" hereinafter) image formed in response to the image information is transferred onto the recording medium 4 by a transfer means 6. Thereafter, the recording medium 4 is sent to a fixing means 7 where the transferred toner image is permanently fixed to the recording medium 4. Then, the recording medium is ejected onto an ejection tray 8.

The process cartridge B defining the image forming station operates to uniformly charge a surface of a rotating photosensitive drum (image bearing member) 9 by a charger means 10, then to form a latent image on the photosensitive drum 9 by illuminating a light image read by the reading means 1 on the photosensitive drum by means of an exposure means 11, and then to visualize the latent image as a toner image by a developing means 12. After the toner image is transferred onto the recording medium 4 by the transfer means 6, the residual toner remaining on the photosensitive drum 9 is removed by a cleaning means 13.

Incidentally, the process cartridge B is formed as a cartridge unit by housing the photosensitive drum 9 and the like within frames, which include a first or upper frame 14 and a second or lower frame 15. Further, in the illustrated embodiment, the frames 14, 15 are made of high impact styrol resin (HIPS), and a thickness of the upper frame 14 is about 2 mm and a thickness of the lower frame 15 is about 2.5 min. However, the material and thickness of the frames are not limited to the above, but may be selected appropriately.

Next, various parts of the image forming apparatus A and the process cartridge B mountable within the image forming apparatus will be fully described.

Image Forming Apparatus

First of all, various parts of the image forming apparatus A will be explained.

Original Reading Means

The original reading means 1 serves to optically read the information written on the original, and, as shown in FIG. 1, includes an original glass support 1*a*, which is disposed at an upper portion of a body 16 of the image forming apparatus and on which the original 2 is to be supported. An original hold-down plate 1*b* having a sponge layer 1b1 on its inner surface is attached to the original glass support 1*a* for opening and closing movement. The original glass support 1*a* and the original hold-down plate 1*b* are mounted on the apparatus body 16 for reciprocal sliding movement in the left and right directions in FIG. 1. On the other hand, a lens unit 1*c* is disposed below the original glass support 1*a* at the upper portion of the system body 16 and includes a light source 1c1 and a short focus focusing lens array 1c2 therein.

With this arrangement, when the original 2 is supported on the original glass support 1*a* with an image surface thereof faced downside and the light source 1c1 is activated and the original glass support 1*a* is slid in the left and right direction in FIG. 1, the photosensitive drum 9 of the process cartridge B is exposed by reflection light from the original 2 via the lens array 1c2.

Recording Medium Feeding Means

The feeding means 5 serves to feed the recording medium 4 rested on the sheet supply tray 3 to the image forming station and to feed the recording medium to the fixing means 7. More particularly, after a plurality of recording media 4 are stacked on the sheet supply tray 3 or a single recording medium 4 is manually inserted on the sheet supply tray 3, and leading end(s) of the recording media or medium are abutted against a nip between a sheet supply roller 5*a* and a friction pad 5*b* urged against the roller, when a copy start button A3 is depressed, the sheet supply roller 5*a* is rotated to separate and feed the recording medium 4 to a pair of regist rollers 5c1, 5c2, which, in turn, feed the recording medium is registration with the image forming operation. After the image forming operation, the recording medium 4 is fed to the fixing means 7 by a convey belt 5*d* and a guide member 5*e*, and then is ejected onto the ejection tray 8 by a pair of ejector rollers 5f1, 5f2.

Transfer Means

The transfer means 6 serves to transfer the toner image formed on the photosensitive drum 9 onto the recording medium 4 and, in the illustrated embodiment, as shown in FIG. 1, it comprises a transfer roller 6. More particularly, by urging the recording medium 4 against the photosensitive drum 9 in the process cartridge B mounted within the image forming apparatus by means of the transfer roller 6 provided in the image forming apparatus and by applying to the transfer roller 6 a voltage having the polarity opposite to that of the toner image formed on the photosensitive drum 9, the toner image on the photosensitive drum 9 is transferred onto the recording medium 4.

Fixing Means

The fixing means 7 serves to the toner image transferred to the recording medium 4 by applying the voltage to the transfer roller 6 and, as shown in FIG. 1, comprises a heat-resistive fixing film 7*e* wound around and extending between a driving roller 7*a*, a heating body 7*c* held by a holder 7*b*, and a tension plate 7*d*. Incidentally, the tension plate 7*d* is biased by a tension spring 7*f* to apply a tension force to the film 7*e*. A pressure roller 7*g* is urged against the heating body 7*c* with the interposition of the film 7*e* so that the fixing film 7*e* is pressed against the heating body 7*c* with a predetermined force required for the fixing operation.

The heating body 7*c* is made of heat-resistive material, such as alimina, and has a heat generating surface comprised of a wire-shaped or plate-shaped members having a width of about 160 μm and a length (dimension perpendicular to a plane of FIG. 1) of about 216 mm and made of $Ta_2N$ for example arranged on an under surface of the holder 7*b* made of insulation material or composite material including insulation, and a protection layer made of $Ta_2O$, for example, and covering the heat generating surface. The lower surface of the heating body 7*c* is flat, and front and rear ends of the heating body are rounded to permit the sliding movement of the fixing film 7*e*. The fixing film 7*e* is made of heat-treated polyester and has a thickness of about 9 μm. The film can be rotated in a clockwise direction by the rotation of the driving roller 7*a*. When the recording medium 4 to which the toner image was transferred passes through between the fixing film 7*e* and the pressure roller 7*g*, the toner image is fixed to the recording medium 4 by heat and pressure.

Incidentally, in order to escape or discharge the heat generated by the fixing means 7 out of the image forming apparatus, a cooling fan 17 is provided within the body 16 of the image forming apparatus. The fan 17 is rotated, for example when the copy start button A3 (FIG. 2) is depressed, so as to generate an airflow a (FIG. 1) flowing into the image forming apparatus from the recording medium supply inlet and out from the recording medium ejecting outlet. The various parts including the process cartridge B are cooled by the airflow so that the heat does not remain in the image forming apparatus.

Recording Medium Supply and Ejection Trays

As shown in FIGS. 1 to 3, the sheet supply tray 3 and the ejection tray 8 are mounted on shafts 3*a*, 8*a*, respectively within the system body 16 for pivotal movements in directions b in FIG. 2, and for pivotal movements around shafts 3*b*, 8*b* in directions c in FIG. 2. Locking projections 3*c*, 8*c* are formed on free ends of the trays 3, 8 at both sides thereof, respectively. These projections can be fitted into locking recesses 1b2 formed in an upper surface of the original hold-down plate 1b. Thus, as shown in FIG. 3, when the trays 3, 8 are folded inwardly to fit the locking projections 3*c*, 8*c* into the corresponding recesses 1b2, the original glass support 1*a* and the original hold-down plate 1*b* are prevented from sliding in the left and right directions. As a result, an operator can easily lift the image forming apparatus A via grippers 16*a* and transport it.

Setting Buttons for Density and the Like

Incidentally, setting buttons for setting the density and the like are provided on the image forming apparatus A. Briefly explaining, in FIG. 2, a power switch A1 is provided to turn ON and OFF the image forming apparatus. A density adjusting dial A2 is used to adjust the fundamental density (of the copied image) of the image forming apparatus. The copy start button A3, when depressed, starts the copying operation of the image forming apparatus. A copy clear button A4, when depressed, interrupts the copying operation and clears the various setting conditions (for example, the set density condition). A copy number counter button A5 serves to set the number of copies when depressed. An automatic density setting button A6, when depressed, automatically sets the density in the copying operation. A density setting dial A7 is provided so that the operator can adjust the copy density by rotating this dial at needed.

Process Cartridge

Next, various parts of the process cartridge B which can be mounted within the image forming apparatus A will be explained.

The process cartridge B includes an image bearing member and at least one process means. For example, the process means may comprise a charge means for charging a surface of the image bearing member, a developing means for forming a toner image on the image bearing member and/or a cleaning means for removing the residual toner remaining on the image bearing member. As shown in FIGS. 1 and 4, in the illustrated embodiment, the process cartridge B is constituted as a cartridge unit, which can be removably mounted within the body 16 of the image forming apparatus, by enclosing the charger means 10, the developing means 12 containing the toner (developer) and the cleaning means 13, which are arranged around the photosensitive drum 9 as the image bearing member by a housing comprising the upper and lower frames 14, 15. The charger means 10, exposure means 11 (opening 11*a*) and toner reservoir 12*a* of the developing means 12 are disposed within the upper frame 14, and the photosensitive drum 9, developing sleeve 12*d* of the developing means 12 and cleaning means 13 are disposed within the lower frame 15.

Figure 7:
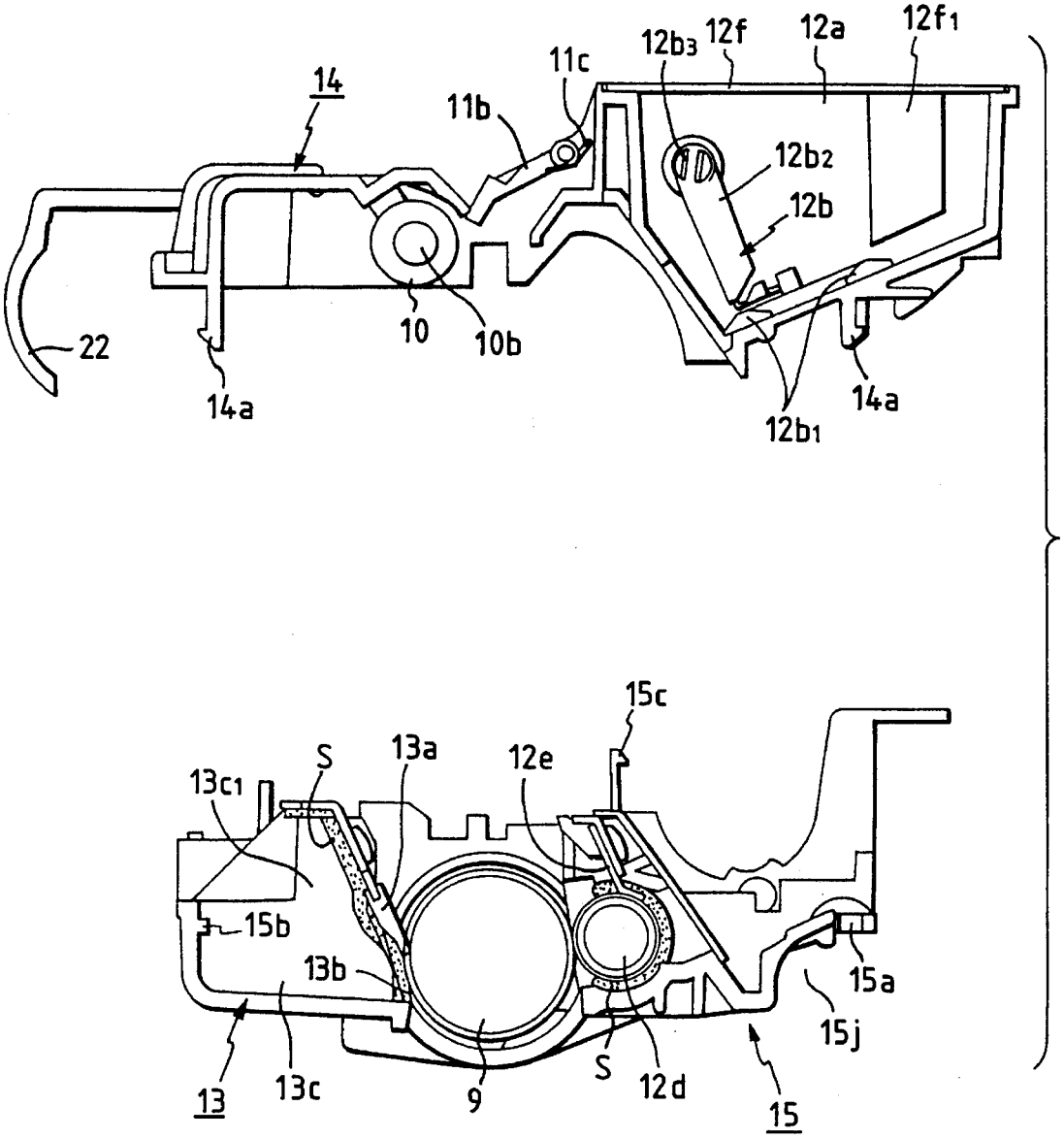
FIG. 7 is an exploded sectional view of the process cartridge in a condition that an upper frame and a lower frame are separated.
Figure 8:
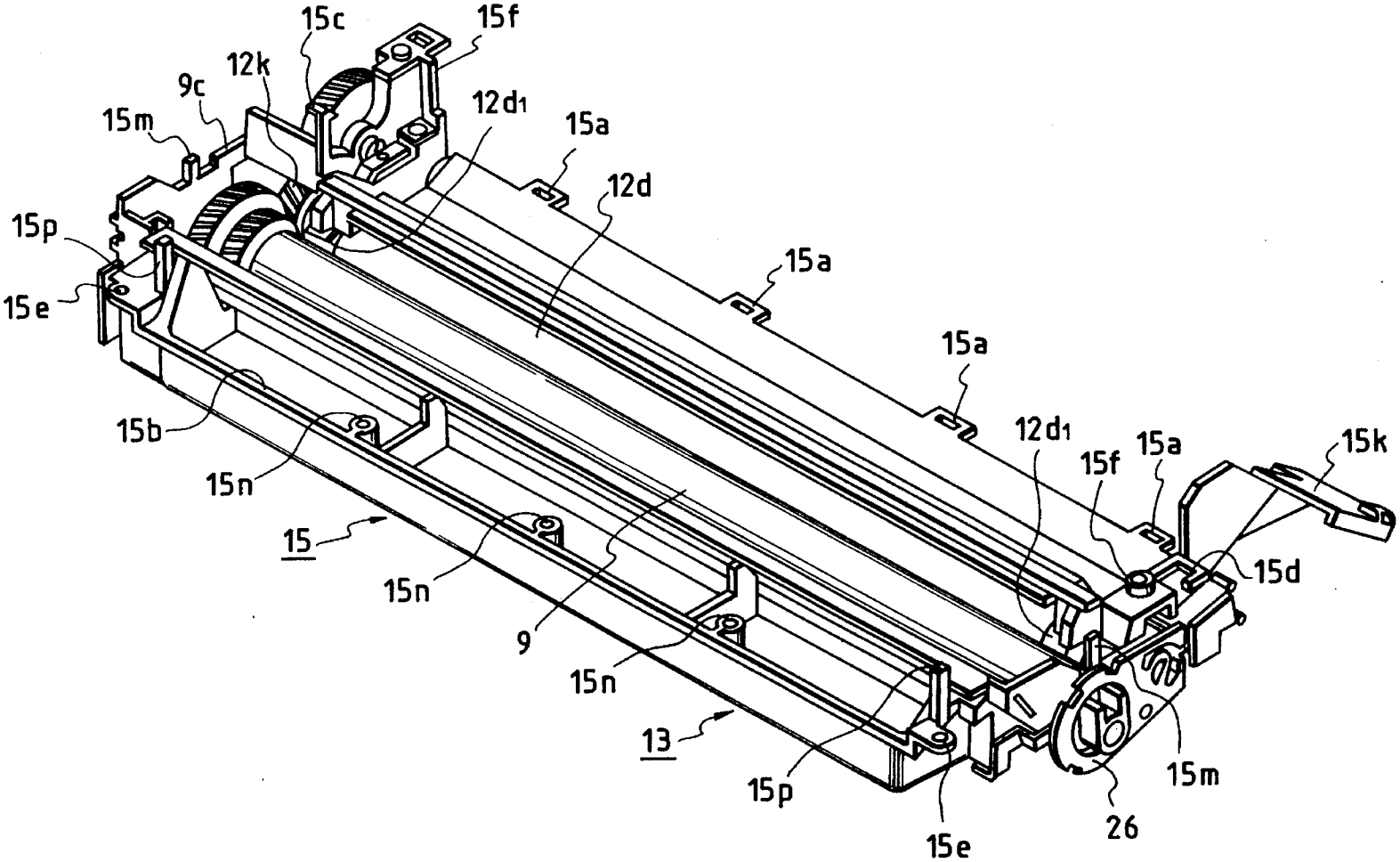
FIG. 8 is a perspective view of the lower frame showing an internal structure thereof.
Figure 9:
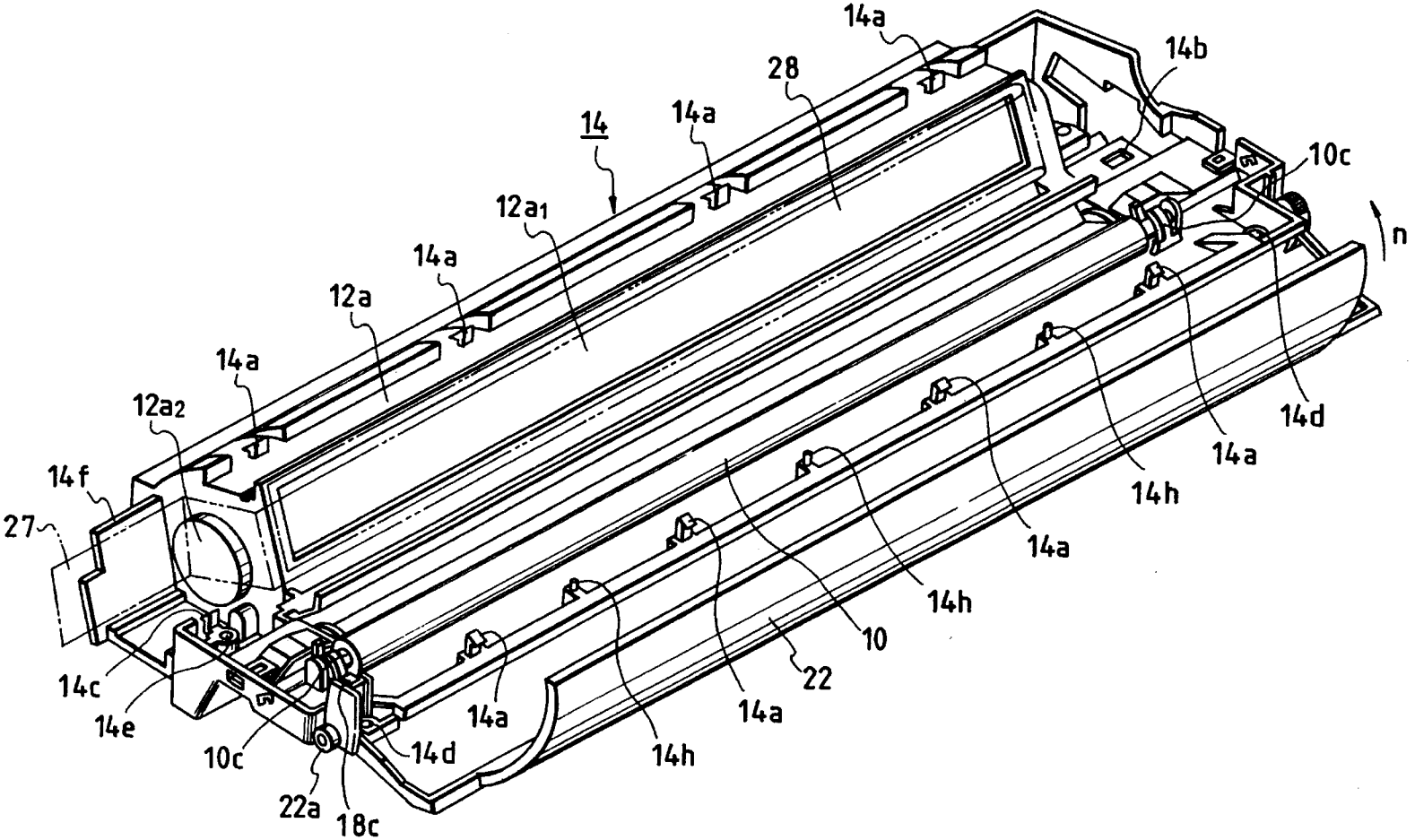
FIG. 9 is a perspective view of the upper frame showing an internal structure thereof.

Now, the various parts of the process cartridge B will be fully described regarding the charger means 11, exposure means 11, developing means 12 and cleaning means 13 in order. Incidentally, FIG. 7 is a sectional view of the process cartridge with the upper and lower frames separated from each other, FIG. 8 is a perspective view showing the internal construction of the lower frame, and FIG. 9 is a perspective view showing the internal construction of the upper frame.

Photosensitive Drum

In the illustrated embodiment, the photosensitive drum 9 comprises a cylindrical drum core 9*a* having a thickness of about 1 mm and made of aluminium, and an organic photosensitive layer 9*b* disposed on an outer peripheral surface of the drum core, so that an outer diameter of the photosensitive drum 9 becomes 24 mm. The photosensitive drum 9 is rotated in a direction shown by the arrow in response to the image forming operation, by transmitting a driving force of a drive motor 54 (FIG. 56) of the image forming apparatus to a flange gear 9*c* (FIG. 8) secured to one end of the photosensitive drum 9.

During the image forming operation, when the photosensitive drum 9 is being rotated, the surface of the photosensitive drum 9 is uniformly charged by applying to the charger roller 10 (contacting with the drum 9) a vibrating voltage obtained by overlapping a DC voltage with an AC voltage. In this case, in order to uniformly charge the surface of the photosensitive drum 9, the frequency of the AC voltage applied to the charger roller 10 must be increased. However, if the frequency exceeds about 2000 Hz, the photosensitive drum 9 and the charger roller 10 will be vibrated, thus generating the so-called "charging noise".

That is to say, when the AC voltage is applied to the charger roller 10, an electrostatic attraction force is generated between the photosensitive drum 9 and the charger roller 10, so that the attraction force becomes maximum at the maximum and minimum values of the AC voltage, thus attracting the charger roller 10 against the photosensitive drum 9 while elastically deforming the charger roller. On the other hand, at an intermediate value of the AC voltage, the attraction force becomes minimum, with the result that the elastical deformation of the charger roller 10 is restored to tray to separate the charger roller 10 from the photosensitive drum 9. Consequently, the photosensitive drum 9 and the charger roller 10 are vibrated at the frequency as twice as that of the applied AC voltage. Further, when the charger roller 10 is attracted against the photosensitive drum 9, the rotations of the drum and the roller are braked, thus causing the vibration due to the stick slip, which also results in the charging noise.

Figure 10:
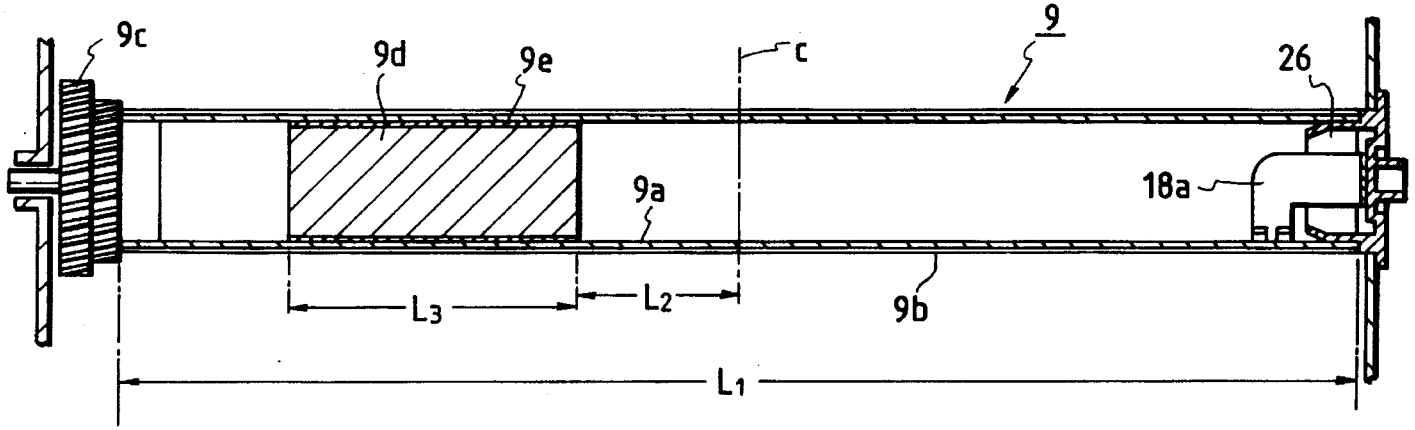
FIG. 10 is a longitudinal sectional view of a photosensitive drum of the process cartridge.

In order to reduce the vibration of the photosensitive drum 9, in the illustrated embodiment, as shown in FIG. 10 (sectional view of the drum), a rigid or elastic filler 9*d* is disposed within the photosensitive drum 9. The filler 9*d* may be made of metal such as aluminium, brass or the like, cement, ceramics such as gypsum, or rubber material such as natural rubber, in consideration of the productivity, workability, effect of weight and cost. The filler 9*d* has a solid cylindrical shape or a hollow cylindrical shape, and has an outer diameter smaller than an inner diameter of the photosensitive drum 9 by about 100 μm, and is inserted into the drum core 9*a*. That is to say, a gap between the drum core 9*a* and the filler 9*d* is set to have a value of 100 μm at the maximum, and an adhesive (for example, cyanoacrylate resin, epoxy resin or the like) 9*e* is applied on the outer surface of the filler 9*d* or on the inner surface of the drum core 9*a*, and the filler 9*d* is inserted into the drum core 9*a*, thus adhering them to each other.

Figure 11:
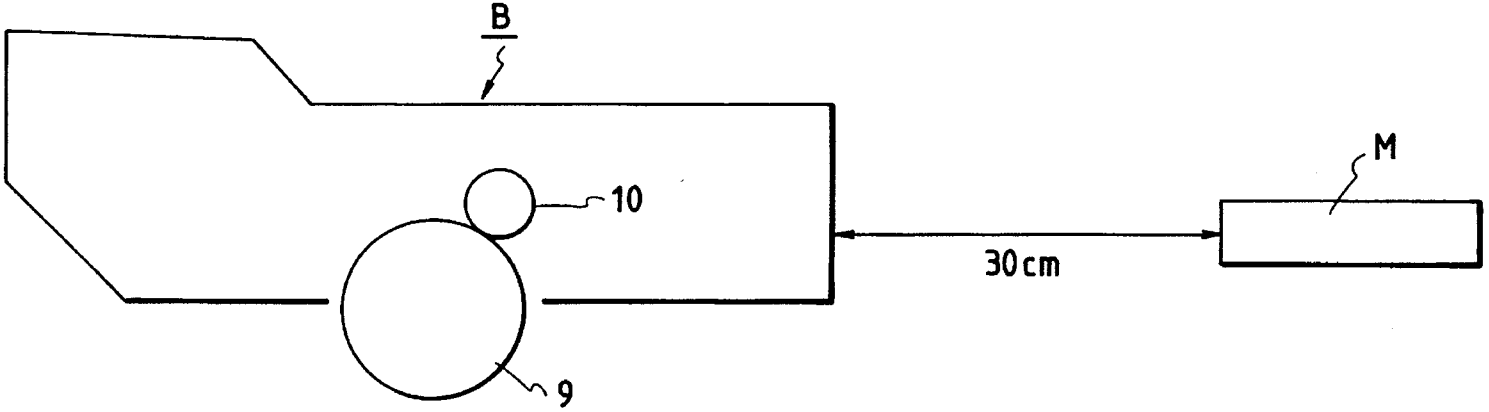
FIG. 11 is a schematic view for explaining the measurement of the charging noise.
Figure 12A:
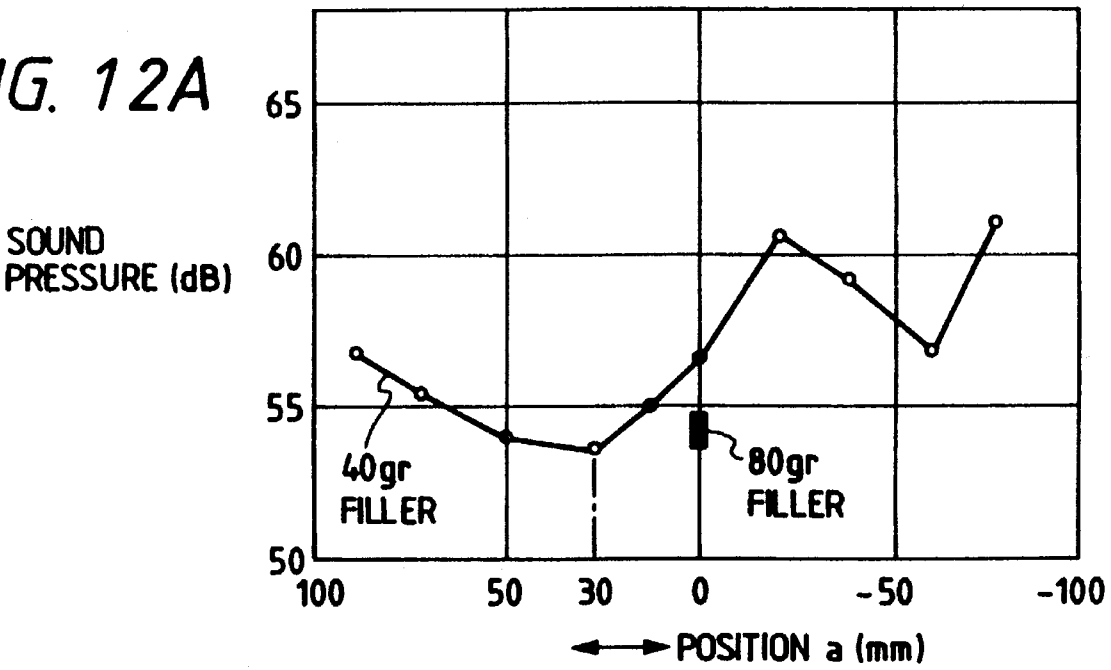
FIG. 12 is a graph showing the result of the measurement of the charging noise regarding a position of a filler.
Figure 12B:
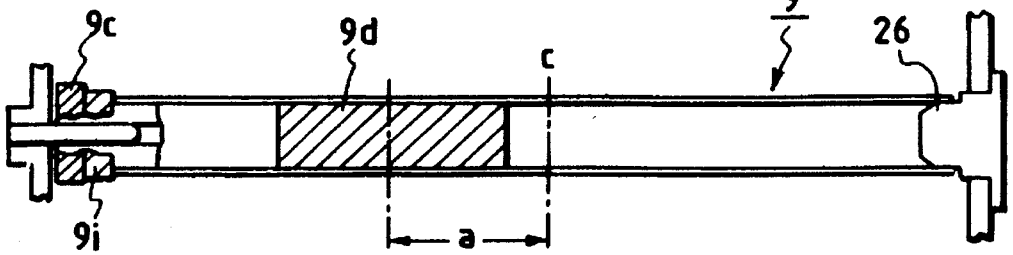

Now, the test results performed by the inventors, wherein the relation between the position of the filler 9*d* and the noise pressure (noise level) was checked by varying the position of the filler 9*d* in the photosensitive drum 9 will be explained. As shown in FIG. 11, the noise pressure was measured by a microphone M arranged at a distance of 30 cm from the front surface of the process cartridge B disposed in a room having the background noise of 43 dB. As result, as shown in FIG. 12, when the filler having a weight of 80 grams was arranged, at a central position in the longitudinal direction of the photosensitive drum 9, the noise pressure was 54.5–54.8 dB. Whereas, when the filler having a weight of 40 grams was arranged at a position offset from the central position toward the flange gear 9*c* by 30 mm, the noise pressure was minimum. From this result, it was found that it was more effective to arrange the filler 9*d* in the photosensitive drum 9 offset from the central position toward the gear flange 9*c*. The reason seems that one end of the photosensitive drum 9 is supported via the flange gear 9*c* while the other end of the drum 9 is supported by a bearing member 26 having no flange, so that the construction of the photosensitive drum 9 is not symmetrical with respect the central position in the longitudinal direction of the drum.

Thus, in the illustrated embodiment, as shown in FIG. 10, the filler 9*d* is arranged in the photosensitive drum 9 offset from the central position c (in the longitudinal direction of the drum) toward the flange gear 9*c*, i.e., toward the drive transmission mechanism to the photosensitive drum 9. Incidentally, in the illustrated embodiment, a filler 9*d* comprising a hollow aluminium member having a length L3 of 40 mm and a weight of about 20–60 grams, preferably 35–45 grams (most preferably about 40 grams) is positioned within the photosensitive drum 9 having a longitudinal length L1 of 257 mm at a position offset from the central position c toward the flange gear 9*c* by a distance L2 of 9 min. By arranging the filler 9*d* within the photosensitive drum 9, the latter can be rotated stably, thus suppressing the vibration due to the rotation of the photosensitive drum 9 in the image forming operation. Therefore, even when the frequency of the AC voltage applied to the charger roller 10 is increased, it is possible to reduce the charging noise.

Further, in the illustrated embodiment, as shown in FIG. 10, an earthing contact 18*a* is contacted with the inner surface of the photosensitive drum 9 and the other end of the earthing contact is abutted against a drum earth contact pin 35*a*, thereby electrically earthing the photosensitive drum 9. The earthing contact 18*a* is arranged at the end of the photosensitive drum opposite to the end adjacent to the flange gear 9*c*.

Figure 13:
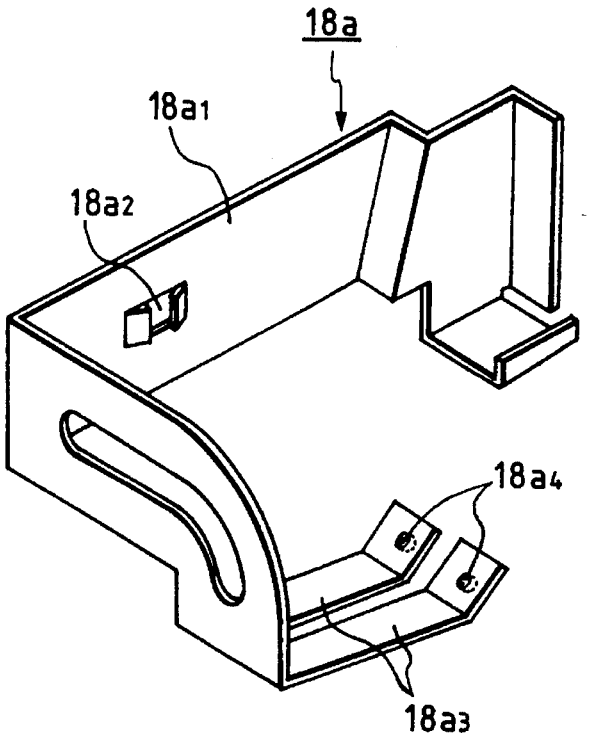
FIG. 13 is a perspective view of an earthing contact for the photosensitive drum.

The earthing contact 18*a* is made of spring stainless steel, spring bronze phosphate or the like and is attached to the bearing member 26. More particularly, as shown in FIG. 13, the earthing contact comprises a base portion 18a1 having a locking opening 18*a*2 into which a boss formed on the bearing member 26 can be fitted, and two are portions 18a3 extending from the base portion 18a1, each arm portion being provided at its free end with a semi-circular projection 18a4 protruding downwardly. When the bearing member 26 is attached to the photosensitive drum 9, the projections 18a4 of the earthing contact 18*a* are urged against the inner surface of the photosensitive drum 9 by the elastic force of the arm portions 18a3. In this case, since the earthing contact 18*a* is contacted with the photosensitive drum at plural points (two points), the reliability of the contact is improved, and, since the earthing contact 18*a* is contacted with the photosensitive drum via the semi-circular projections 18a4, the contact between the earthing contact and the photosensitive drum 9 is stabilized.

Figure 14:
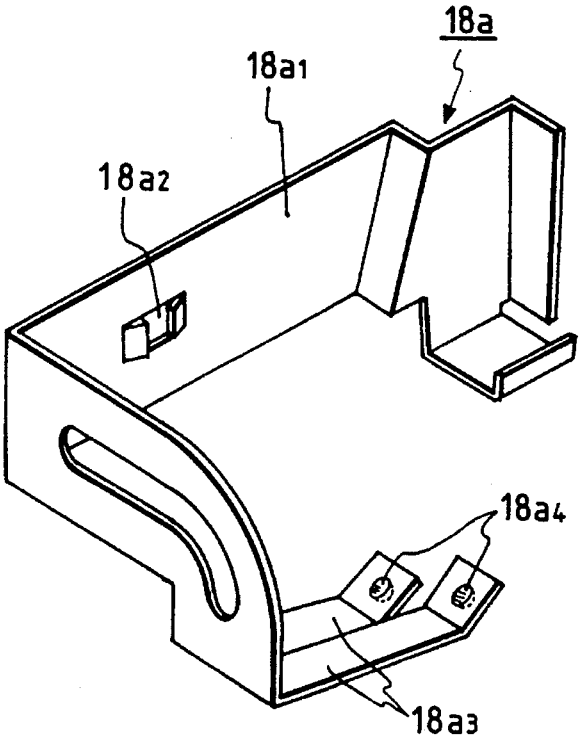
FIG. 14 is a perspective view of an earthing contact for the photosensitive drum, according to another embodiment.

Incidentally, as shown in FIG. 14, lengths of the arm portions 18a3 of the earthing contact 18*a* may be differentiated from each other. With this arrangement, since positions where the semi-circular projections 18a4 are contacted with the photosensitive drum 9 are offset from each other in the circumferential direction of the drum, even if there is a crack portion extending in the axial direction in the inner surface of the photosensitive drum 9, both projections 18a4 do not contact with such crack portion simultaneously, thereby maintaining the earthing contact (between the contact and the drum) without fail. Incidentally, when the lengths of the arm portions 18a3 are differentiated, the contacting pressure between one of the arm portions 18a3 and the photosensitive drum is differentiated from the contacting pressure between the other arm portion and the drum. However, such difference can be compensated, for example, by changing the bending angles of the arm portions 18a3.

Figure 15:
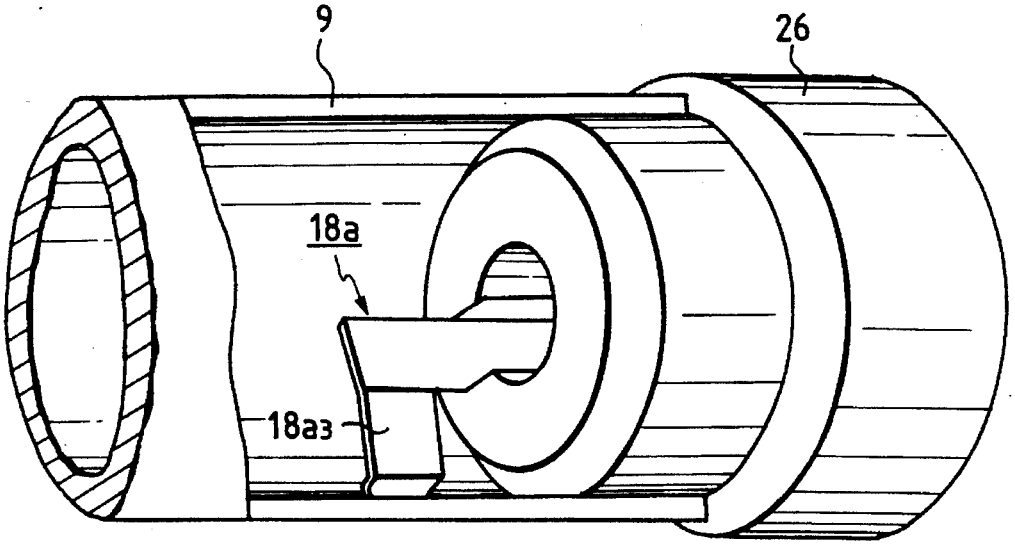
FIG. 15 is a perspective view showing an embodiment wherein an earthing contact, which is not bifurcated, is used with the photosensitive drum.
Figure 16:
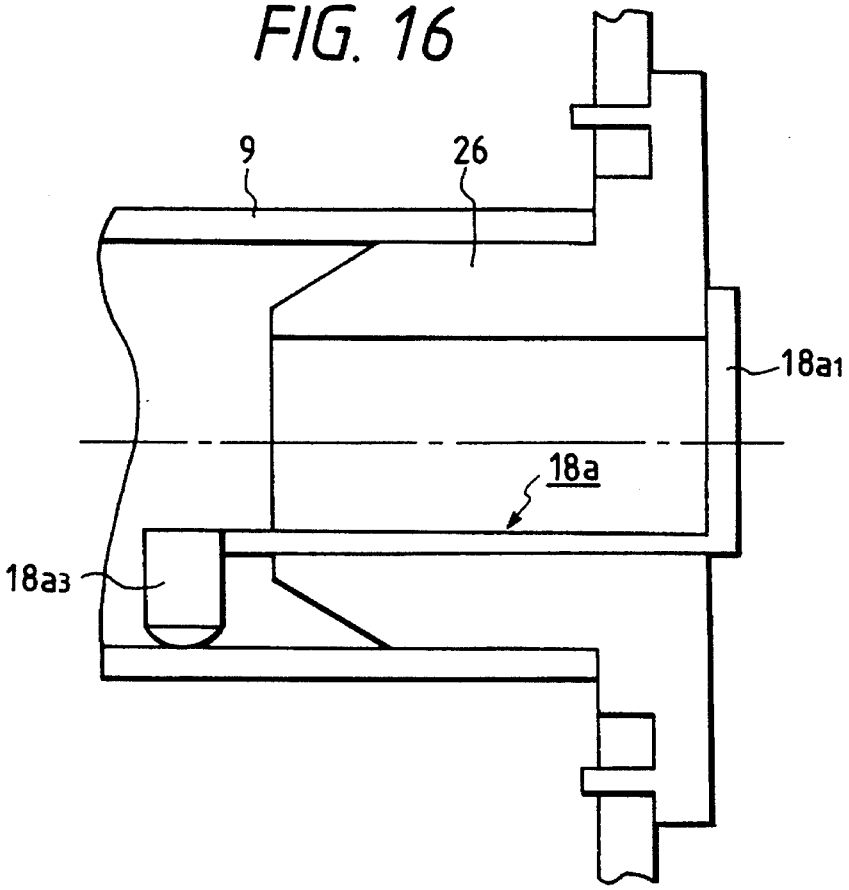
FIG. 16 is a sectional view of the non-bifurcated earthing contat used with the photosensitive drum.

In the illustrated embodiment, while the earthing contact 18*a* had two arm portions 18a3 as mentioned above, three or more arm portions may be provided, or, when the earthing contact is contacted with the inner surface of the photosensitive drum 9 without fail, a single arm portion 18a3 (not bifurcated) having no projection may be used, as shown in FIGS. 15 and 16.

Now, if the contacting pressure between the earthing contact 18*a* and the inner surface of the photosensitive drum 9 is too weak, the semi-circular projections 18a4 cannot follow the unevenness of the inner surface of the photosensitive drum, thus causing the poor contact between the earthing contact and the photosensitive drum and generating noise due to the vibration of the arm portions 18a3. In order to prevent such poor contact and noise, the contacting pressure must be increased. However, if the contacting pressure is too strong, when the image forming system is used for a long time, the inner surface of the photosensitive drum will be damaged by the high pressure of the semi-circular projections 18a4. Consequently, when the semi-circular projections 18a4 pass through such damaged portion, vibration occurs, thus causing poor contact and vibration noise. In consideration of the above affairs, it is preferable that the contacting pressure between the earthing contact 18*a* and the inner surface of the photosensitive drum is set in a range between about 10 grams and about 200 grams. That is to say, according to the test result effected by the inventors, when the contacting pressure was smaller than about 10 grams, it was feared that poor contact was likely to occur in response to the rotation of the photosensitive drum, thus causing radio wave jamming regarding other electronic equipments. On the other hand, when the contacting pressure was greater than about 200 grams, it was feared that the inner surface of the photosensitive drum 9 was damaged due to the sliding contact between the drum inner surface and the earthing contact 18*a* for a long time, thus causing abnormal noise and/or poor contact.

Incidentally, although the generation of the above noise and the like sometimes cannot be eliminated completely because of the inner surface condition of the photosensitive drum, it is possible to reduce the vibration of the photosensitive drum 9 by arranging the filler 9*d* within the drum 9, and it is also possible to prevent the damage of the drum and the poor contact more effectively by disposing the conductive grease on the contacting area between the earthing contact 18*a* and the inner surface of the photosensitive drum 9. Further, since the earthing contact 18*a* positioned on the bearing member 26 situated remote from the filler 9*d* offset toward the flange gear 9*c*, the earthing contact can easily be attached to the bearing member.

Charger Means

The charger means serves to charge the surface of the photosensitive drum 9. In the illustrated embodiment, the charger means is of so-called contact charging type as disclosed in the Japanese Patent Laid-open Appln. No. 63-149669. More specifically, as shown in FIG. 4, the charger roller 10 is rotatably mounted on the inner surface of the upper frame 14 via a slide bearing 10*c*. The charger roller 10 comprises a metallic roller shaft 10*b* (for example, a conductive metal core made of iron, SUS or the like), an elastic rubber layer made of EPDM, NBR or the like and arranged around the roller shaft, and an urethane rubber layer dispersing carbon therein and arranged around the elastic rubber layer, or comprise a metallic roller shaft and a foam urethane rubber layer dispersing carbon therein. The roller shaft 10*b* of the charger roller 10 is held by bearing slide guide pawls 10*d* of the upper frame 14 via the slide bearing 10*c* so that it cannot detached from the upper frame and it can slightly be moved toward the photosensitive drum 9. The roller shaft 10*b* is biased by a spring 10*a* so that the charger roller 10 is urged against the surface of the photosensitive drum 9. Thus, the charger means is constituted by the charger roller 10 incorporated into the upper frame 14 via the bearing 10*c*. In the image forming operation, when the charger roller 10 is driven by the rotation of the photosensitive drum 9, the surface of the photosensitive drum 9 is uniformly charged by applying the overlapped DC and AC voltage to the charger roller 10 as mentioned above.

Now, the voltage applied to the charger roller 10 will be described. Although the voltage applied to the charger roller 10 may be the DC voltage alone, in order to achieve the uniform charging, the vibration voltage obtained by overlapping the DC voltage and the AC voltage as mentioned above should be applied to the charger roller. Preferably, the vibration voltage obtained by overlapping the DC voltage having a peak-to-peak voltage value greater, by twice or more, than the charging start voltage when the DC voltage along is used, and the AC voltage is applied to the charger roller 10 to improve the uniform charging (refer to the Japanese Patent Laid-open Appln. No. 63-149669). The "vibration voltage" described herein means a voltage that the voltage value is periodically changed as a function of time and that preferably has the peak-to-peak voltage greater, by twice or more, than the charging start voltage when the surface of the photosensitive drum is charged only by the DC voltage. Further, the waveform of the vibration voltage is not limited to the sinusoidal wave, but may be rectangular wave, triangular wave or pulse wave. However, the sinusoidal wave not including the higher harmonic component is preferable in view of the reduction of the charging noise. The DC voltage may include a voltage having the rectangular wave obtained by periodically turning ON/OFF a DC voltage source, for example.

Figure 17:
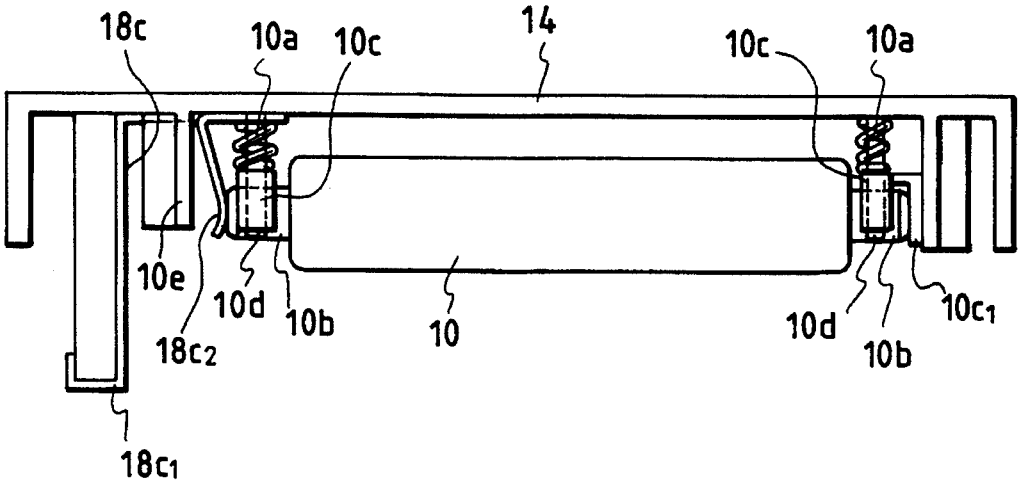
FIG. 17 is an elevational view showing an attachment structure for a charger roller.

As shown in FIG. 17, the application of the voltage to the charger roller 10 is accomplished by urging one end 18c1 of a charging bias contact 18*c* against a charging bias contact pin of the image forming apparatus as will be described later, and the other end 18c2 of the charging bias contact 18*c* is urged-against the metallic roller shaft 10*b*, thereby applying the voltage to the charger roller 10. Incidentally, since the charger roller 10 is biased by the elastic contact 18*c* toward the right in FIG. 17, the charger roller bearing 10*c* disposed remote from the contact 18*c* has a hooked stopper portion 10c1. Further, a stopper portion 10*e* depending from the upper frame 14 is arranged near the contact 18*c* in order to prevent the excessive axial movement of the charger roller 10 when the process cartridge B is dropped or vibrated.

In the illustrated embodiment, with the arrangement as mentioned above, the voltage of 1.6–2.4 KVVpp, −600 VVDC (sinusoidal wave) is applied to the charger roller 10.

When the charger roller 10 is incorporated into the upper frame 14, first of all, the bearing 10*c* is supported by the guide pawls 10*d* of the upper frame 14 and then the roller shaft 10*b* of the charger roller 10 is fitted into the bearing 10*c*. And, when the upper frame 14 is assembled with the lower frame 15, the charger roller 10 is urged against the photosensitive drum 9, as shown in FIG. 4.

Incidentally, the bearing 10*c* for the charger roller 10 is made of conductive bearing material including a great amount of carbon filler, and the voltage is applied to the charger roller 10 from the charging bias contact 18*c* via the metallic spring 10*a* so that the stable charging bias can be supplied.

Exposure Means

The exposure means 11 serves to expose the surface of the photosensitive drum 9 uniformly charged by the charger roller 10 with a light image from the reading means 1. As shown in FIGS. 1 and 4, the upper frame 14 is provided with an opening 11*a* through which the light from the lens array 1c2 of the image forming system is illuminated onto the photosensitive drum 9. Incidentally, when the process cartridge B is removed from the image forming apparatus A, if the photosensitive drum 9 is exposed by the ambient light through the opening 11*a*, it is feared that the photosensitive drum is deteriorated. To avoid this, a shutter member 11*b* is attached to the opening 11*a* so that when the process cartridge B is removed from the image forming apparatus A the opening 11*a* is closed by the shutter member 11*b* and when the process cartridge is mounted within the image forming apparatus the shutter member opens the opening 11*a*.

Figure 18A:
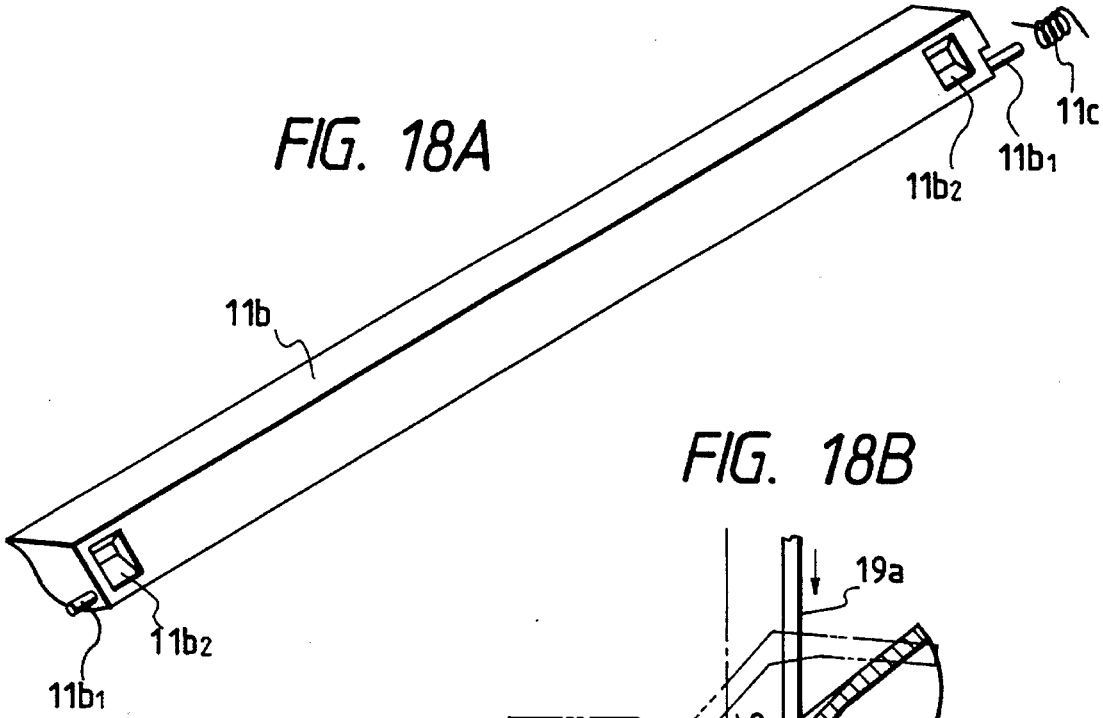
FIG. 18A is a perspective view of an exposure shutter.
Figure 18B:
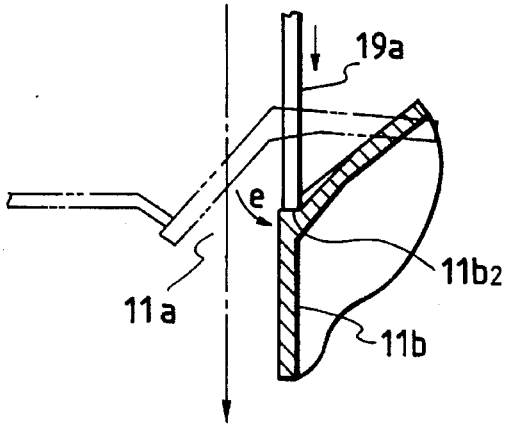
FIG. 18B is a partial sectional view of the exposure shutter.

As shown in FIGS. 18A and 18B, the shutter member 11*b* has an L-shaped cross-section having a convex portion directing toward the outside of the cartridge, and is pivotally mounted on the upper frame 14 via pins 11b1. A torsion coil spring 11*c* is mounted around one of the pins 11b1 so that the shutter member 11*b* is biased by the coil spring 11*c* to close the opening 11*a* in a condition that the process cartridge B is dismounted from the image forming apparatus A.

As shown in FIG. 18A, abutment portions 11b2 are formed on the outer surface of the shutter member 11*b* so that, when the process cartridge B is mounted within the image forming apparatus A and an upper opening/closing cover 19 (FIG. 1) openable with respect to the body 16 of the image forming apparatus is closed, a projection 19*a* formed on the cover 19 is abutted against the abutment portions 11b2, thereby rotating the shutter member 11*b* in a direction shown by the arrow e (FIG. 18B) to open the opening 11*a*.

In the opening and closing operation of the shutter member 11*b*, since the shutter member 11*b* has the L-shaped cross-section and the abutment portions 11b2 are disposed outwardly of the contour of the cartridge B and near the pivot pins 11b1, as shown in FIGS. 4 and 18B, the shutter member 11*b* is abutted against the projection 19*a* of the cover 19 outwardly of the contour of the process cartridge B. As a result, even when the opening and closing angle of the shutter member 11*b* is small, a leading end of the rotating shutter member 11*b* is surely opened, thereby surely illuminating the light from the lens array 1c2 disposed above the shutter member onto the photosensitive drum to form the good electrostatic latent image on the surface of the photosensitive drum 9. By constituting the shutter member 11*b* as mentioned above, when the process cartridge B is inserted into the image forming system, it is not necessary to retard the cartridge B from the shutter opening projection 19*a* of the cover 19 of the image forming apparatus, with the result that it is possible to shorten the stroke of the projection, thereby making the process cartridge B and the image forming apparatus A small-sized.

Developing Means

Next, the developing means 12 will be explained. The developing means 12 serves to visualize the electrostatic latent image formed on the photosensitive drum 9 by the exposure means with toner as a toner image. Incidentally, in this image forming apparatus A, although magnetic toner or non-magnetic toner can be used, in the illustrated embodiment, the developing means in the process cartridge B includes the magnetic toner as one-component magnetic developer.

Binder resin of the one-component magnetic toner used in the developing operation may be the following or a mixture of the following polymer of styrene and substitute thereof such as polystyrene and polyvinyltoluene; styrene copolymer such as styrene-propylene copolymer, styrene-vinyltoluene copolymer, styrene-vinylnaphthalene copolymer, styrene-acrylic acid ethyl copolymer or styrene-acrylic acid butyl copolymer; polymetylmethacrylate, polybuthymethacrylate, polyvinylacetate, polyethylene, polypropylene, polyvinylbutyral, polycrylic acid resin, rosin, modified rosin, turpentine resin, phenolic resin, aliphatic hydrocarbon resin, alicyclic hydrocarbon resin, aromatic petroleum resin, paraffin wax, carnauba wax or the like.

As for the coloring material added to the magnetic toner it may be known carbon black, copper phthalocyanine, iron black or the like. The magnetic fine particles contained in the magnetic toner may be of the material magnetizable when placed in the magnetic field, such as ferromagnetic powder of metal such as iron, cobalt, and nickel, powder of metal alloy or powder of compound such as magnetite or ferrite.

As shown in FIG. 4, the developing means 12 for forming the toner image with the magnetic toner has a toner reservoir 12*a* for containing the toner, and a toner feed mechanism 12*b* disposed within the toner reservoir 12*a* and adapted to feed out the toner. Further, the developing means is so designed that the developing sleeve 12*d* having a magnet 12*c* therein is rotated to form a thin toner layer on a surface of the developing sleeve. When the toner layer is being formed on the developing sleeve 12*d*, the developable frictional charging charges are applied to the electrostatic latent image on the photosensitive drum 9 by the friction between the toner and the developing sleeve 12*d*. Further, in order to regulate a thickness of the toner layer, a developing blade 12*e* is urged against the surface of the developing sleeve 12*d*. The developing sleeve 12*d* is disposed in a confronting relation to the surface of the photosensitive drum 9 with a gap of about 100–400 μm therebetween.

As shown in FIG. 4, the magnetic toner feed mechanism 12*b* has feed members 12b1 made of polypropylene (PP), acrylobutadienestyrol (ABS), high-impact styrol (HIPS) or the like and reciprocally shiftable in a direction shown by the arrows f along a bottom surface of the toner reservoir 12*a*. Each feed member 12b1 has a substantial triangular cross-section and is provided with a plurality of long rod members extending along the rotation axis of the photosensitive drum (direction perpendicular to the plane of FIG. 4) for scraping the whole bottom surface of the toner reservoir 12*a*. The rod members are interconnected at their both ends to constitute an integral structure. Further, there are three feed members 12b1, and the shifting range of the feed members are selected to be greater than a bottom width of the triangular cross-section so that all of the toner on the bottom surface of the toner reservoir can be scraped. In addition, an arm member 12b2 is provided at its free end with a projection 12b6, thereby preventing the feed members 12b1 from floating and being disordered.

The feed member 12b1 has a lock projection 12b4 at its one longitudinal end, which projection is rotatably fitted into a slot 12b5 formed in the arm member 12b2. The arm member 12b2 is rotatably mounted on the upper frame 14 via a shaft 12b3 and is connected to an arm (not shown) disposed outside the toner reservoir 12*a*. Further, a drive transmitting means is connected to the feed members 12b1 so that, when the process cartridge B is mounted within the image forming apparatus A, the driving force from the image forming apparatus is transmitted to the feed members to swing the arm member 12b2 around the shaft 12b3 by a predetermined angle. Incidentally, as shown in FIG. 7 and the like, the feed members 12b1 and the arm member 12b2 may be integrally formed from resin such as polypropylene, polyamide or the like so that they can be folded at a connecting portion therebetween.

Accordingly, in the image forming operation, when the arm member 12b2 is rocked by the predetermined angle, the feed members 12b1 are reciprocally shifted along the bottom surface of the toner reservoir 12*a* in directions f between a condition shown by the solid lines and a condition shown by the broken lines. Consequently, the toner situated near the bottom surface of the toner reservoir 12*a* is fed toward the developing sleeve 12*d* by the feed members 12b1. In this case, since each feed member 12b1 has the triangular cross-section, the toner is scraped by the feed members and is gently fed along inclined surfaces of the feed members 12b1. Thus, the toner near the developing sleeve 12*d* is hard to be agitated, and, therefore, the toner layer formed on the surface of the developing sleeve 12*d* is hard to be deteriorated.

Further, as shown in FIG. 4, a lid member 12*f* of the toner reservoir 12*a* is provided with a depending member 12f1. A distance between a lower end of the depending member 12f1 and the bottom surface of the toner reservoir is selected so as to be slightly greater than a height of the triangular cross-section of each toner feed member 12b1. Accordingly, the toner feed member 12b1 is reciprocally shifted between the bottom surface of the toner reservoir and the depending member 12f1, with the result that, if the feed member 12b1 tries to float from the bottom surface of the toner reservoir, such floating is limited or regulated, thus preventing the floating of the feed members 12b1.

Incidentally, the image forming apparatus A according to the illustrated embodiment can also receive a process cartridge including the non-magnetic toner. In this case, the toner feed mechanism is driven to agitate the non-magnetic toner near the developing sleeve 12*d*.

Figure 19:
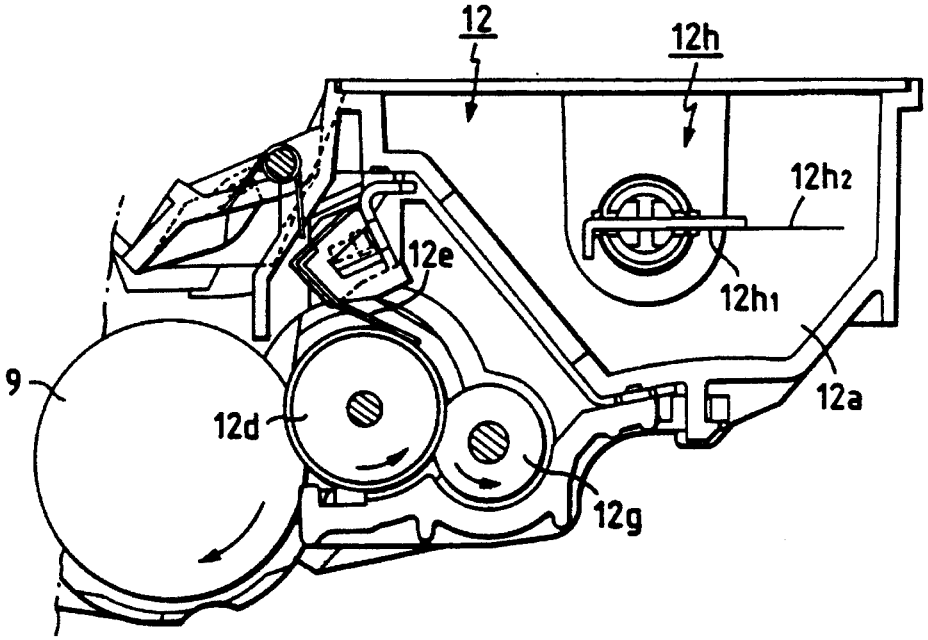
FIG. 19 is a sectional view showing a non-magnetic toner feeding mechanism having an agitating vane.

That is to say, when the non-magnetic toner is used, as shown in FIG. 19, an elastic roller 12*g* rotated in a direction the same as that of the developing sleeve 12*d*, which feeds the non-magnetic toner fed from the toner reservoir 12*a* by the toner feed mechanism 12*h* toward the developing sleeve 12*d*. In this case, at a nip between the developing sleeve 12*d* and the elastic roller 12*g*, the toner on the elastic roller 12*g* is frictionally charged by the sliding contact between the toner and the developing sleeve 12*d* to be adhered onto the developing sleeve 12*d* electrostatically. Thereafter, during the rotation of the developing sleeve 12*d*, the non-magnetic toner adhered to the developing sleeve 12*d* enters into an abutment area between the developing blade 12*e* and the developing sleeve 12*d* to form the thin toner layer on the developing sleeve, and the toner is frictionally charged by the sliding contact between the toner and the developing sleeve with the polarity sufficiently to develop the electrostatic latent image. However, when the toner remains on the developing sleeve 12*d*, the remaining toner is mixed with the new toner fed to the developing sleeve 12*d* and is fed to the abutment area between the developing sleeve and the developing blade 12*e*. The remaining toner and the new toner are frictionally charged by the sliding contact between the toner and the developing sleeve 12*d*. In this case, however, although the new toner is charged with the proper charge, since the remaining toner is further charged from the condition that it has already been charged with the proper charge, it is over-charged. The over-charged or excessively charged toner has an adhesion force (to the developing sleeve 12*d*) stronger than that of the properly charged toner, thus becoming harder to use in the developing operation.

To avoid this, in the illustrated embodiment, regarding the process cartridge containing the non-magnetic toner, as shown in FIG. 19, the non-magnetic toner feed mechanism 12*h* comprises a rotary member 12h1 disposed in the toner reservoir 12*a*, which rotary member 12h1 has an elastic agitating vane 12h2. When the non-magnetic toner cartridge is mounted within the image forming apparatus A, the drive transmitting means is connected to the rotary member 12h1 so that the latter is rotated by the image forming apparatus in the image forming operation. In this way, when the image is formed by using the cartridge containing the non-magnetic toner and mounted within the image forming apparatus, the toner in the toner reservoir 12*a* is greatly agitated by the agitating vane 12h2. As a result, the toner near the developing sleeve 12*d* is also agitated to be mixed with the toner in the toner reservoir 12*a*, thereby dispersing the charging charges removed from the developing sleeve 12*d* in the toner within the toner reservoir to prevent the deterioration of the toner.

By the way, the developing sleeve 12*d* on which the toner layer is formed is arranged in a confronting relation to the photosensitive drum 9 with a small gap therebetween (about 300 μm regarding the process cartridge containing the magnetic toner, or about 200 μm regarding the process cartridge containing the non-magnetic toner). Accordingly, in the illustrated embodiment, abutment rings each having an outer diameter greater than that of the developing sleeve by an amount corresponding to the small gap are arranged in the vicinity of both axial ends of the developing sleeve 12*d* and outside the toner layer forming area so that these rings are abutted against the photosensitive drum 9 at zones outside the latent image forming area.

Figure 20:
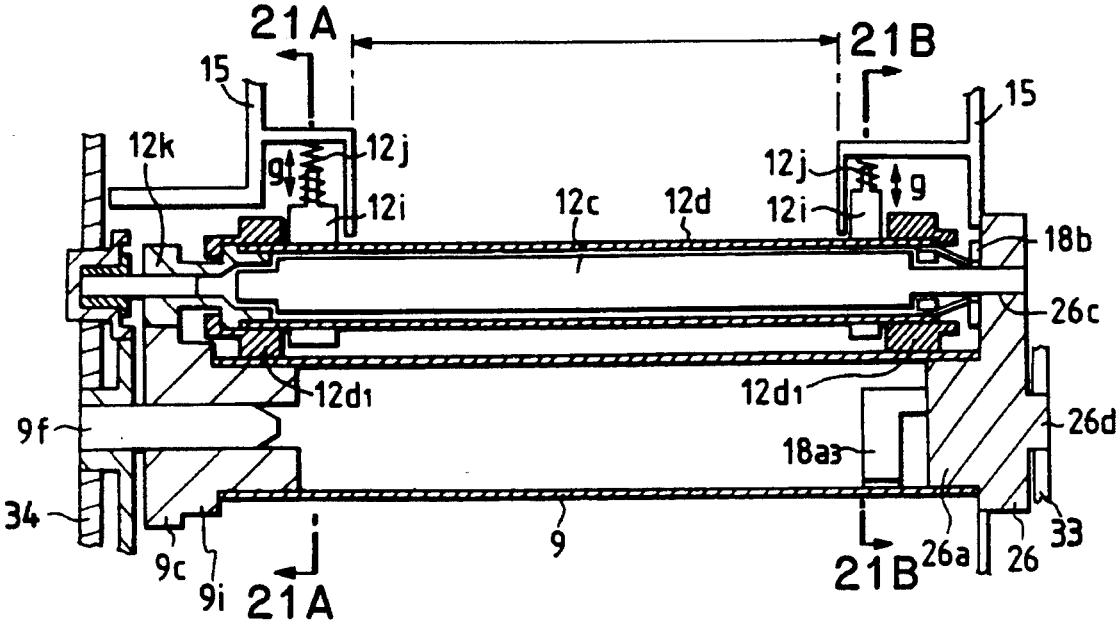
FIG. 20 is a longitudinal sectional view showing a positional relation between the photosensitive drum (9) and a developing sleeve (12*d*) and a structure for pressurizing the developing sleeve.
Figure 21A:
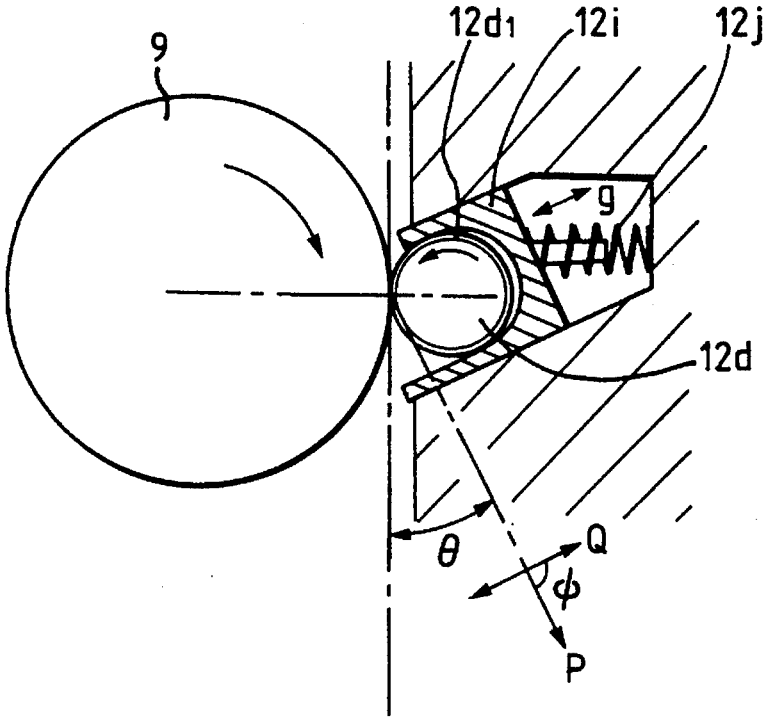
FIG. 21A is a sectional view taken along the line A—A of FIG. 20.
Figure 21B:
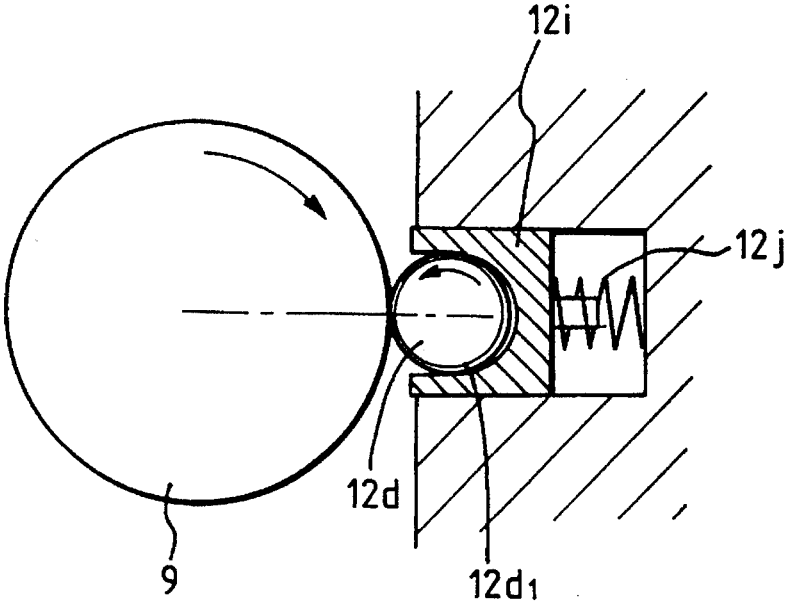
FIG. 21B is a sectional view taken along the line B—B of FIG. 20.

Now, the positional relation between the photosensitive drum 9 and the developing sleeve 12*d* will be explained. FIG. 20 is a longitudinal sectional view showing a positional relation between the photosensitive drum 9 and the developing sleeve 12*d* and a structure for pressurizing the developing sleeve, FIG. 21A is a sectional view taken along the line A—A of FIG. 20, and FIG. 21B is a sectional view taken along the line B—B of FIG. 20.

As shown in FIG. 20, the developing sleeve 12*d* on which the toner layer is formed is arranged in a confronting relation to the photosensitive drum 9 with the small gap therebetween (about 200–300 μm). In this case, the photosensitive drum 9 is rotatably mounted on the lower frame 15 by rotatably supporting a rotary shaft 9*f* of the flange gear 9*c* at the one end of the drum via a supporting member 33. The other end of the photosensitive drum 9 is also rotatably mounted on the lower frame 15 via a bearing portion 26*a* of the bearing member 26 secured to the lower frame. The developing sleeve 12*d* has the above-mentioned abutment rings 12d1 each having the outer diameter greater than that of the developing sleeve by the amount corresponding to the small gap and arranged in the vicinity of both axial ends of the developing sleeve and outside the toner layer forming area so that these rings are abutted against the photosensitive drum 9 at the zones outside the latent image forming area.

Further, the developing 12*d* is rotatably supported by sleeve bearings 12*i* disposed between the abutment rings 12d1 in the vicinity of both axial ends of the developing sleeve and outside the toner layer forming area, which sleeve bearings 12*i* are mounted on the lower frame 15 in such a manner that they can be slightly shifted in directions shown by the arrow g in FIG. 20. Each sleeve bearing 12*i* has a rearwardly extending projection around which an urging spring 12*j* having one end abutted against the lower frame 15 is mounted. Consequently, the developing sleeve 12*d* is always biased toward the photosensitive drum 9 by these urging springs. With this arrangement, the abutment rings 12da are always abutted against the photosensitive drum 9, with the result that a predetermined amount of gas between the developing sleeve 12*d* and the photosensitive drum 9 is always maintained, thereby transmitting the driving force to the flange gear 9*c* of the photosensitive drum 9 and a sleeve gear 12*k* of the developing sleeve 12*d* meshed with the flange gear 9*c*.

The sleeve gear 12*k* also constitutes a flange portion of the developing sleeve 12*d*. That is to say, according to the illustrated embodiment, the sleeve gear 12*k* and the flange portion are integrally formed from resin material (for example, polyacetylene resin). Further, a metallic pin 12d2 having a small diameter (for example, made of stainless steel) and having one end rotatably supported by the lower frame 15 is press-fitted into a secured to the sleeve gear 12*k* (flange portion) at its center. This metallic pin 12d2 acts as a rotary shaft at one end of the developing sleeve 12*d*. According to the illustrated embodiment, since the sleeve gear and the flange portion can be integrally formed from resin, it is possible to facilitate the manufacturing of the developing sleeve and to make the developing sleeve 12*d* and the process cartridge B light-weighted.

Figure 22:
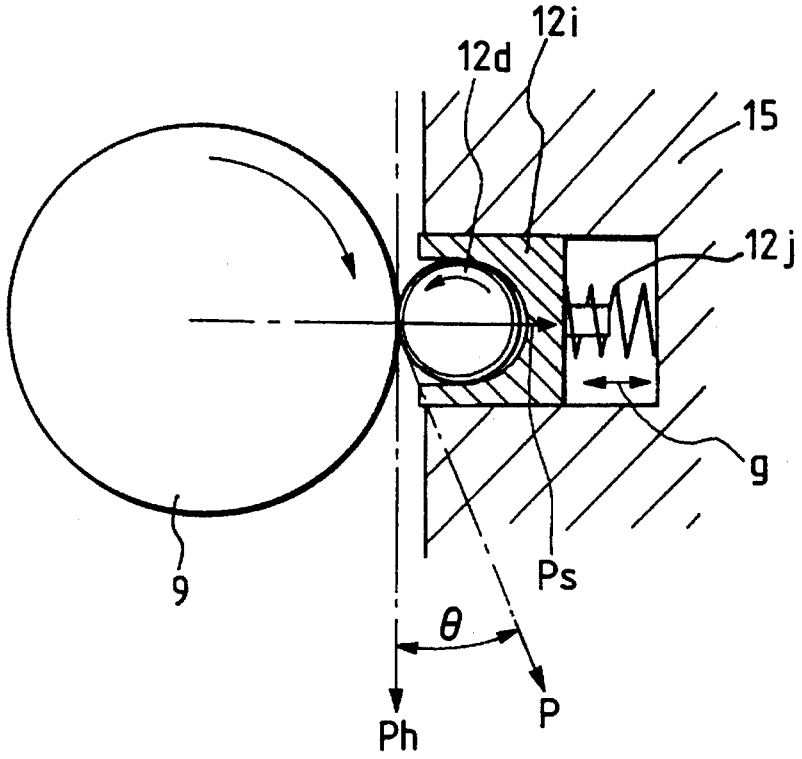
FIG. 22 is a sectional view for explaining the pressurizing force acting on the developing sleeve.

Now, the sliding directions of the sleeve bearings 12*i* will be explained with reference to FIG. 22. First of all, the driving of the developing sleeve 12*d* will be described. When the driving force is transmitted from the drive source (drive motor 54) of the image forming apparatus to the flange gear 9*c* and then is transmitted from the flange gear 9*c* to the sleeve gear 12*k*, the meshing force between the gears is directed to a direction inclined or offset from a tangential line contacting a meshing pitch circle of the flange gear 9*c* and a meshing pitch circle of the sleeve gear 12*k* by a pressure angle (20° in the illustrated embodiment). Thus, the meshing force is directed to a direction shown by the arrow P in FIG. 22 ($\theta \approx 20°$) . In this case, if the sleeve bearings 12*i* are slid in a direction parallel to a line connecting the center of rotation of the photosensitive drum 9 and the center of rotation of the developing sleeve 12*d*, when the meshing force P is divided into a force component Ps of a horizontal direction parallel with the sliding direction and a force component Ph of a vertical direction perpendicular to the sliding direction, as shown in FIG. 22, the force component of the horizontal direction parallel with the sliding direction is directed away from the photosensitive drum 9. As a result, regarding the driving of the developing sleeve 12*d*, the distance between the photosensitive drum 9 and the developing sleeve 12*d* is easily varied in accordance with the meshing force between the flange gear 9*c* and the sleeve gear 12*k*, with the result that the toner on the developing sleeve 12*d* cannot be moved to the photosensitive drum 9 properly, thus worsening the developing ability.

To avoid this, in the illustrated embodiment, as shown in FIG. 21A, in consideration of the transmission of the driving force from the flange gear 9*c* to the sleeve gear 12*k*, the sliding direction of the sleeve bearing 12*i* at the driving side (side where the sleeve gear 12*k* is disposed) is coincided with directions shown by the arrow Q. That is to say, an angle θ formed between the direction of the meshing force P (between the flange gear 9*c* and the sleeve gear 12*k*) and the sliding direction is set to have a value of about 90° (92° in the illustrated embodiment). With this arrangement, the force component Ps of the horizontal direction parallel with the sliding direction is negligible, and, in the illustrated embodiment, the force component Ps acts to slightly bias the developing sleeve 12*d* toward the photosensitive drum 9. In such a case, the developing sleeve 12*d* is pressurized by an amount corresponding to spring pressure α of the urging springs 12*j* to maintain the distance between the photosensitive drum 9 and the developing sleeve 12*d* constant, thereby ensuring the proper development.

Next, the sliding direction of the slide bearing 12*i* at the non-driving side (side where the sleeve gear 12*k* is not arranged) will be explained. At the non-driving side, to the above-mentioned driving side, since the slide bearing 12*i* does not receive a driving force, as shown in FIG. 21B, the sliding direction of the slide bearing 12*i* is selected to be substantially parallel with a line connecting a center of the photosensitive drum 9 and a center of the developing sleeve 12*d*.

In this way, when the developing sleeve 12*d* is pressurized toward the photosensitive drum 9, by changing the urging angle for urging the developing sleeve 12*d* at the driving side from that at the non-driving side, the positional relation between the developing sleeve 12*d* and the photosensitive drum 9 is always maintained properly, thus permitting proper development.

Incidentally, the sliding direction of the slide bearing 12*i* at the driving side may be set to be substantially parallel with the line connecting the center of the photosensitive drum 9 and the center of the developing sleeve 12*d* as in the case of the non-driving side. That is to say, as described in the above-mentioned embodiment, at the driving side, since the developing sleeve 12*d* is urged away from the photosensitive drum 9 by the force component Ps (of the meshing force between the flange gear 9*c* and the sleeve gear 12*k*) directing toward the sliding direction of the slide bearing 12*i*, in this embodiment, the urging force of the urging spring 12*j* at the driving side may be set to have a value greater than that at the non-driving side by an amount corresponding to the force component Ps. That is, when the urging force of the urging spring 12*j* to the developing sleeve 12*d* at the non-driving side is P, the urging force P2 of the urging spring 12*j* at the driving side is set to have a relation P2=P1+Ps, with the result that the developing sleeve 12*d* is always subjected to the proper urging force, thus ensuring the constant distance between the developing sleeve and the photosensitive drum 9.

Cleaning Means

The cleaning means 13 serves to remove the residual toner remaining on the photosensitive drum 9 after the toner image on the photosensitive drum 9 has been transferred to the recording medium 4 by the transfer means 6. As shown in FIG. 4, the cleaning means 13 comprises an elastic cleaning blade 13*a* contacting with the surface of the photosensitive drum 9 and adapted to remove or scrape off the residual toner remaining on the photosensitive drum 9, a squeegee sheet 13*b* slightly contacting with the surface of the photosensitive drum 9 and disposed below the cleaning blade 13*a* to receive the removed toner, and a waste toner reservoir 13*c* for collecting the waste toner received by the sheet 13*b*. Incidentally, the squeegee sheet 13*b* is slightly contacted with the surface of the photosensitive drum 9 and the serves to permit the passing of the residual toner remaining on the photosensitive drum, but to direct the toner removed from the photosensitive drum 9 by the cleaning blade 13*a* to a direction away from the surface of the photosensitive drum 9.

Figure 23:
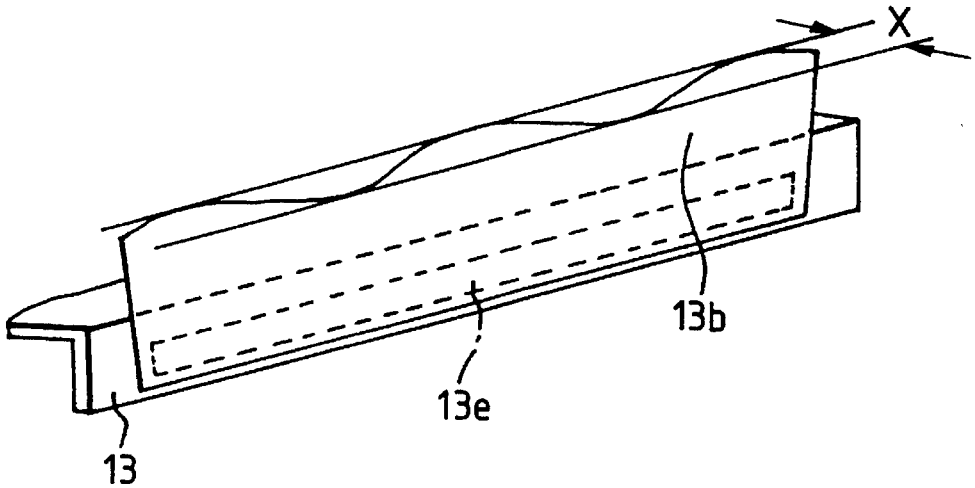
FIG. 23 is a perspective view of a squeegee sheet in a condition that an upper edge of the sheet is tortuous.

Now, a method for attaching the squeegee sheet 13*b* will be described. The squeegee sheet 13*b* is adhered to an attachment surface 13*d* of the waste toner reservoir 13*c* via a both-sided adhesive tape 13*e*. In this case, the waste toner reservoir 13*c* is made of resin material (for example, high-impact styrol (HIPS) or the like) and has a slight uneven surface. Thus, as shown in FIG. 23, if the both-sided adhesive tape 13*e* is merely sticked to the attachment surface 13*d* and the squeegee sheet 13*b* is merely attached to the adhesive tape 13*e*, it is feared that a free edge of the squeegee sheet 13*b* (to be contacted with the photosensitive drum 9) is tortuous shown by x. If such a tortuous edge x of the squeegee sheet 13*b* is generated, the squeegee sheet 13*b* does not closely contact with the surface of the photosensitive drum 9, so that it cannot surely receive the toner removed by the cleaning blade 13*a*.

Figure 24A:
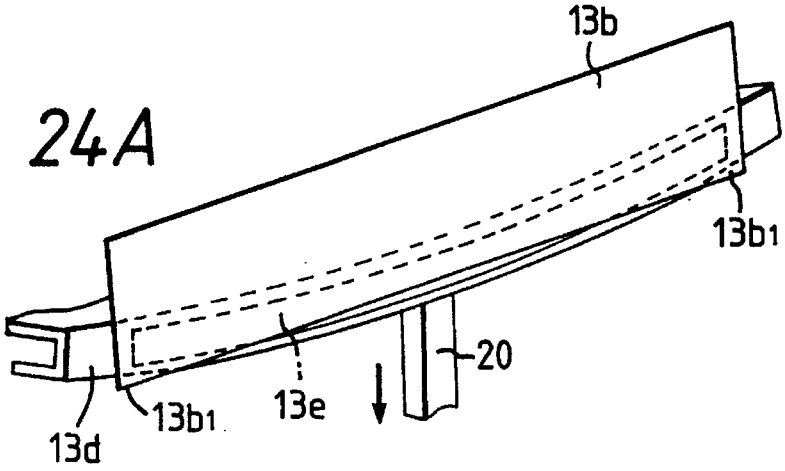
FIG. 24A is a perspective view showing a condition that a both-sided adhesive tape is protruded from a lower end of the squeegee sheet.

In order to avoid this, it is considered that, when the squeegee sheet 13*b* is attached to the attachment surface, as shown in FIG. 24A, the attachment surface 13*d* at a lower portion of the waste toner reservoir is pulled downwardly by a pulling tool 20 to elastically deform the attachment surface to for a curvature and then the squeegee sheet 13*b* is adhered to the curved attachment surface, and, thereafter the curvature of the attachment surface is released to apply the tension to the free edge of the squeegee sheet 13*b*, thereby preventing the free edge from becoming tortuous. However, in the recent small-sized process cartridges B, since the dimension of the attachment surface 13*d* is small, if the squeegee sheet 13*b* is adhered to the curved attachment surface 13*d*, as shown in FIG. 24A, both lower ends or corners 13b1 of the squeegee sheet 13*b* will be protruded from the attachment surface 13*d* downwardly. And, when the squeegee sheet 13*b* is protruded downwardly from the attachment surface 13*d*, as apparent from the sectional view of FIG. 1, it is feared that the recording medium 4 is interfered with the protruded squeegee sheet 13*b*.

Figure 24B:
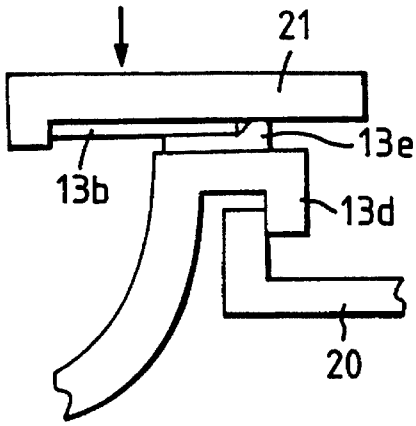
FIGS. 24B and 24C are views showing a condition that a sticking tool is adhered to the protruded both-sided adhesive tape.
Figure 24C:
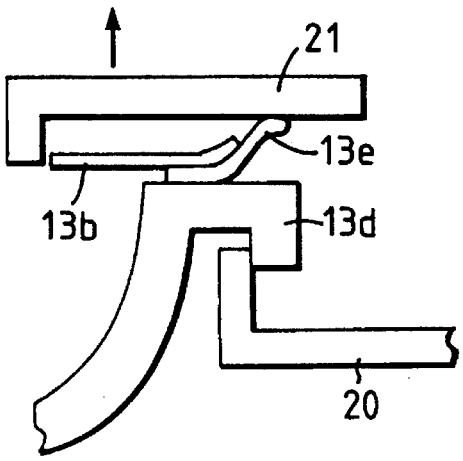

Further, it the squeegee sheet 13*b* is attached to the curved attachment surface 13*d*, as shown in FIG. 24A, the both-sided adhesive tape 13*e* will be protruded from the lower end of the squeegee sheet 13*b*. Thus, in this condition, when the squeegee sheet 13*b* is urged against the both-sided adhesive tape 13*e* by a sticking tool 21, as shown in FIG. 24B, the protruded portion of the both-sided adhesive tape 13*e* is adhered to the adhering tool 21, with the result that, when the adhering tool 21 is removed, as shown in FIG. 24C, the both-sided adhesive tape 13*e* is peeled from the attachment surface 13*d*, thus causing the poor attachment of the squeegee sheet 13*b*.

Figure 25A:
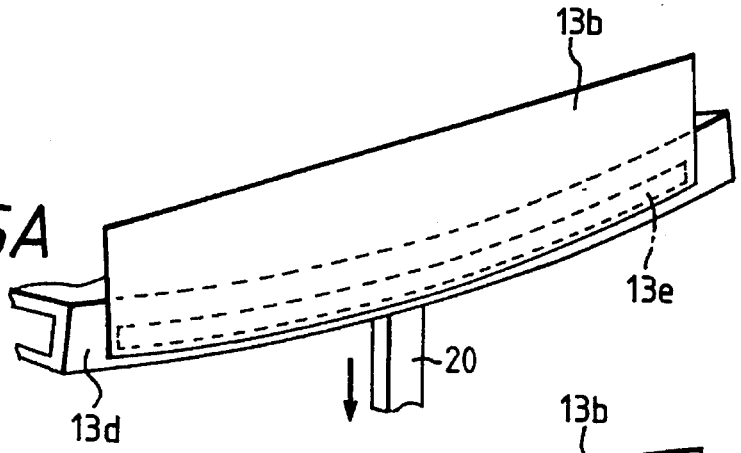
FIG. 25A is a perspective view showing a condition that the squeegee sheet is sticked to a curved attachment surface with a lower end portion of the sheet being curved.
Figure 25B:
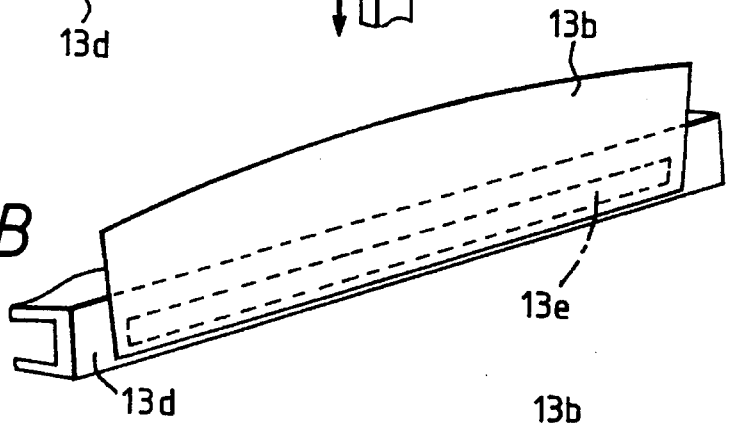
FIG. 25B is a perspective view showing a condition that an upper end portion of the squeegee sheet is tensioned by releasing the curvature of the attachment surface.

To avoid this, in the illustrated embodiment, as shown in FIG. 25A, the configuration of the lower end of the squeegee sheet 13*b* becomes substantially the same as the curvature configuration of the attachment surface 13*d* which has been curved by the pulling tool 20. That is to say, a width of the squeegee sheet 13*b* is varied from both longitudinal ends to a central portion so that the latter becomes greater than the former (for example, width at the central portion is about 7.9 mm, and width at both ends is about 7.4 mm). In this way, when the squeegee sheet 13*b* is attached to the attachment surface, the curved both-sided adhesive tape 13*e* does not protrude from the squeegee sheet 13*b*. Further, when the pulling tool 20 is removed to release the curvature of the attachment surface 13*d* thereby to apply the tension to the upper edge of the squeegee sheet 13*b* as shown in FIG. 25B, the lower end of the squeegee sheet does not protrude from the attachment surface 13*d* downwardly. Therefore, the above-mentioned interference between the recording medium 4 and the squeegee sheet 13*b* and the poor attachment of the squeegee sheet 13*b* can be prevented.

Figure 26:
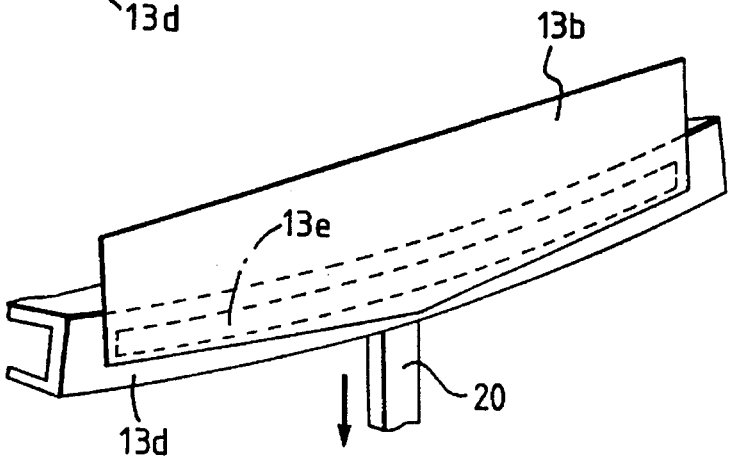
FIG. 26 is a perspective view of a squeegee sheet according to another embodiment wherein a width of the sheet is widened straightly and gradually from both ends to a central portion thereof.
Figure 27:
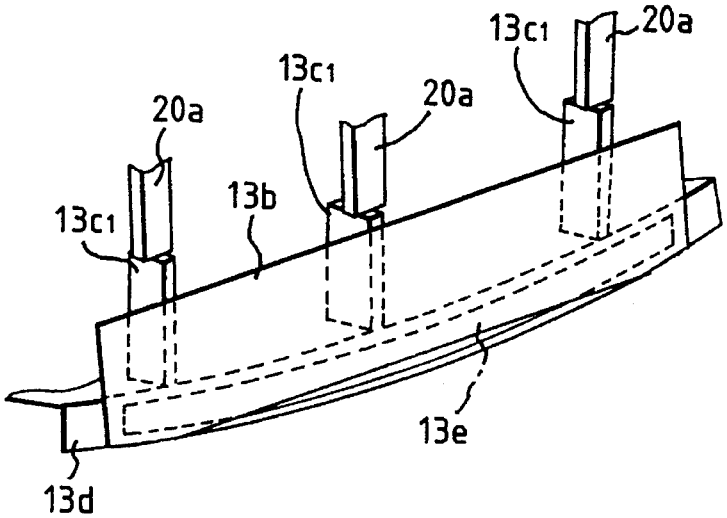
FIG. 27 is a perspective view for explaining the formation of the curvature of the squeegee sheet attachment surface by pressing the surface.

Incidentally, in view of the workability and the service life of a working tool, it is desirable that the lower edge of the squeegee sheet 13*b* is straight. Thus, as shown in FIG. 26, the width of the squeegee sheet 13*b* may be varied straightly so that the width at the central portion becomes greater than those at both longitudinal ends in correspondence to the amount of the curvature of the attachment surface 13*d*. In the above-mentioned embodiment, while the attachment surface 13*d* was curved by pulling it by-the pulling tool 20, it is to be understood that, as shown in FIG. 27, the attachment surface 13*d* may be curved by pushing toner reservoir partition plates 13c1 integrally formed with the attachment surface 13*d* by pushing tools 20*a*.

Further, in the illustrated embodiment, while the squeegee sheet attachment surface 13*d* was formed on the lower portion of the waste toner reservoir 13*c*, the squeegee sheet 13*b* may be adhered to a metallic plate attachment surface independently formed from the waste toner reservoir 13*c* and then metallic plate may be incorporated into the waste toner reservoir 13*c*.

Incidentally, in the illustrated embodiment, the squeegee sheet 13*b* is made of polyethylene terephthalate (PET) and has a thickness of about 38 μm, a length of about 241.3 mm, a central width of about 7.9 mm, end widths of about 7.4 mm and an appropriate radius of curvature of about 14556.7 mm.

Upper and Lower Frames

Next, the upper and lower frames 14, 15 constituting the housing of the process cartridge B will be explained. As shown in FIGS. 7 and 8, the photosensitive drum 9, the developing sleeve 12*d* and developing blade 12*e* of the developing means 12, the cleaning means 13 are provided in the lower frame 15. On the other hand, as shown in FIGS. 7 and 9, the charger roller 10, the toner reservoir 12*a* of the developing means 12 and the toner feed mechanism 12*b* are provided in the upper frame 14.

In order to assemble the upper and lower frames 14, 15 together, four pairs of locking pawls 14*a* are integrally formed with the upper frame 14 and are spaced apart from each other equidistantly in a longitudinal direction of the upper frame. Similarly, locking openings 15*a* and locking projections 15*b* for engaging by the locking pawls 14*a* are integrally formed on the lower frame 15. Accordingly, when the upper and lower frames 14, 15 are forcibly urged against each other to engage the locking pawls 14*a* by the corresponding locking openings 15*a* and locking projections 15*b*, the upper and lower frames 14, 15 are interconnected. Incidentally, in order to ensure the interconnection between the upper and lower frames, as shown in FIG. 8, a locking pawl 15*c* and a locking opening 15*d* are formed near both longitudinal ends of the lower frame 15, respectively, whereas, as shown in FIG. 9, a locking opening 14*b* (to be engaged by the locking pawl 15*c*) and a locking pawl 14*c* (to be engaged by the locking opening 15*d*) are formed near both longitudinal ends of the upper frame 14, respectively.

When the parts constituting the process cartridge B are separately contained within the upper and lower frames 14, 15 as mentioned above, by arranging the parts which should be positioned with respect to the photosensitive drum 9 (for example, developing sleeve 12*d*, developing blade 12*e* and cleaning blade 13*a*) within the same frame (lower frame 15 in the illustrated embodiment), it is possible to ensure the excellent positioning accuracy of each part and to facilitate the assembling of the process cartridge B. Further, as shown in FIG. 8, fitting recesses 15*n* are formed in the lower frame 15 in the vicinity of one lateral edge thereof. On the other hand, as shown in FIG. 9, fitting projections 14*h* (to be fitted into the corresponding fitting recesses 15*n*) are formed on the upper frame 14 in the vicinity of one lateral edge thereof at intermediate locations between the adjacent locking pawls 14*a*.

Further, in the illustrated embodiment, as shown in FIG. 8, fitting projections 15*e* are formed on the lower frame 15 near two corners thereof, whereas fitting recesses 15*f* are formed in the lower frame near the other two corners. On the other hand, as shown in FIG. 9, fitting recesses 14*d* (to be engaged by the corresponding fitting projections 15*e*) are formed in the upper frame 14 near two corners thereof, whereas fitting projections 14*e* (to be fitted into the corresponding fitting recesses 15*f*) are formed in the lower frame near the other two corners. Accordingly, when the upper and lower frames 14, 15 are interconnected, by fitting the fitting projections 14*h*, 14*e*, 15*e* (of the upper and lower frames 14, 15) into the corresponding fitting recesses 15*n*, 15*f*, 14*d*, the upper and lower frames 14, 15 are firmly interconnected to each other so that, even if a torsion force is applied to the interconnected upper and lower frames 14, 15, they are not disassembled.

Incidentally, the positions of the above-mentioned fitting projections and fitting recesses may be changed so long as the interconnected upper and lower frames 14, 15 are not disassembled by any torsion force applied thereto.

Further, as shown in FIG. 9, a protection cover 22 is rotatably mounted on the upper frame 14 via pivot pins 22*a*. The protection cover 22 is biased toward a direction shown by the arrow h in FIG. 9 by torsion coil springs (not shown) arranged around the pivot pins 22*a*, so that the projection cover 22 closes or covers the photosensitive drum 9 in the condition that the process cartridge B is removed from the image forming apparatus A as shown in FIG. 4.

More specifically, as shown in FIG. 1, the photosensitive drum 9 is so designed that it is exposed from an opening 15*g* formed in the lower frame 15 to be opposed to the transfer roller 6 in order to permit the transferring of the toner image from the photosensitive drum onto the recording medium 4. However, in the condition that the process cartridge B is removed from the image forming apparatus A, if the photosensitive drum 9 is exposed to the atmosphere, it will be deteriorated by the ambient light and dirt and the like will be adhered to the photosensitive drum 9. To avoid this, when the process cartridge B is dismounted from the image forming apparatus A, the opening 15*g* is closed by the protection cover 22, thereby protecting the photosensitive drum 9 from the ambient light and dirt. Incidentally, when the process cartridge B is mounted within the image forming apparatus A, the protection cover 22 is rotated by a rocking mechanism (not shown) to expose the photosensitive drum 9 from the opening 15*g*.

Further, as apparent from FIG. 1, in the illustrated embodiment, the lower surface of the lower frame 15 also acts as a guide for conveying the recording medium 4. The lower surface of the lower frame is formed as both side guide portions 15h1 and a stepped central guide portion 15h2 (FIG. 6). The longitudinal length (i.e., distance between the steps) of the central guide portion 15h2 is about 102–120 mm (107 mm in the illustrated embodiment) which is slightly greater than a width (about 100 mm), and the depth of the step is selected to have a value of about 0.8–2 mm. With this arrangement, the central guide portion 15h2 increases the conveying space for the recording medium 4, with the result that, even when thicker and resilient sheet such as a post card, visiting card or envelope is used as the recording medium 4, such thicker sheet does not interfere with the guide surface of the lower frame 15, thereby preventing the recording medium from jamming. On the other hand, when a thin sheet having a greater width than that of the postcard such as a plain sheet is used as the recording medium, since such sheet (recording medium) is guided by the both side guide portions 15h1, it is possible to convey the sheet without floating.

Figure 28A:
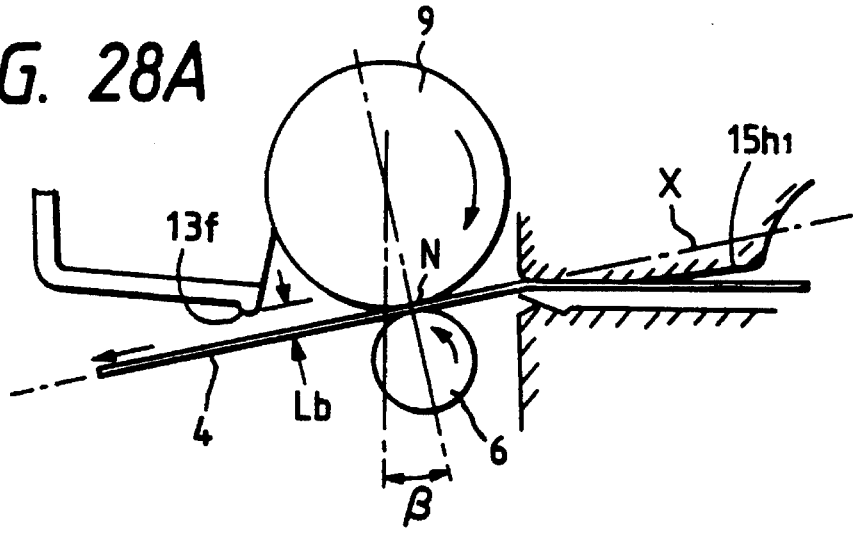
FIG. 28 is a view showing conditions that a recording medium is being guided by a lower surface of the lower frame.
Figure 28B:
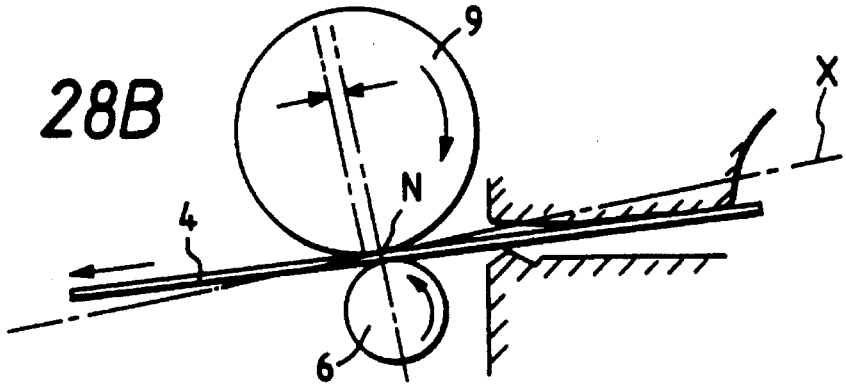
Figure 28C:
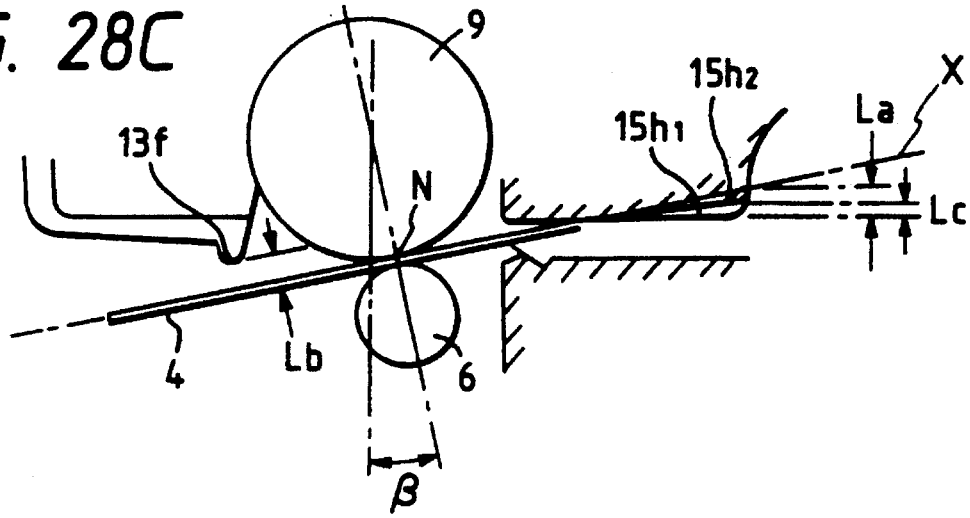

Now, the lower surface of the lower frame 15 acting as the convey guide for the recording medium will be described more concretely. As shown in FIG. 28, the both side guide portions 15h1 can be flexed by an amount La (=5–7 mm) with respect to a tangential direction X regarding a nip N between the photosensitive drum 9 and the transfer roller 6. Since the both side guide portions 15h1 are formed on the lower surface of the lower frame 15 designed to provide the required space between the lower frame and the developing sleeve **12*d* and the required space for sufficiently supplying the toner to the developing sleeve, such guide portions are determined by the position of the developing sleeve 12*d* selected to obtain the optimum developing condition. If the lower surfaces of the side guide portions are approached to the tangential line X, the thickness of the lower portion of the lower frame 15** is decreased, thus causing a problem regarding the strength of the process cartridge B.

Further, the position of a lower end **13*f* of the cleaning means 13 is determined by the positions of the cleaning blade 13*a*, the squeegee sheet 13*b* and the like constituting the cleaning means 13 as described later, and is so selected to provide a distance Lb (=3–5 mm) preventing the interference with the recording medium 4 being fed. Incidentally, in the illustrated embodiment, as angle β between a vertical line passing through the-rotational center of the photosensitive drum 9 shown in FIG. 28 and a line connecting the rotational center of the photosensitive drum and the rotational center of the transfer roller 6** is selected to have a value of 5–20 degrees.

In consideration of the above affairs, by providing the recess or step having a depth Lc (=1–2 mm) only in the central guide portion 15h2 to approach this guide portion to the tangential line X, it is possible to feed the thicker and resilient recording medium 4 smoothly without reducing the strength of the lower frame 15. Incidentally, in most cases, since the thicker and resilient recording medium 4 is the visiting card, envelope or the like which is narrower than the post card under the general specification of the image forming apparatus, so long as the width of the stepped or recessed central guide portion 15h2 is selected to be slightly greater than that of the post card, there is no problem in the practical use.

Further, regulating projections **15*i* protruding downwardly are formed on the outer surface of the lower frame 15 in areas outside of the recording medium guiding zone. The regulating projections 15*i* each protrudes from the guide surface of the lower frame for the recording medium 4 by about 1 mm. With this arrangement, even if the process cartridge B is slightly lowered for some reason during the image forming operation, since the regulating projections 15*i* are abutted against a lower guide member 23 (FIG. 1) of the body 16 of the image forming apparatus, the further lowering of the process cartridge can be prevented. Accordingly, a space of at least 1 mm is maintained between the lower guide member 23 and the lower guide surface of the lower frame 15 to provide a convey path for the recording medium 4, thereby conveying the recording medium without jamming. Further, as shown in FIG. 1, a recess 15*j* is formed in the lower surface of the lower frame 15 not to interfere with the regist roller 5c2. Thus, when the process cartridge B is mounted within the image forming apparatus A, since it can be mounted near the regist roller 5c2**, the whole image forming apparatus can be small-sized.

Assembling of Process Cartridge

Figure 29:
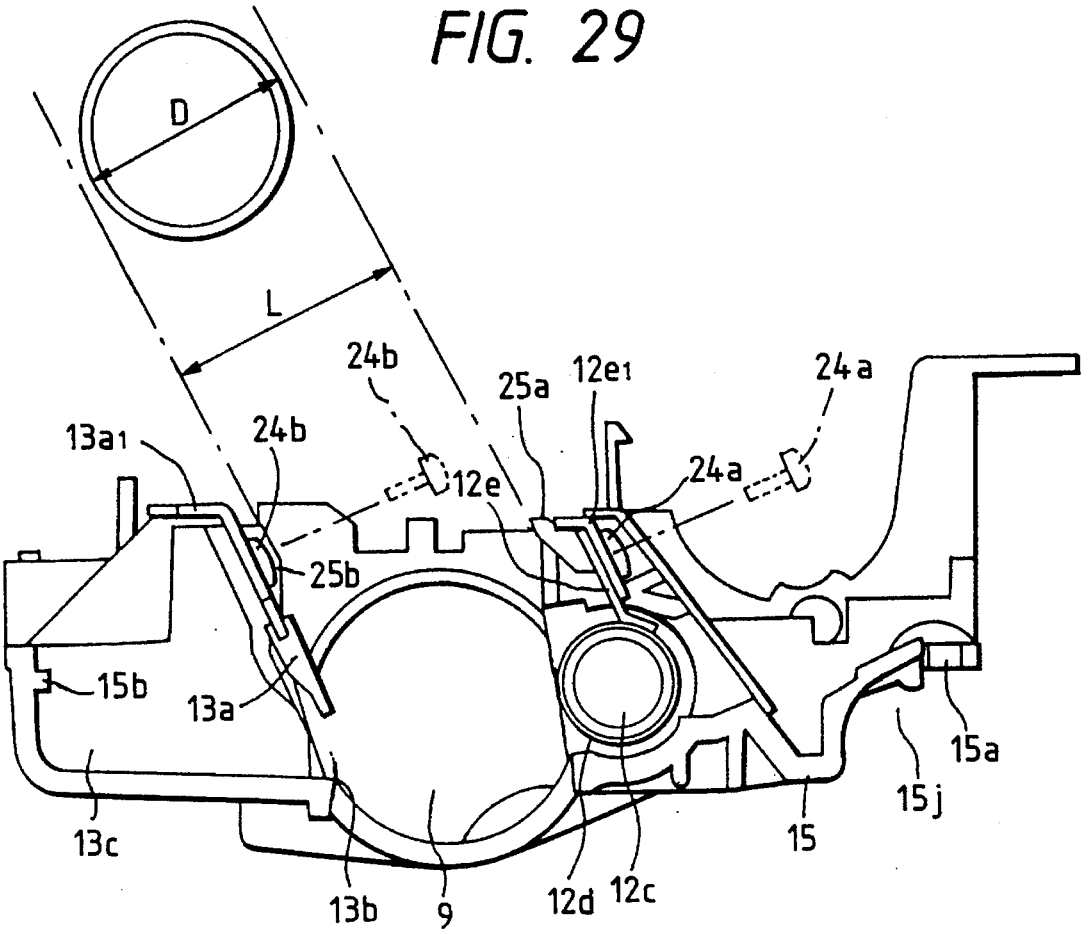
FIG. 29 is a sectional view showing a condition that the photosensitive drum is finally assembled.

Next, the assembling of the process cartridge having the above-mentioned construction will be explained. In FIG. 29, toner leak preventing seals S having a regular shape and made of Moltopren (flexible palyurethane, manufactured by INOAC Incorp.) rubber for preventing the leakage of toner are sticked on ends of the developing means 12 and of the cleaning means 13 and on the lower frame 15. Incidentally, the toner leak preventing seals S each may not have a regular shape. Alternatively, toner leak preventing seals may be attached by forming recesses in portions (to be attached) of the seals and by pouring liquid material which becomes elastomer when solidified into the recesses.

A blade support member 12e1 to which the developing sleeve **12*e* is attached and a blade support member 13a1 to which the cleaning blade 13*a* is attached are attached to the lower frame 15 by pins 24*a*, 24*b*, respectively. According to the illustrated embodiment, as shown by the phantom lines in FIG. 29, the attachment surfaces of the blade support members 12e1, 13a1 may be substantially parallel with each other so that the pins 24*a*, 24*b* can be driven from the same direction. Thus, when a large number of process cartridges B are manufactured, the developing blades 12*e* and the cleaning blades 13*a* can be continuously attached by the pins by using an automatic device. Further, the assembling ability for the blades 12*e*, 13*a*** can be improved by providing a space for a screw driver, and the shape of a mold can be simplified by aligning the housing removing direction from the mold, thereby achieving the costdown.

Figure 30:
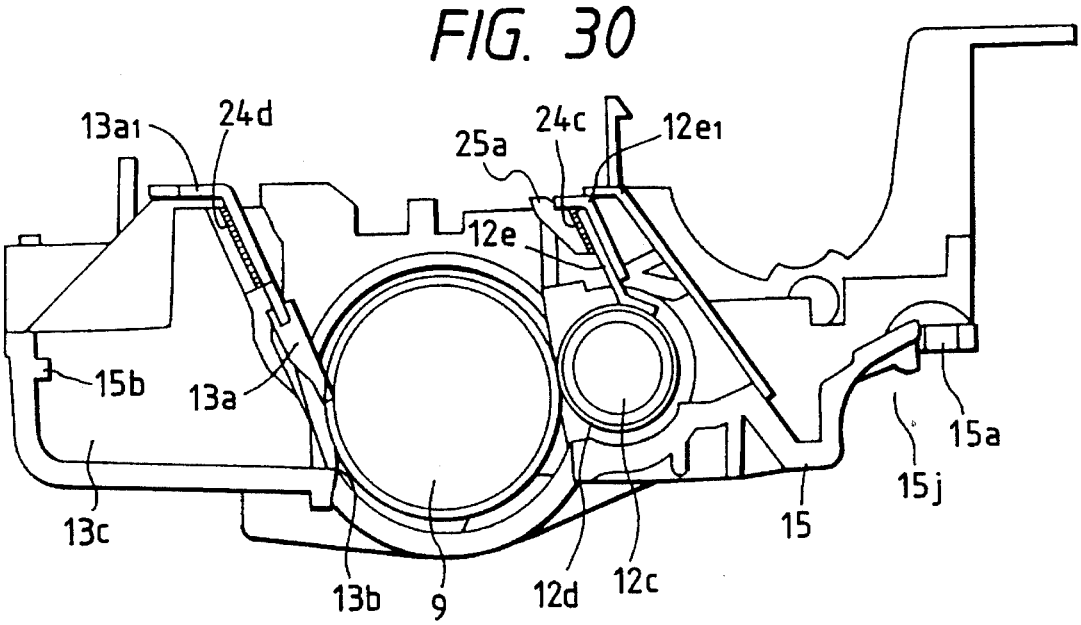
FIG. 30 is a sectional view showing a condition that a developing blade and a cleaning blade are adhered.

Incidentally, the developing blade **12*e* and the cleaning blade 13*a* may not be attached by the pins (screws), but may be attached to the lower frame 15 by adhesives 24*c*, 24*d* as shown in FIG. 30. Also in this case, when the adhesives can be applied from the same direction, the attachment of the developing blade 12*e* and the cleaning blade 13*a*** can be automatically and continuously performed by using an automatic device.

Figure 31:
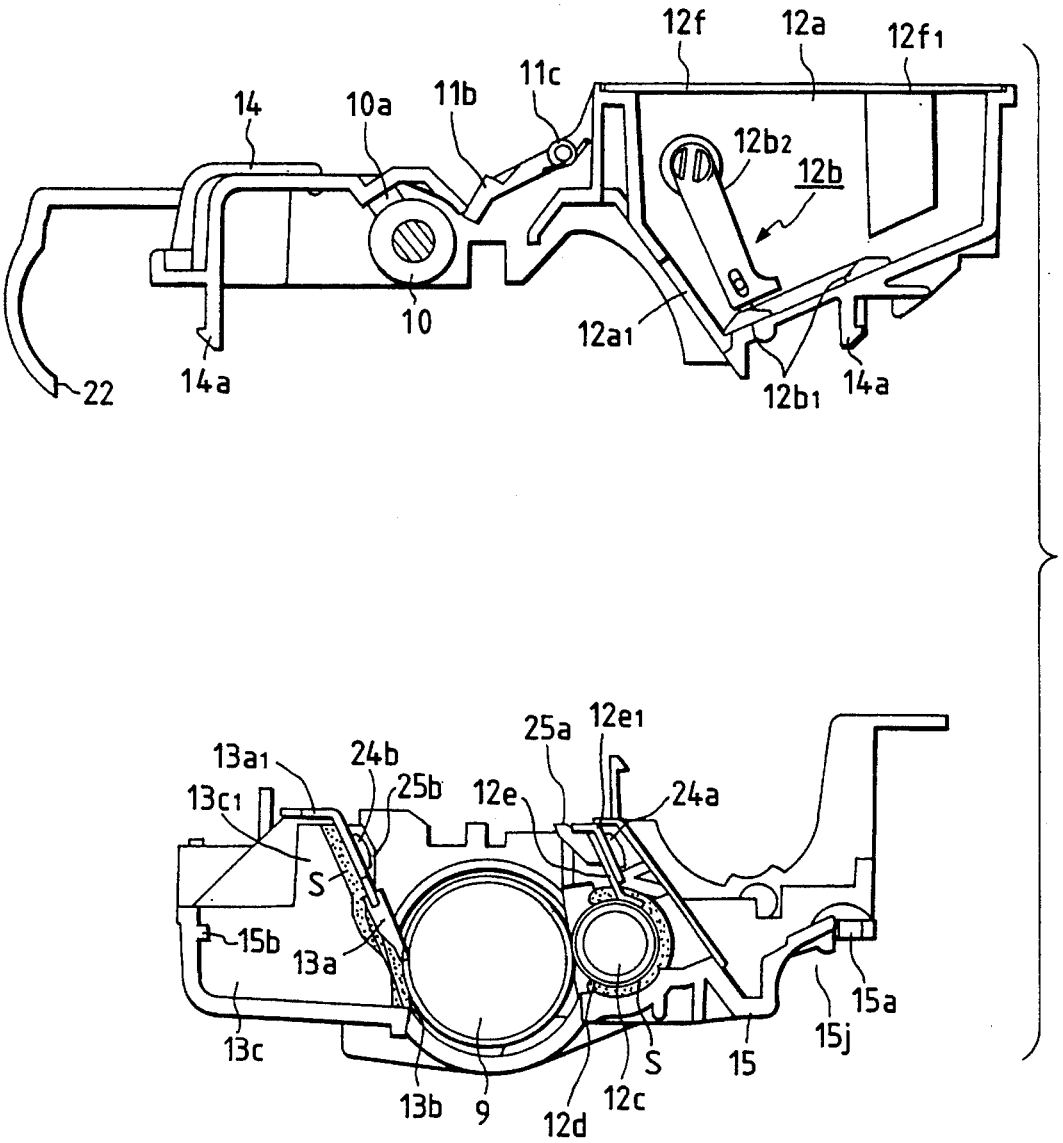
FIG. 31 is an exploded view for explaining the assembling of the process cartridge.
Figure 32:
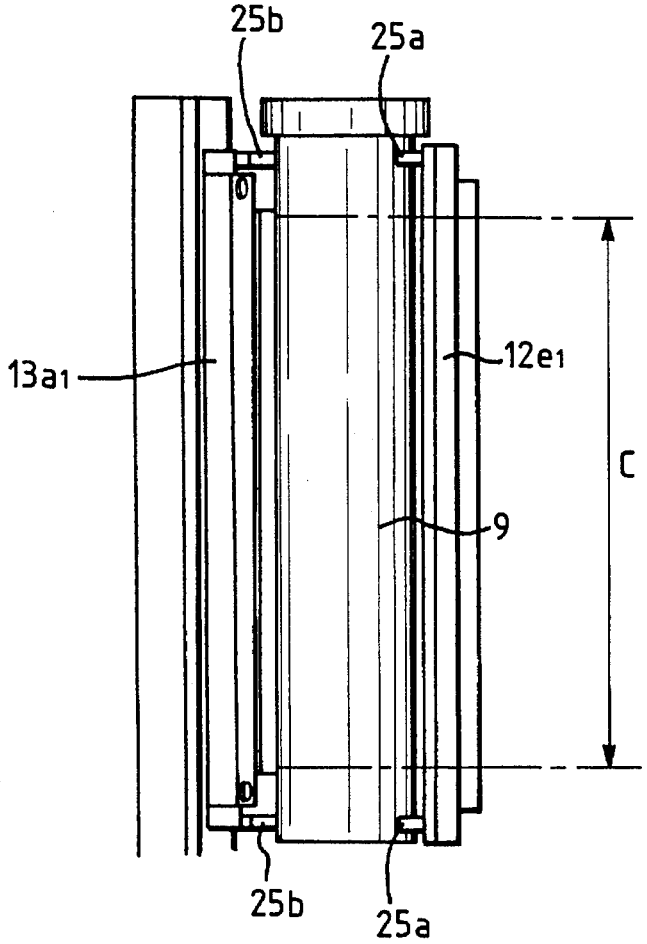
FIG. 32 is a view for explaining a position of guide members when the photosensitive drum of the process cartridge is assembled.

After the blades **12*e*, 13*a* have been attached as mentioned above, the developing sleeve 12*d* is attached to the lower frame 15. Then, the photosensitive drum 9 is attached to the lower frame 15. To this end, in the illustrated embodiment, guide members 25*a*, 25*b* are attached to surfaces (opposed to the photosensitive drum) of the blade support members 12e1, 13a1, respectively, at zones outside of the longitudinal image forming area C (FIG. 32) of the photosensitive drum 9. (Incidentally, in the illustrated embodiment, the guide members 25*a*, 25*b* are integrally formed with the lower frame 15). A distance between the guide members 25*a* and 25*b* is set to be greater than the outer diameter D of the photosensitive drum 9. Thus, after the various parts such as the developing blade 12*e*, cleaning blade 13*a* and the like have been attached to the lower frame 15, as shown in FIG. 31, the photosensitive drum 9 can be finally attached to the lower frame while guiding the both longitudinal ends (outside of the image forming area) of the photosensitive drum by the guide members 25*a*, 25*b*. That is to say, the photosensitive drum 9 is attached to the lower frame 15 while slightly flexing the cleaning blade 13*a* and/or slightly retarding and rotating the developing sleeve 12*d***.

If the photosensitive drum 9 is initially attached to the lower frame 15 and then the blades **12*e*, 13*a* and the like are attached to the lower frame, it is feared that the surface of the photosensitive drum 9 is damaged during the attachment of the blades 12*e*, 13*a* and the like. Further, during the assembling operation, it is difficult or impossible to check the attachment positions of the developing blade 12*e* and the cleaning blade 13*a* and to measure the contacting pressures between the blades and the photosensitive drum. In addition, although lubricant must be applied to the blades 12*e*, 13*a* to prevent the increase in torque and/or the blade turn-up due to the close contact between the initial blades 12*e*, 13*a* (at the non-toner condition) and the photosensitive drum 9 and the developing sleeve 12*d* before the blades 12*e*, 13*a* are attached to the lower frame 15, such lubricant is likely to drip from the blades during the assembling of the blades. However, according to the illustrated embodiment, since the photosensitive drum 9** is finally attached to the lower frame, the above-mentioned drawbacks and problems can be eliminated.

As mentioned above, according to the illustrated embodiment, it is possible to check the attachment positions of the developing means 12 and the cleaning means 13 in the condition that these means 12, 13 are attached to the frames, and to prevent the image forming area of the photosensitive drum from being damaged or scratched during the assembling of the drum. Further, since it is possible to apply the lubricant to the blades in the condition that these means 12, 13 are attached to the frames, dripping of the lubricant can be prevented, thereby preventing the occurrence of the increase in torque and/or the blade turn-up due to the close contact between the developing blade **12*e* and the developing sleeve 12*d*, and the cleaning blade 13*a* and the photosensitive drum 9**.

Figure 33:
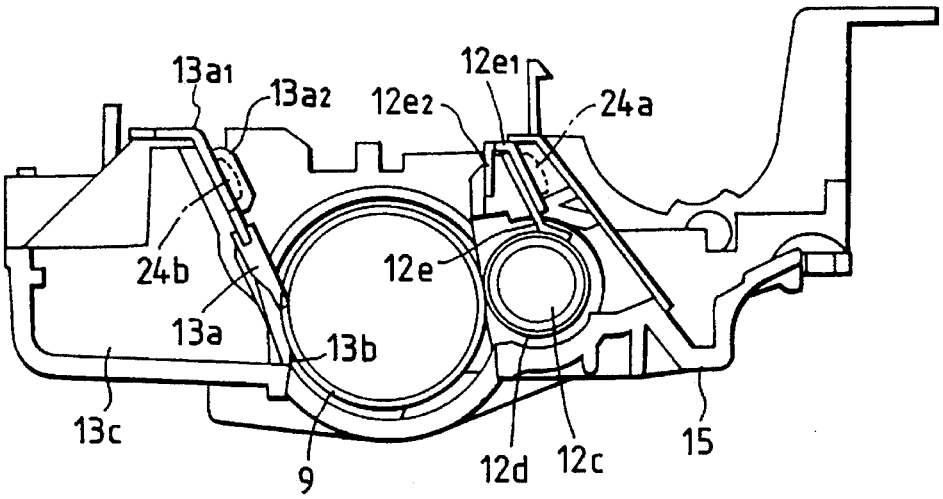
FIG. 33 is a sectional view of a structure wherein drum guides are arranged at ends of blade supporting members.

Incidentally, in the illustrated embodiment, while the guide members **25*a*, 25*b* were integrally formed with the lower frame 15, as shown in FIG. 33, projections 12e2, 13*a*2 may be integrally formed on the blade support members 12e1, 13a1 or other guide members may be attached to the blade support members at both longitudinal end zones of the blade support members outside of the image forming area of the photosensitive drum 9, so that the photosensitive drum 9** is guided by these projections or other guide members during the assembling of the drum.

Figure 34:
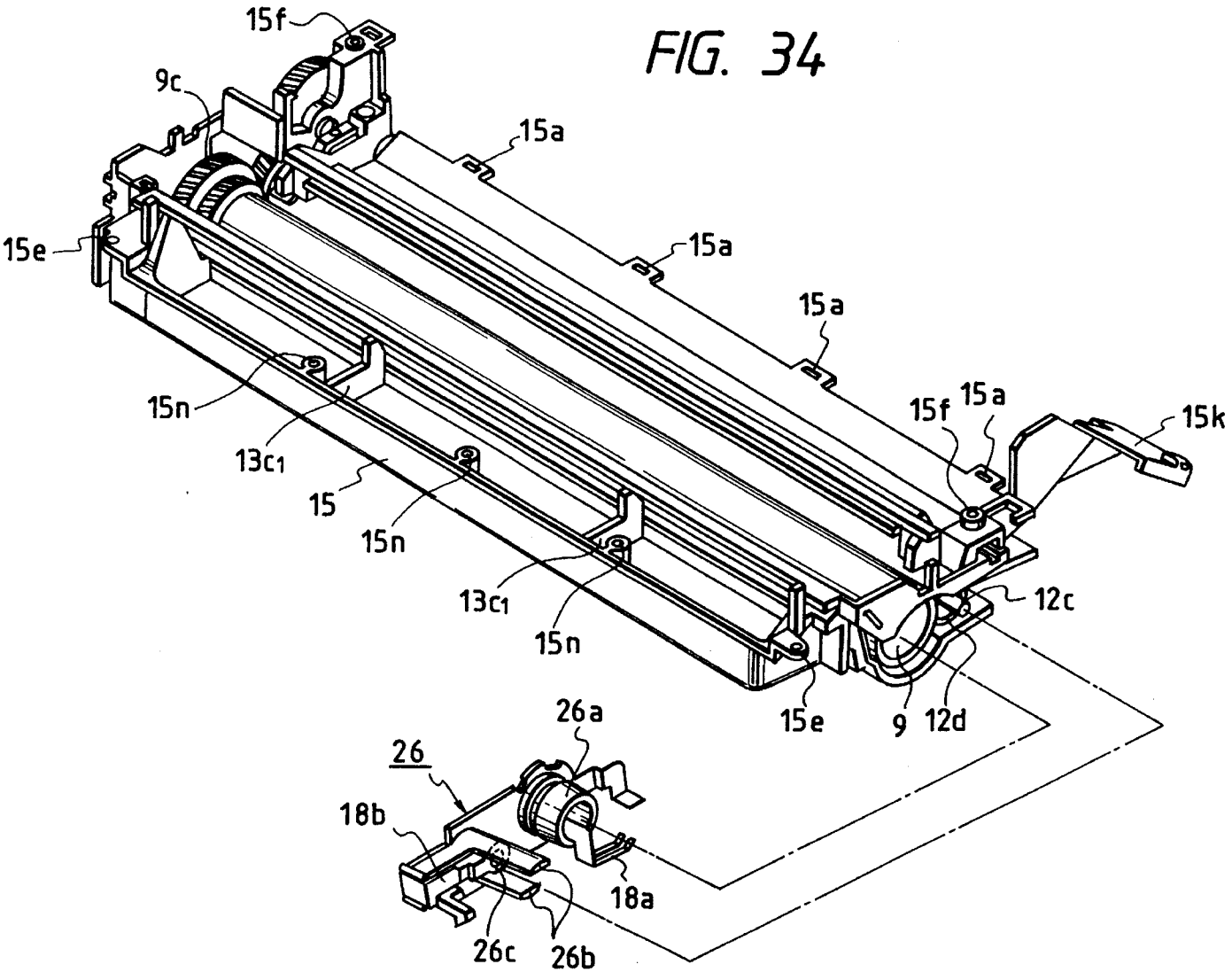
FIG. 34 is a perspective view for explaining the attachment of bearing members for the photosensitive drum and the developing sleeve.
Figure 35:
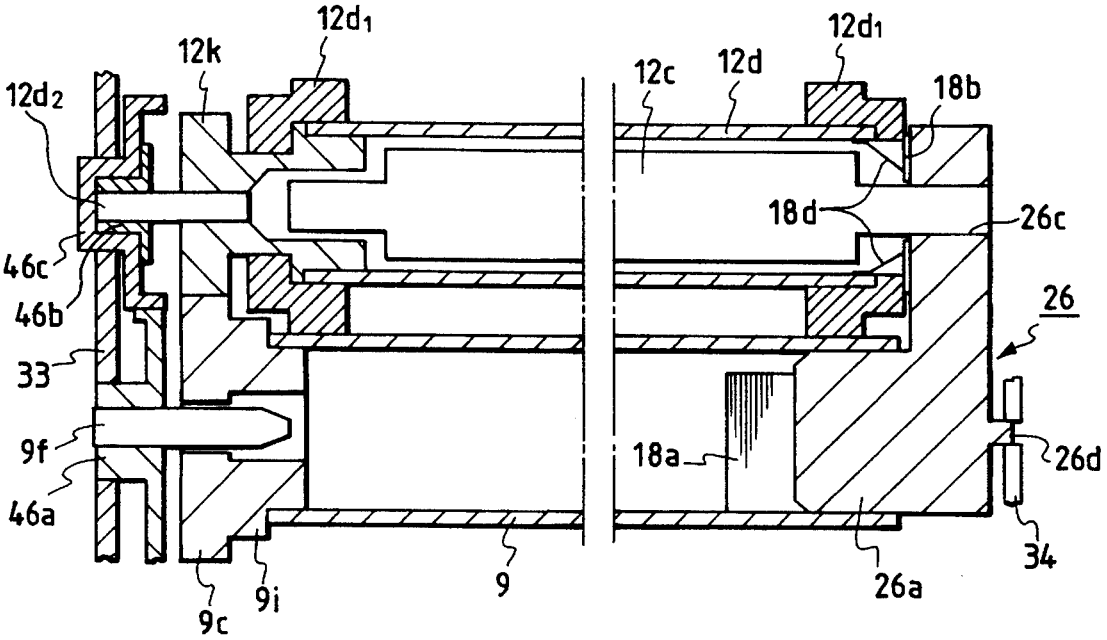
FIG. 35 is a sectional view of the photosensitive drum and the developing sleeve with the bearing members attached thereto.

After the developing sleeve **12*d*, developing blade 12*e*, cleaning blade 13*a* and photosensitive drum 9 have been attached to the lower frame 15 as mentioned above, as shown in FIG. 34 (perspective view) and FIG. 35 (sectional view), the bearing member 26 is incorporated to rotatably support one ends of the photosensitive drum 9 and of the developing sleeve 12*d*. The bearing member 26 is made of anti-wear material such as polyacetal and comprises a drum bearing portion 26*a* to be fitted on the photosensitived rum 9, a sleeve bearing portion 26*b* to be fitted on the outer surface of the developing sleeve 12*d*, and a D-cut hole portion 26*c* to be fitted on an end of a D-cut magnet 12*c*. Alternatively, the sleeve bearing portion 26*b* may be fitted on the outer surface of the sleeve bearing 12*i* supporting the outer surface of the developing sleeve 12*d* or may be fitted between slide surfaces 15Q of the lower frame 15 which are fitted on the outer surface of the slide bearing 12*i***.

Accordingly, when the drum bearing portion **26*a* is fitted on the end of the photosensitive drum 9 and the end of the magnet 12*c* is inserted into the D-cut hole portion 26*c* and the developing sleeve 12*d* is inserted between into the sleeve bearing portion 26*b* and the bearing member 26 is fitted into the side of the lower frame 15 while sliding it in the longitudinal direction of the drum, the photosensitive drum 9 and the developing sleeve 12*d* are rotatably supported. Incidentally, as shown in FIG. 34, the earthing contact 18*a* is attached to the bearing member 26, and, when the bearing member 26 is fitted into the side of the lower frame, the earthing contact 18*a* is contacted with the aluminium drum core 9*a* of the photosensitive drum 9 (see FIG. 10). Further, the developing bias contact 18*b* is also attached to the bearing member 26, and, when the bearing member 26 is attached to the developing sleeve 12*d*, the bias contact 18*b* is contacted with a conductive member 18*d* contacting the inner surface of the developing sleeve 12*d***.

In this way, by rotatably supporting the photosensitive drum 9 and the developing sleeve **12*d* by the single bearing member 26, it is possible to improve the positional accuracy of the elements 9, 12*d*, and to reduce the number of parts, thereby facilitating the assembling operation and achieving lower cost. Further, since the positioning of the photosensitive drum 9 and the positioning of the developing sleeve 12*d* and the magnet 12*c* can be performed by using the single member, it is possible to determine the positional relation between the photosensitive drum 9 and the magnet 12*c* with high accuracy, with the result that it is possible to maintain a magnetic force regarding the surface of the photosensitive drum 9 constant, thus obtaining the high quality image. In addition, since the earthing contact 18*a* for earthing the photosensitive drum 9 and the developing bias contact 18*b* for applying the developing bias to the developing sleeve 12*d* are attached to the bearing member 26**, the compactness of the parts can be achieved effectively, thus making the process cartridge B small-sized effectively.

Further, by providing (on the bearing member 26) supported portions for positioning the process cartridge B within the image forming apparatus when the process cartridge is mounted within the image forming apparatus, the positioning of the process cartridge B regarding the image forming apparatus can be effected accurately. Furthermore, as apparent from FIGS. 5 and 6, an outwardly protruding U-shaped projection, i.e., drum shaft portion **26*d* (FIG. 20) is also formed on the bearing member 26. When the process cartridge B is mounted within the body 16 of the image forming apparatus, the drum shaft portion 26*d* is supported by a shaft support member 34 as will be described later, thereby positioning the process cartridge B. In this way, since the process cartridge B is positioned by the bearing member 26 for directly supporting the photosensitive drum 9 when the cartridge is mounted within the apparatus body 16, the photosensitive drum 9** can be accurately positioned regardless of the manufacturing and/or assembling errors of other parts.

Further, as shown in FIG. 35, the other end of the magnet **12*c* is received in an inner cavity formed in the sleeve gear 12*k*, and an outer diameter of the magnet 12*c* is so selected as to be slightly smaller than an inner diameter of the cavity. Thus, at the sleeve gear 12*k*, the magnet 12*c* is held in the cavity with any play and is maintained in a lower position in the cavity by its own weight or is biased toward the blade support member 12e1 made of magnetic metal such as ZINKOTE (zinc plated steel plate, manufactured by shin Nippon Steel Incorp.) by a magnetic force of the magnet 12*c*. In this way, since the sleeve gear 12*k* and the magnet 12*c* are associated with each other with any play, the friction torque between the magnet 12*c* and the rotating sleeve gear 12*k*** can be reduced, thereby reducing the torque regarding the process cartridge.

On the other hand, as shown in FIG. 31, the charger roller 10 is rotatably mounted within the upper frame 14, and the shutter member **11*b*, the protection cover 22 and the toner feed mechanism 12*b* are also attached to the upper frame 15. The opening 12a1 for feeding out the toner from the toner reservoir 12*a* to the developing sleeve 12*d* is closed by a cover film 28 (FIG. 36) having a tear tape 27. Further, the lid member 12*f* is secured to the upper frame, and, thereafter, the toner is supplied to the toner reservoir 12*a* through the filling opening 12a3 and then the filling opening 12a3 is closed by the lid 12*a*2, thus sealing the toner reservoir 12*a***.

Figure 36:
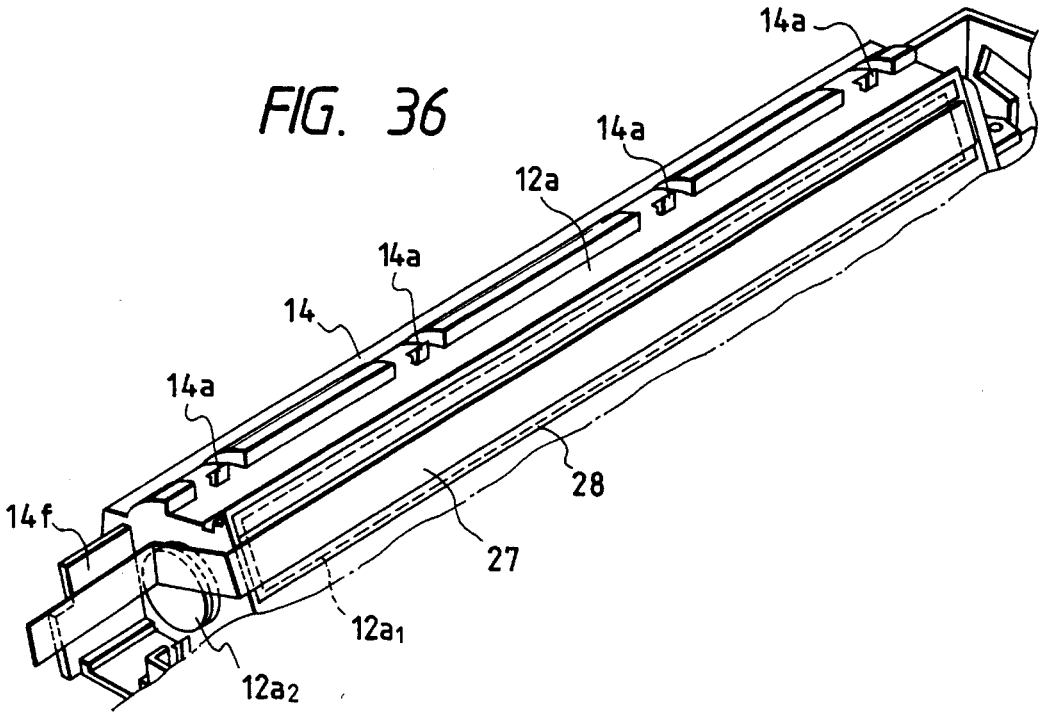
FIG. 36 is a perspective view for explaining a cover film and a tear tape.

Incidentally, as shown in FIG. 36, the tear tape 27 of the cover film 28 adhered around the opening 12a1 extends from one longitudinal end (right end in FIG. 36) of the opening 12a1 to the other longitudinal end (left end in FIG. 36) and is bent at the other end and further extends along a gripper portion 14*f* formed on the upper frame 14 and protrudes therefrom outwardly.

Figure 37:
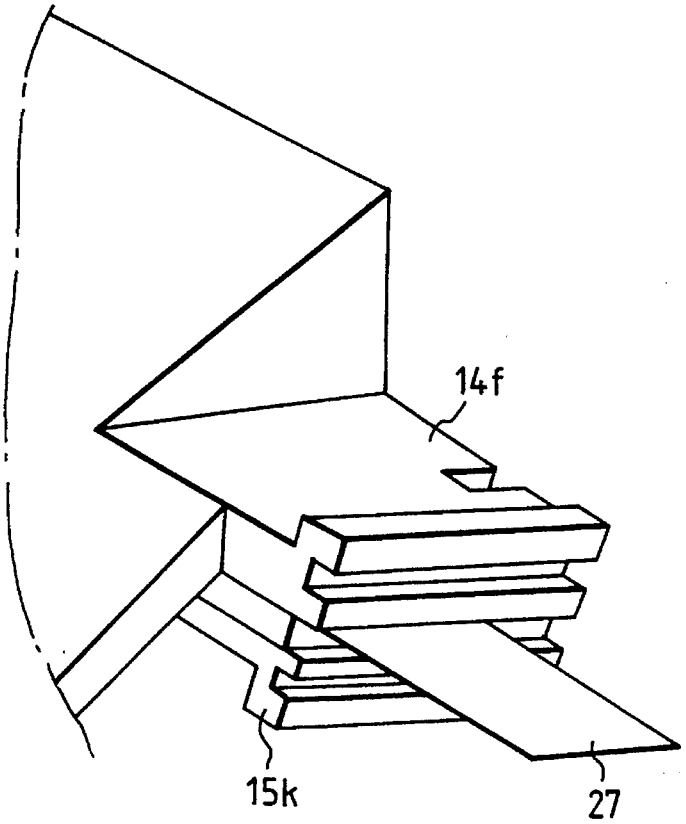
FIG. 37 is a perspective view showing a condition that the tear tape is protruded from a gripper.

Next, the process cartridge B is assembled by interconnecting the upper and lower frames 14, 15 via the above-mentioned locking pawls and locking openings or recesses. In this case, as shown in FIG. 37, the tear tape 27 is exposed between the gripper portion 14*f* of the upper frame 14 and a gripper portion 15*k* of the lower frame 15. Therefore, when a new process cartridge B is used, the operator pulls a protruded portion of the tear tape 27 exposed between the gripper portions 14*f*, 15*k* to peel the tear tape 27 from the cover film 28 so as to open the opening 12a1, thus permitting the movement of the toner in the toner reservoir 12*a* toward the developing sleeve 12*d*. Thereafter, the process cartridge is mounted within the image forming apparatus A.

As mentioned above, by exposing the tear tape 27 between the gripper portions 14*f*, 15*k* of the upper and lower frames 14, 15, the tear tape 27 can easily be exposed from the process cartridge in assembling the upper and lower frames 14, 15. The gripper portions 14*f*, 15*k* are utilized when the process cartridge B is mounted within the image forming apparatus. Thus, if the operator forgets to remove the tear tape 27 before the process cartridge is mounted within the image forming apparatus, since he must grip the gripper portions in mounting the process cartridge, he will become aware of the existence of the non-removed tear tape 27. Further, when the color of the tear tape 27 is clearly differentiated from the color of the frames 14, 15 (for example, if the frames are black, a white or yellow tear tape 27 is used), the noticeability is improved, thus reducing the likelihood of removing the tear tape.

Figure 38:
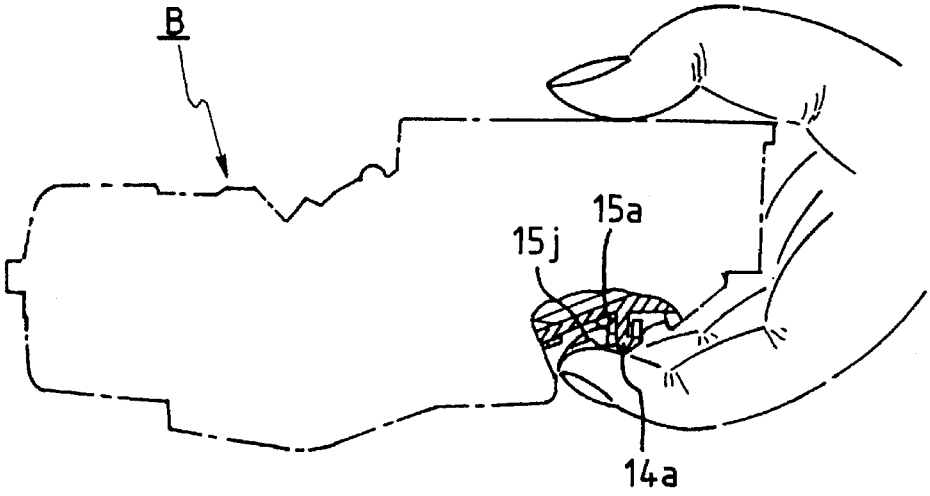
FIG. 38 is a schematic view showing a condition that the process cartridge is gripped by an operator's hand.

Further, for example, when a U-shaped guide rib for temporarily holding the tear tape 27 is provided on the gripper portion 14*f* of the upper frame 14, it is possible to surely and easily expose the tear tape 27 at a predetermined position during the interconnection between the upper and lower frames 14, 15. Incidentally, when the process cartridge B is assembled by interconnecting the upper and lower frames 14, 15, since the recess 15*j* for receiving the regist roller 5c2 is formed in the outer surface of the lower frame 15, as shown in FIG. 38, the operator can surely grip the process cartridge B by inserting his fingers into the recess 15*j*. Further, in the illustrated embodiment, as shown in FIG. 6, slip preventing ribs 14*i* are formed on the process cartridge B so that, when the operator can easily grip the process cartridge by hooking his fingers against the ribs. Incidentally, since the recess for receiving (preventing the contact with) the regist roller 5c2 is formed in the lower frame 15 of the process cartridge B, it is possible to make the image forming apparatus more small-sized.

Further, as shown in FIG. 6 since the recess 15*j* is formed along and in the vicinity of the locking pawls 14*a* and the locking openings 15*b* through which the upper and lower frames 14, 15 are interconnected, when the operator grips the process cartridge B by hooking his fingers against the recess 15*Zj*, the gripping force from the operator acts toward the locking direction, thus surely interlocking the locking pawls 14*a* and the locking openings 15*b*.

Figure 39A:
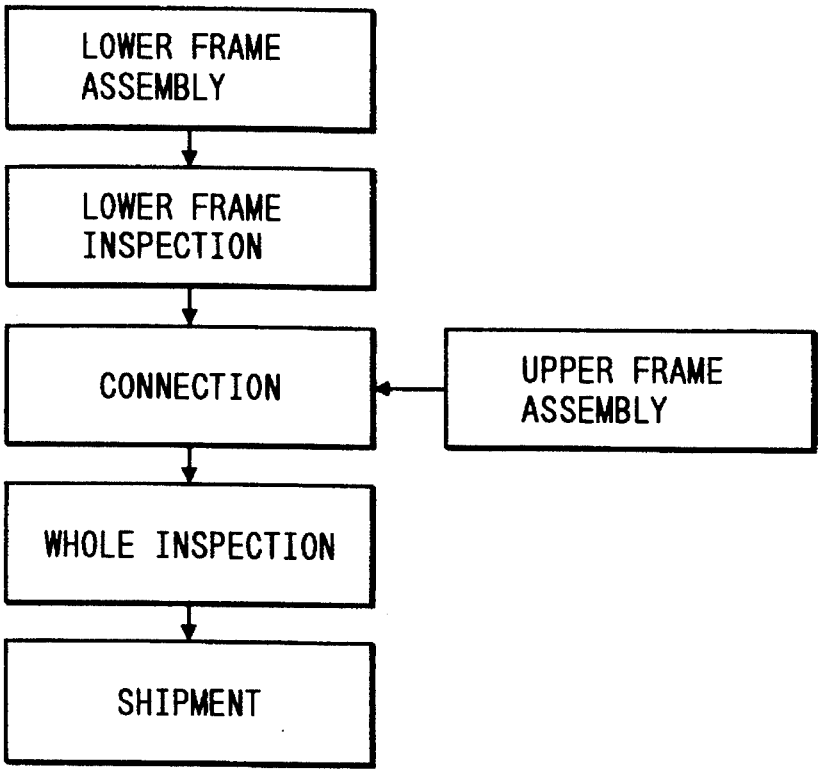
FIG. 39A is a flowchart showing the assembling and shipping line for the process cartridge.

Now, the assembling and shipping line for the process cartridge B will be explained with reference to FIG. 39A. As shown, the various parts are assembled in the lower frame 15, and then, the lower frame into which the various parts are incorporated is checked (for example, the positional relation between the photosensitive drum 9 and the developing sleeve 12*d* is checked). Then, the lower frame 15 is interconnected to the upper frame 14 within which the parts such as the charger roller 10 are assembled, thereby forming the process cartridge B. Thereafter, the total check of the process cartridge B is effected, and then the process cartridge is shipped. Thus, the assembling and shipping line is very simple.

Mounting of Cartridge

Next, the construction for mounting the process cartridge B within the image forming apparatus A will be explained.

Figure 40:
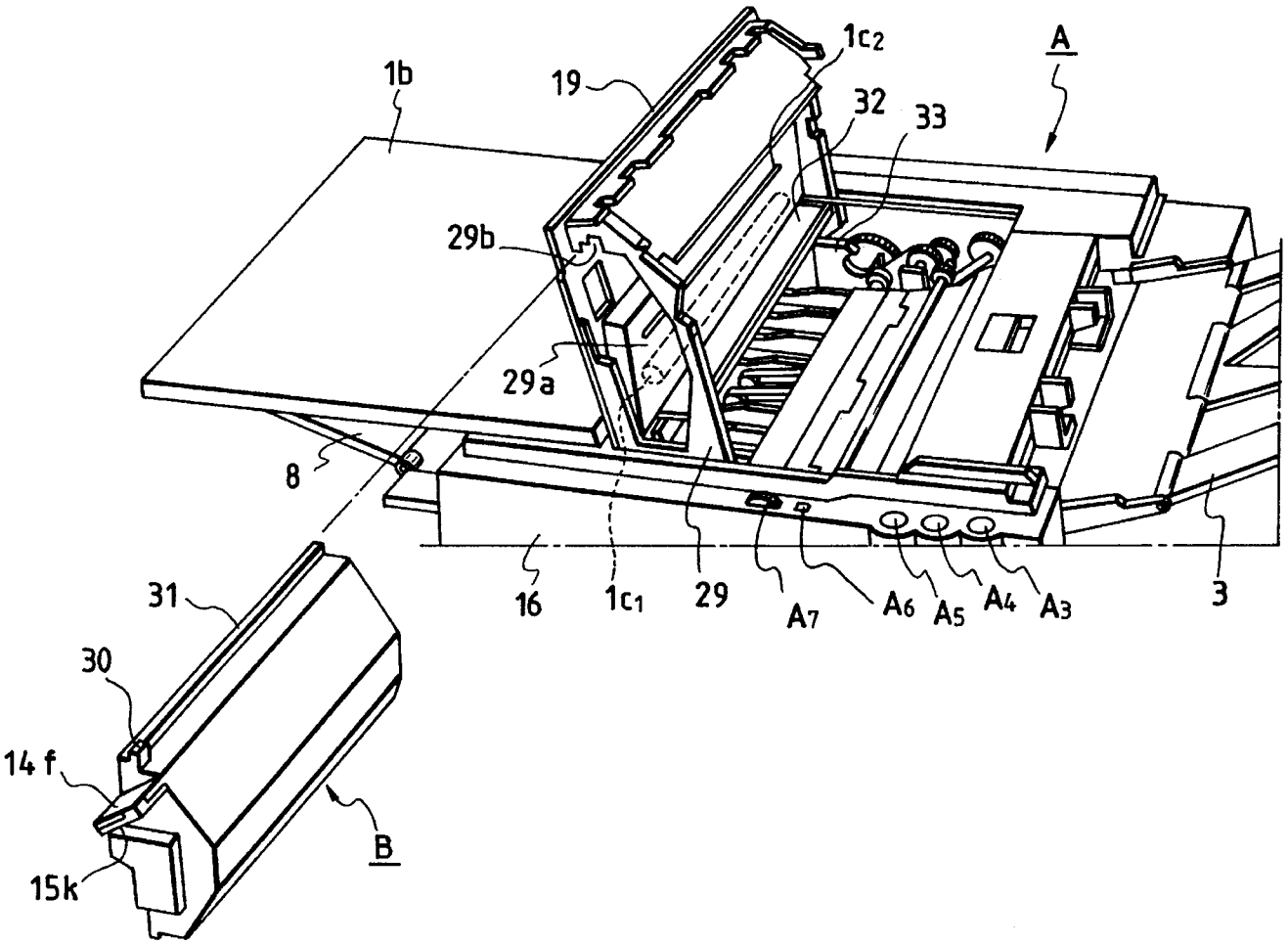
FIG. 40 is a perspective view showing a condition that the process cartridge is being mounted within the image forming system.

As shown in FIG. 40, a loading member 29 having a fitting window 29*a* matched to the contour of the process cartridge B is provided on the upper opening/closing cover 19 of the image forming apparatus A. The process cartridge B is inserted into the image forming apparatus through the fitting window 29*a* by gripping the gripper portions 14*f*, 15*k*. In this case, a guide ridge 31 formed on the process cartridge B is guided by a guide groove (not numbered) formed in the cover 19 and the lower portion of the process cartridge is guided a guide plate 32 having a hook at its free end.

Figure 41:
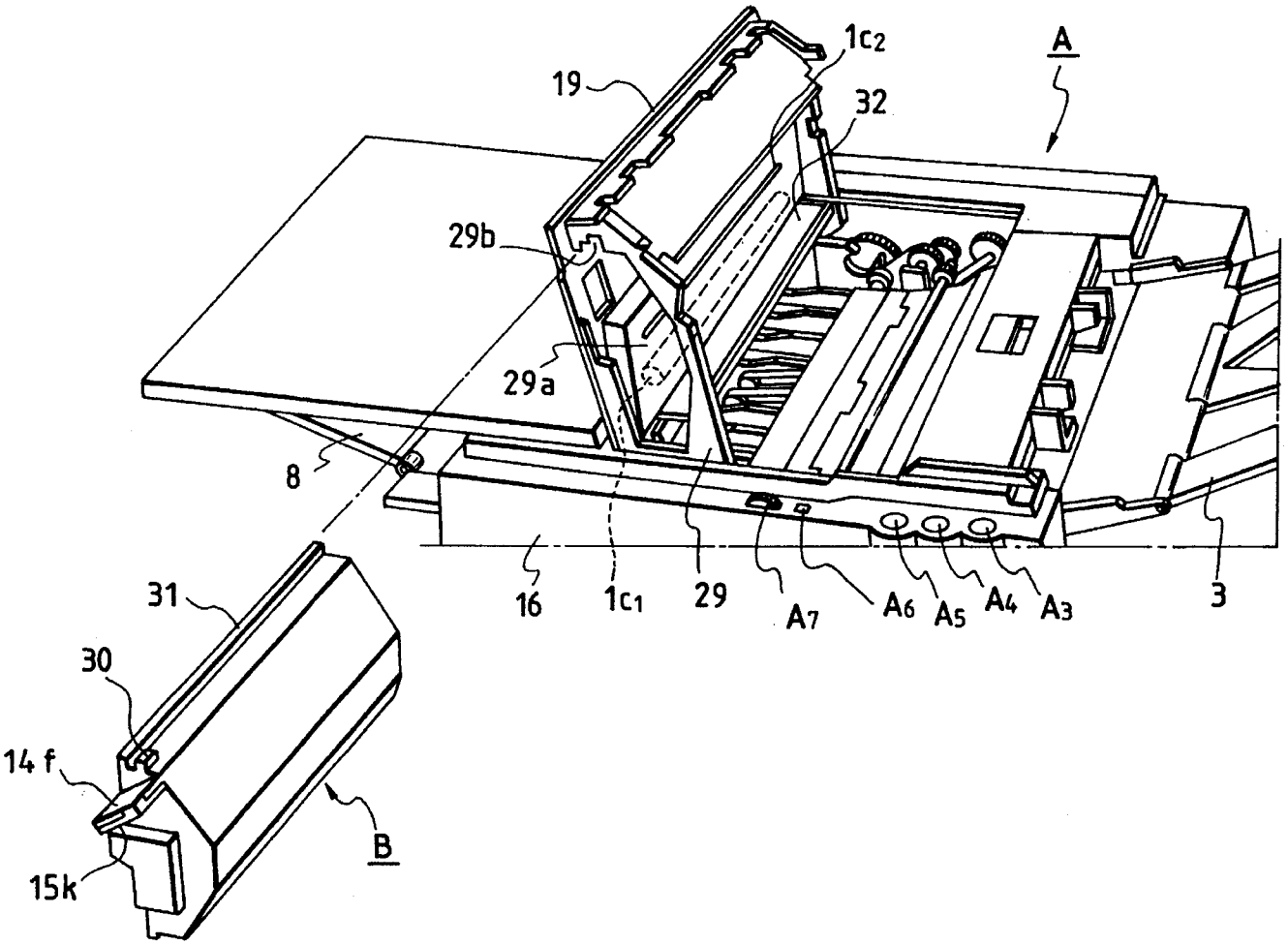
FIG. 41 is a perspective view showing a condition that the process cartridge of FIG. 24 is being mounted within the image forming system.

Incidentally, as shown in FIG. 40, a mismount preventing projection 30 is formed on the process cartridge B and the fitting window 29*a* has a recess 29*b* for receiving the projection 30. As shown in FIGS. 40 and 41, the configuration or position of the projection 30 is differentiated depending upon a particular process cartridge containing the toner having the developing sensitivity suitable to a particular image forming apparatus A (i.e. differentiated for each process cartridge), so that, even when a process cartridge containing the toner having the different developing sensitivity is tried to be mounted within the particular image forming apparatus, since the projection 30 does not match with the fitting window 29*a* of that image forming apparatus, it cannot be mounted within that image forming apparatus. Accordingly, the mismounting of the process cartridge B can be prevented, thus preventing the formation of the obscure image due to the different developing sensitive toner. Incidentally, it is also possible to prevent the mismounting of a process cartridge including a different kind of photosensitive drum, as well as the different developing sensitivity. Further, since the recess 29*b* and the projection 30 are situated this side when the process cartridge is mounted, if the operator tries to erroneously mount the process cartridge within the image forming apparatus, he can easily ascertain with his eyes the fact that the projection 30 is blocked by the filling member 29. Thus, the possibility that the operator will forcibly push the process cartridge into the image forming apparatus to damage the process cartridge B and/or the image forming apparatus A as in the conventional case can be avoided.

After the process cartridge B is inserted into the fitting window 29*a* of the opening/closing cover 19, when the cover 19 is closed, the rotaty shaft 9*f* of the photosensitive drum 9 which is protruded from one side of the upper and lower frames 14, 15 is supported by a shaft support member 33 (FIG. 40) via a bearing 46*a*, and the rotary shaft 12d2 of the developing sleeve 12*d* which is protruded from one side of the upper and lower frames 14, 15 is supported by the shaft support member 33 via a slide bearing 46*b* and a bearing 46*c* (FIG. 35). On the other hand, the drum shaft portion 26*d* (FIG. 35) of the bearing member 26 attached to the other end of the photosensitive drum 9 is supported by a shaft support member 34 shown in FIG. 42.

In this case, the protection cover 22 is rotated to expose the photosensitive drum 9, with the result that the photosensitive drum 9 is contacted with the transfer roller 6 of the image forming apparatus A. Further, the drum earthing contact 18*a* contacting the photosensitive drum 9, the developing bias contact 18*b* contacting the developing sleeve 12*d* and the charging bias contact 18*c* contacting the charger roller 10 are provided on the process cartridge B so that these contacts protrude from the lower surface of the lower frame 15, and these contacts 18*a*, 18*b*, 18*c* are urgingly contacted with the drum earthing contact pin 35*a*, developing bias contact pin 35*b* and charging bias contact pin 35*c* (FIG. 42), respectively.

Figure 42:
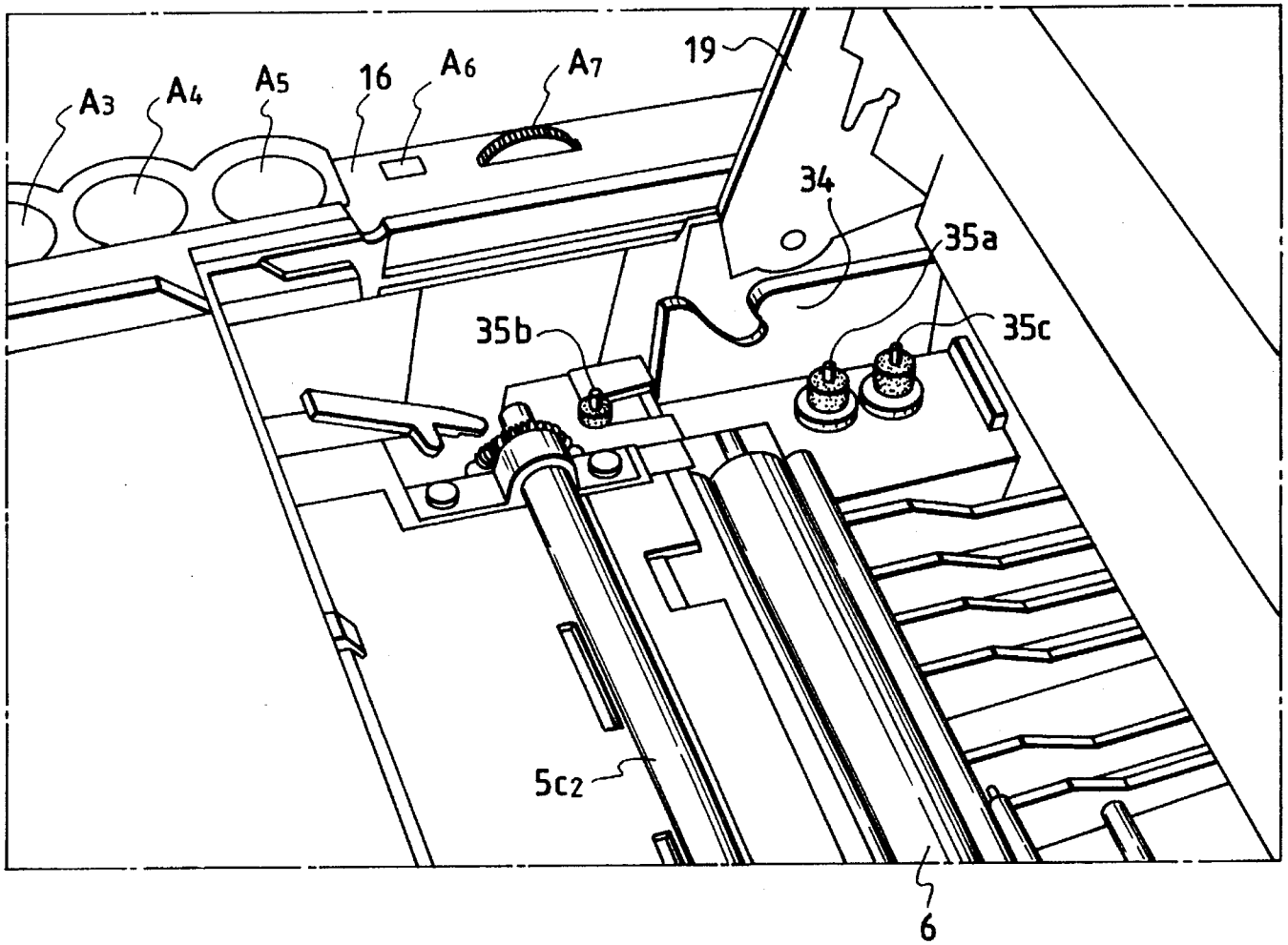
FIG. 42 is a perspective view showing the arrangement of three contacts provided on the image forming system.
Figure 43A:
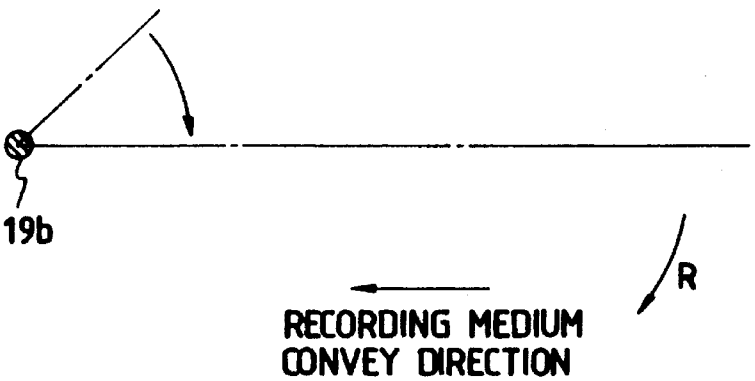
FIG. 43 is a sectional view showing the construction of the three contacts.
Figure 43B:
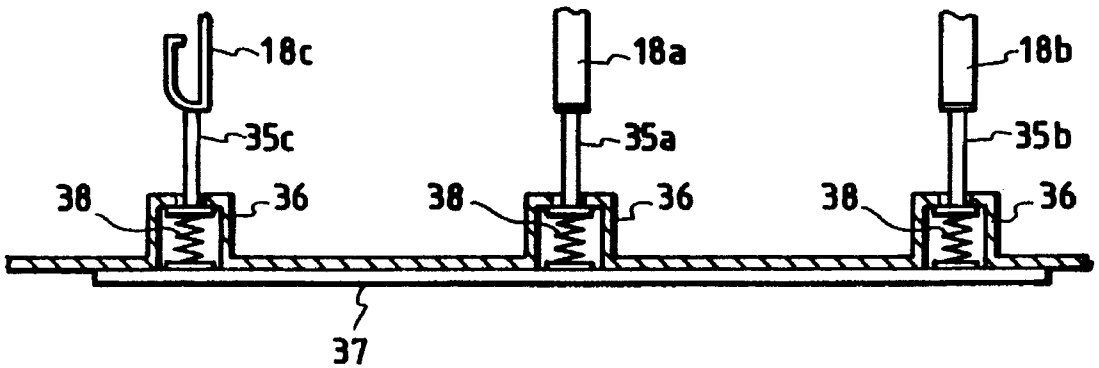

As shown in FIG. 42, these contact pins 35*a*, 35*b*, 35*c* are arranged so that the drum earthing contact pin 35*a* and the charging bias contact pin 35*c* are disposed at a downstream side of the transfer roller 6 in the recording medium feeding direction and the developing bias contact pin 35*b* is disposed at an upstream side of the transfer roller 6 in the recording medium feeding direction. Accordingly, as shown in FIG. 43, the contacts 18*a*, 18*b*, 18*c* provided on the process cartridge B are similarly arranged so that the drum earthing contact 18*a* and the charging bias contact 18*c* are disposed at a downstream side of the photosensitive drum 9 in the recording medium feeding direction and the developing bias contact 18*b* is disposed at an upstream side of the photosensitive drum 9 in the recording medium feeding direction.

Now, the disposition of the electric contacts of the process cartridge B will be explained with reference to FIG. 51. Incidentally, FIG. 51 is a schematic plan view showing the positional relation between the photosensitive drum 9 and the electric contacts 18*a*, 18*b*, 18*c*.

Figure 51:
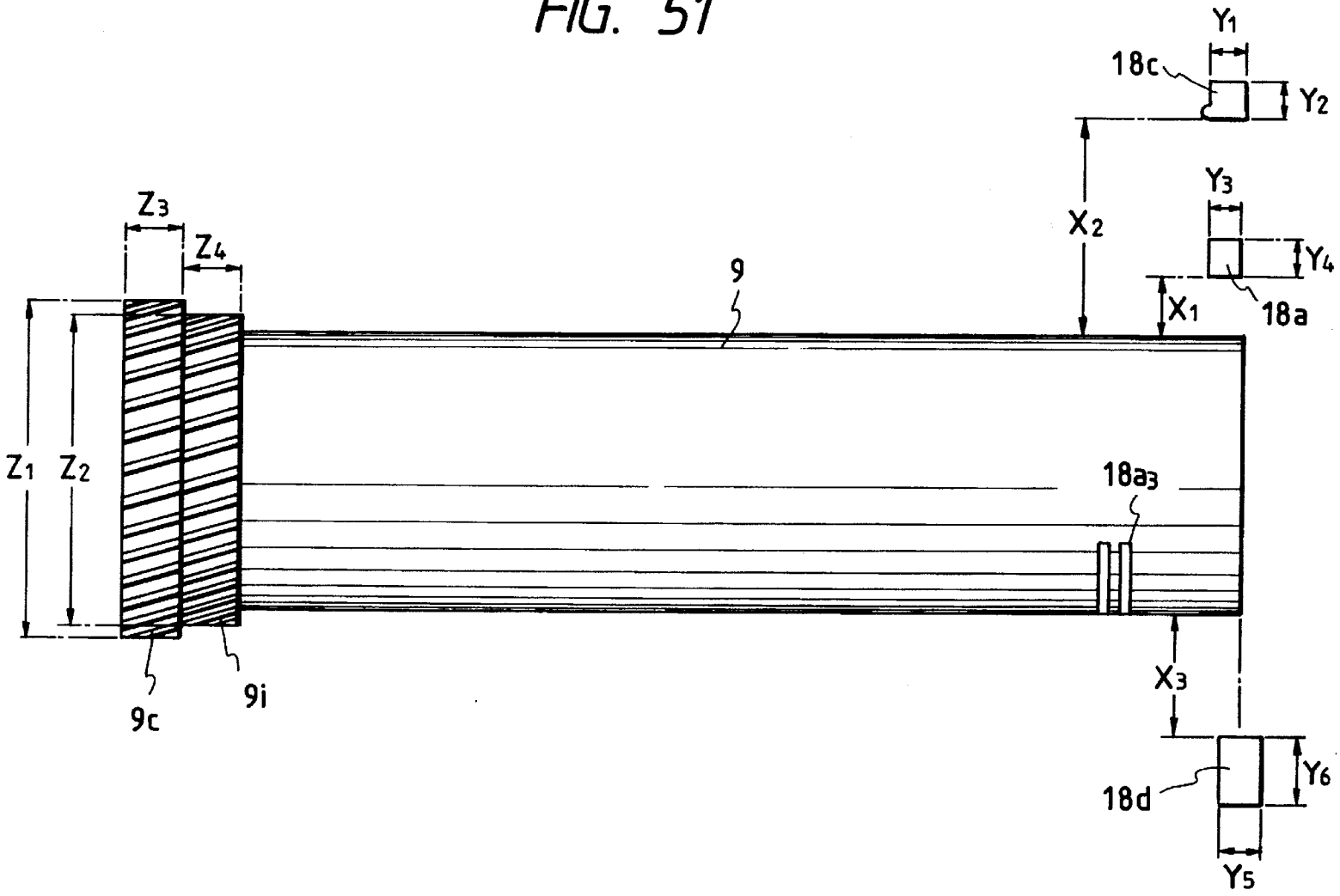
FIG. 51 is a view showing gears and contacts attached to the photosensitive drum.

As shown in FIG. 51, the contacts 18*a*, 18*b*, 18*c* are disposed at the end of the photosensitive drum 9 opposite to the end where the flange gear 9*c* is arranged in the longitudinal direction of the drum. The developing bias contact 18*b* is disposed at one side of the photosensitive drum 9 (i.e. side where the developing means 12 is arranged), and the drum earthing contact 18*a* and the charging bias contact 18*c* are disposed at the other side of the photosensitive drum (where the cleaning means 13 is arranged). The drum earthing contact 18*a* and the charging bias contact 18*c* are substantially arranged on a straight line. Further, the developing bias contact 18*b* is arranged slightly outwardly of the positions of the drum earthing contact 18*a* and the charging bias contact 18*c* in the longitudinal direction of the photosensitive drum 9. The drum earthing contact 18*a*, the developing bias Contact 18*b* and the charging bias contact 18*c* are spaced apart from the outer peripheral surface of the photosensitive drum 9 gradually in order (i.e. a distance between the contact 18*a* and the drum is smallest, and a distance between the contact 18*c* and the drum is greatest). Further, an area of the developing bias contact 18*b* is greater than an area of the drum earthing contact 18*a* and an area of the charging bias contact 18*c*. Furthermore, the developing bias contact 18*b*, the drum earthing contact 18*a* and the charging bias contact 18*c* are disposed outwardly of a position where the arm portions 18a3 of the drum earthing contact 18*a* are contacted with the inner surface of the photosensitive drum 9, in the longitudinal direction of the photosensitive drum 9.

As mentioned above, by arranging the electric contacts between the process cartridge (which can be mounted within the image forming system) and the image forming apparatus at the positioning and abutting side of the process cartridge, it is possible to improve the positional accuracy between the contacts of the process cartridge and the contact pins of image forming apparatus, thereby preventing the poor electrical connection, and, by arranging the contacts at the non-driving side of the process cartridge, it is possible to make the configurations of the contact pins of the image forming apparatus simple and small-sized.

Further, since the contacts of the process cartridge are disposed inside of the contour of the frames of the process cartridge, it is possible to prevent foreign matter from adhering to the contacts, and, thus, to prevent the corrosion of the contacts; and, further to prevent the deformation of the contacts due to the external force. Further, since the developing bias contact 18*b* is arranged at the side of the developing means 12 and the drum earthing contact 18*a* and the charging bias contact 18*c* are arranged at the side of the cleaning means 13, the arrangement of electrodes in the process cartridge can be simplified, thus making the process cartridge small-sized.

Now, dimensions of various parts in the illustrated embodiment will be listed up herein below. However, it should be noted that these dimensions are merely an example, and the present invention is not limited to this example:

| | |
|---|---|
| (1) Distance (X1) between the photosensitive drum 9 and the drum earthing contact 18a | about 6.0 mm; |
| (2) Distance (X2) between the photosensitive drum 9 and the charging Iiias contact 18c | about 18.9 mm; |
| (3) Distance (X3) between the photosensitive drum 9 and the developing bias contact 18b | about 13.5 mm; |
| (4) Width (Y1) of the charging bigs contact 18c | about 4.9 mm; |
| (5) Length (Y2) of the charging bias contact 18c | about 6.5 mm; |
| (6) Width (Y3) of the drum earthing contact 18a | about 5.2 mm; |
| (7) Length (Y4) of the drum earthing contact 18a | about 5.0 mm; |
| (8) Width (Y5) of the developing bias contact 18a | about 7.2 mm; |
| (9) Length (Y6) of the developing bias contact 18a | about 8.0 mm |
| (10) Diameter (Z1) of the flange gear 9c | about 28.6 mm; |
| (11) Diameter (Z2) of the gear 9i | about 26.1 mm; |
| (12) Width (Z3) of the flange gear 9c | about 6.7 mm; |
| (13) Width (Z3) of the gear 9i | about 4.3 mm; |
| (14) Number of teeth of the flange gear 9c | 33; and |
| (15) Number of teeth of the gear 9i | 30. |

Now, the flange gear 9*c* and the gear 9*i* will be explained. The gears 9*c*, 9*i* comprise helical gears. When the driving force is transmitted from the image forming apparatus to the flange gear 9*c*, the photosensitive drum 9 mounted in the lower frame 15 with play is subjected to the thrust force to be shifted toward the flange gear 9*c*, thereby positioning the drum at the side of the lower frame 15.

The gear 9*c* is used with a process cartridge containing the magnetic toner for forming a black image. When the black image forming cartridge is mounted within the image forming apparatus, the gear 9*c* is meshed with a gear of the image forming apparatus to receive the driving force for rotating the photosensitive drum 9 and is meshed with a gear of the developing sleeve 12*d* to rotate the latter. The gear 9*i* is meshed with a gear connected to the transfer roller 6 of the image forming apparatus to rotate the transfer roller. In this case, the rotational load does not almost act on the transfer roller 6.

Incidentally, the gear 9*i* is used with a color image forming cartridge containing the non-magnetic toner. When the color image forming cartridge is mounted within the image forming apparatus, the gear 9*c* is meshed with the gear of the image forming apparatus to receive the driving force for rotating the photosensitive drum 9. On the other hand, the gear **9*i* is meshed with the gear connected to the transfer roller 6 of the image forming apparatus to rotate the transfer roller and is meshed with the gear of the developing sleeve 12*d* for the non-magnetic toner to rotate the latter. The flange gear 9*c* has a diameter greater than that of the gear 9*i*, a width greater than that of the gear 9*i* and a number of teeth-greater than that of the gear 9*i*. Thus, even when the greater load is applied to the gear 9*c*, the gear 9*c* can receive the driving force to rotate the photosensitive drum 9 more surely, and can transmit the greater driving force to the developing sleeve 12*d*** for the magnetic toner to rotate the latter more surely.

Incidentally, as shown in FIG. 43, each of the contact pins **35*a*–35*c* is held in a corresponding holder cover 36 in such a manner that it can be shifted in the holder cover but cannot be detached from the holder cover. Each contact pin 35*a*–35*c* is electrically connected to a wiring pattern printed on an electric substrate 37 to which the holder covers 36 are attached, via a corresponding conductive compression spring 38. Incidentally, the charging bias contact 18*c* to be abutted against the contact pin 35*c* has the arcuated curvature in the vicinity of the pivot axis 19*b* of the upper opening/closing cover 19 so that, the opening/closing cover 19 mounting the process cartridge B thereon is rotated around the pivot axis 19*b* in a direction shown by the arrow R to close the cover, the charging bias contact 18*c* nearest to the pivot axis 19*b* (i.e. having the minimum stroke) can contact with the contact pin 35*c*** effectively.

Positioning

When the process cartridge B is mounted and the opening/closing cover 19 is closed, the positioning is established so that a distance between the photosensitive drum 9 and the lens unit **1*c* and a distance between the photosensitive drum 9** and the original glass support la are kept constant. Such positioning will now be explained.

In shown in FIG. 8, positioning projections **15*m* are formed on the lower frame 15 to which the photosensitive drum 9 is attached, in the vicinity of both longitudinal ends of the frame. As shown in FIG. 5, when the upper and lower frames 14, 15 are interconnected, these projections 15*m* protrude upwardly through holes 14*g* formed in the upper frame 14**.

Figure 44:
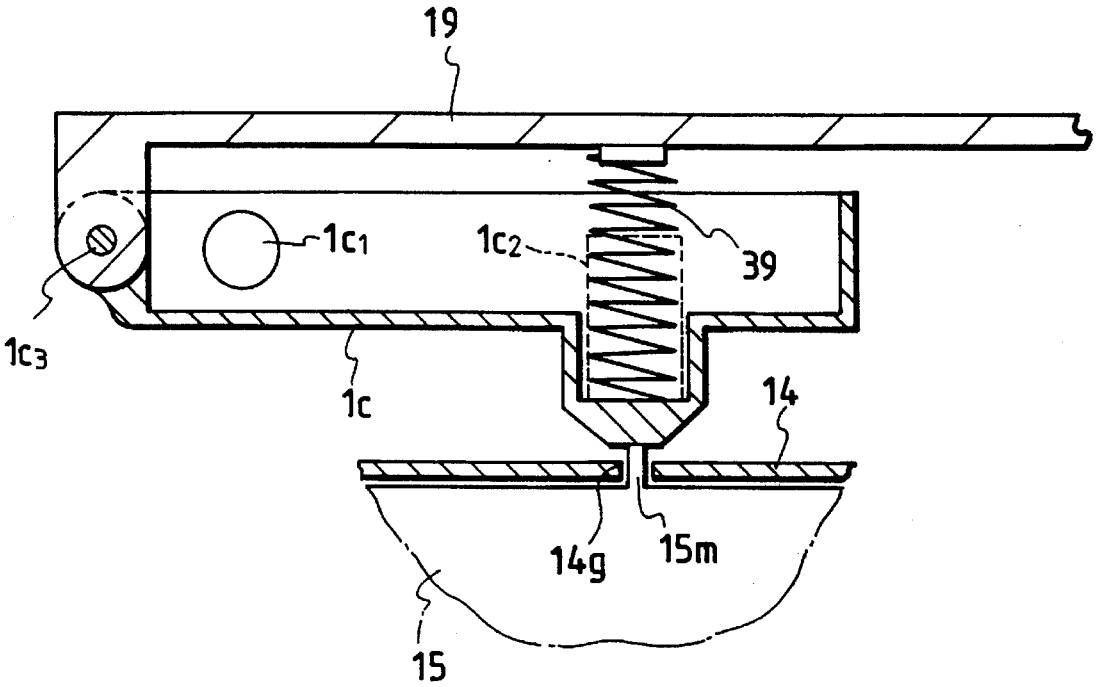
FIG. 44 is a sectional view for explaining the positioning of the relative position between the lower frame and a lens unit.

Further, as shown in FIG. 44, the lens unit **1*c* containing therein the lens array 1c2 for reading the original 2 is attached to the upper opening/closing cover 19 (on which the process cartridge B is mounted) via a pivot pin 1c3 for slight pivotal movement around the pivot pin and is biased downwardly (FIG. 44) by an urging spring 39. Thus, when the process cartridge B is mounted on the upper cover 19 and the latter is closed, as shown in FIG. 44, the lower surface of the lens unit 1*c* is abutted against the positioning projections 15*m* of the process cartridge B. As a result, when the process cartridge B is mounted within the image forming apparatus A, the distance between the lens array 1c2 in the lens unit 1*c* and the photosensitive drum 9 mounted on the lower frame 15 is accurately determined, so that the light image optically read from the original 2 can be accurately illuminated onto the photosensitive drum 9 via the lens array 1c2**.

Figure 45:
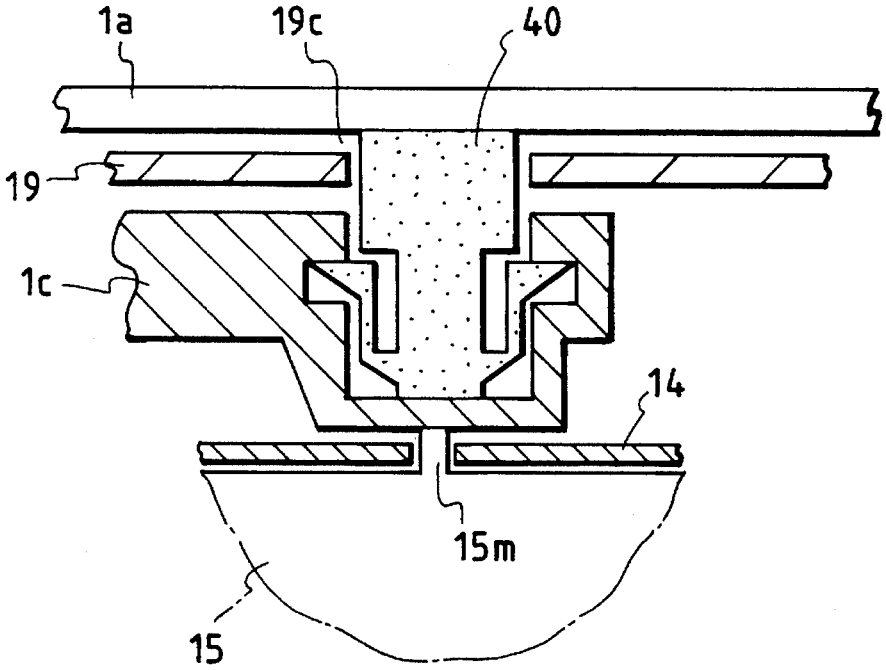
FIG. 45 is a sectional view for explaining the positioning of the relative position between the lower frame and an original glass support.
Figure 46:
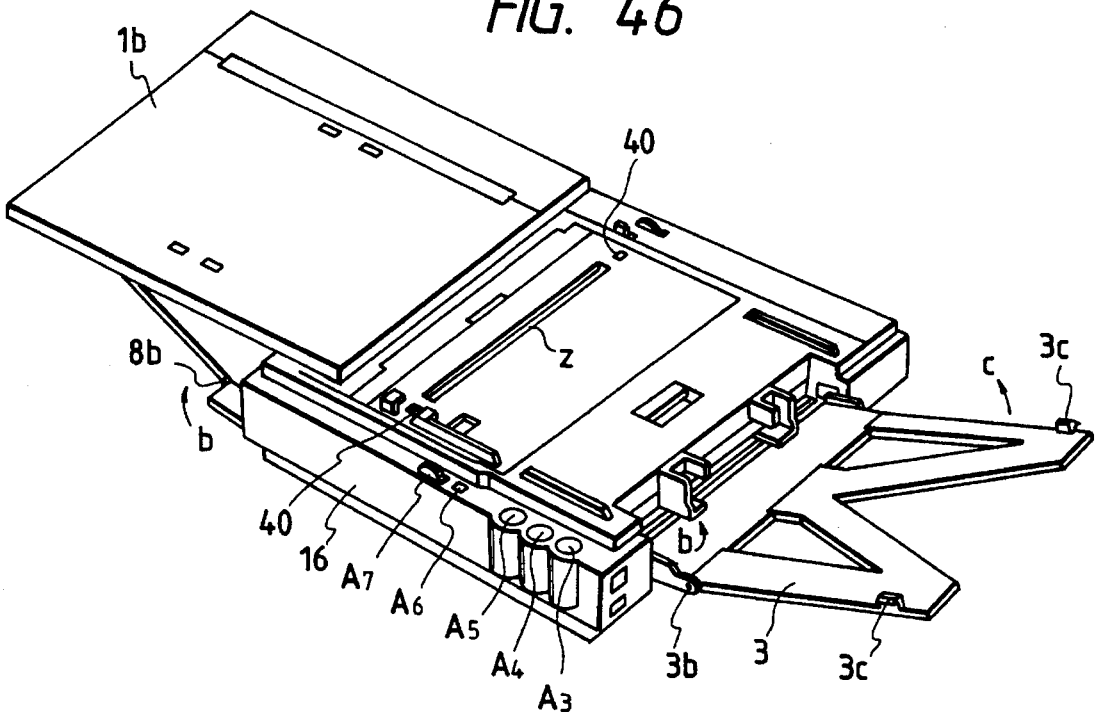
FIG. 46 is a perspective view showing the attachment positions of positioning pegs.

Further, as shown in FIG. 45, positioning pegs 40 are provided in the lens unit **1*c*, which positioning pegs can be protruded slightly from the upper cover 19 upwardly through holes 19*c* formed in the upper cover. As shown in FIG. 46, the positioning pegs 40 are protruded slightly at both longitudinal sides of an original reading slit Z (FIGS. 1 and 46). Thus, when the process cartridge B is mounted on the upper cover 19 and the latter is closed and then the image forming operation is started, as mentioned above, since the lower surface of the lens unit 1*c* is abutted against the positioning projections 15*m*, the original glass support 1*a* is shifted while riding on the positioning pegs 40. As a result, a distance between the original 2 rested on the original glass support 1*a* and the photosensitive drum 9 mounted on the lower frame 15 is always kept constant, thus illuminating the light reflected from the original 2 onto the photosensitive drum 9 accurately. Therefore, since the information written on the original 2 can be optically read accurately and the exposure to the photosensitive drum 9** can be effected accurately, it is possible to obtain a high quality image.

Drive Transmission

Next, the driving force transmission to the photosensitive drum 9 in the process cartridge B mounted within the image forming apparatus A will be explained.

Figure 47:
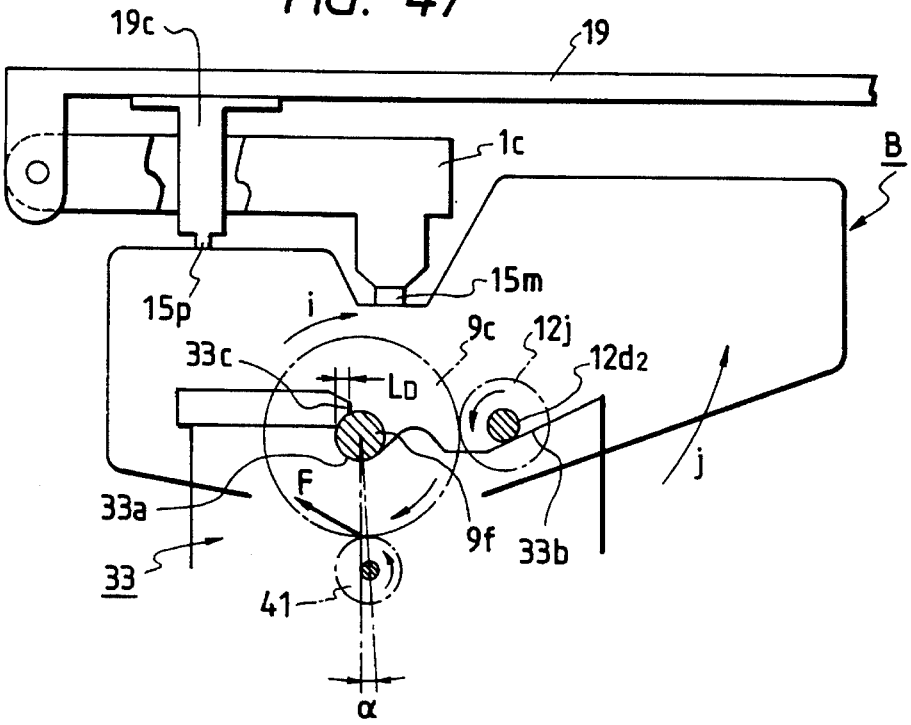
FIG. 47 is a schematic elevational view showing the relation between rotary shafts of the drum and of the sleeve and shaft supporting members therefor, and a transmitting direction of a driving force from a drive gear to a flange gear of the photosensitive drum.

When the process cartridge B is mounted within the image forming apparatus A, the rotary shaft **9*f* of the photosensitive drum 9 is supported by the shaft support member 33 of the image forming apparatus as mentioned above. As shown in FIG. 47, the shaft support member 33 comprises a supporting portion 33*a* for the drum rotary shaft 9*f*, and an abutment portion 33*b* for the rotary shaft 12d2 of the developing sleeve 12*d*. An overlap portion 33*c* having a predetermined overhanging amount L (1.8 mm in the illustrated embodiment) is formed on the supporting portion 33*a*, thus preventing the drum rotary shaft 9*f* from floating upwardly. Further, when the drum rotary shaft 9*f* is supported by the supporting portion 33*a*, the rotary shaft 12d2 of the developing sleeve is abutted against the abutment portion 33*b*, thus preventing the rotary shaft 12d2 from dropping downwardly. Further, when the upper opening/closing cover 19 is closed, positioning projections 15*p* of the lower frame 15 protruding from the upper frame 14 of the process cartridge B are abutted against an abutment portion 19*c* of the opening/closing cover 19**.

Accordingly, when the driving force is transmitted to the flange gear **9*c* of the photosensitive drum 9 by driving the drive gear 41 of the image forming apparatus meshed with the flange gear, the process cartridge B is subjected to a reaction force tending to rotate the process cartridge around the drum rotary shaft 9*f* in a direction shown by the arrow i in FIG. 47. However, since the rotary shaft 12d2 of the developing sleeve is abutted against the abutment portion 33*b* and the positioning projections 15*p* of the lower frame 15 protruding from the upper frame 14 are abutted against the abutment portion 19*c*** of the upper cover, the rotation of the process cartridge B is prevented.

As mentioned above, although the lower surface of the lower frame 15 acts as the guide for the recording medium 4, since the lower frame is positioned by abutting it against the body of the image forming apparatus as mentioned above, the positional relation between the photosensitive drum 9, the transfer roller 6 and the guide portions 15h1, 15h2 for the recording medium 4 is maintained with high accuracy, thus performing the feeding of the recording medium and the image transfer with high accuracy.

During the driving force transmission, the developing sleeve **12*d* is biased downwardly not only by the rotational reaction force acting on the process cartridge B but also by a reaction force generated when the driving force is transmitted from the flange gear 9*c* to the sleeve gear 12*j*. In this case, if the rotary shaft 12d2 of the developing sleeve is not abutted against the abutment portion 33***b*, the developing sleeve 12*d* will be always biased downwardly during the image forming operation. As a result, it is feared that the developing sleeve 12*d* is displaced downwardly and/or the lower frame 15 on which the developing sleeve 12*d* may be mounted is deformed. However, in the illustrated embodiment, since the rotary shaft 12d2 of the developing sleeve is abutted against the = aboutment portion 33*b* without fail, the above-mentioned inconvenience does not occur.

Figure 48:
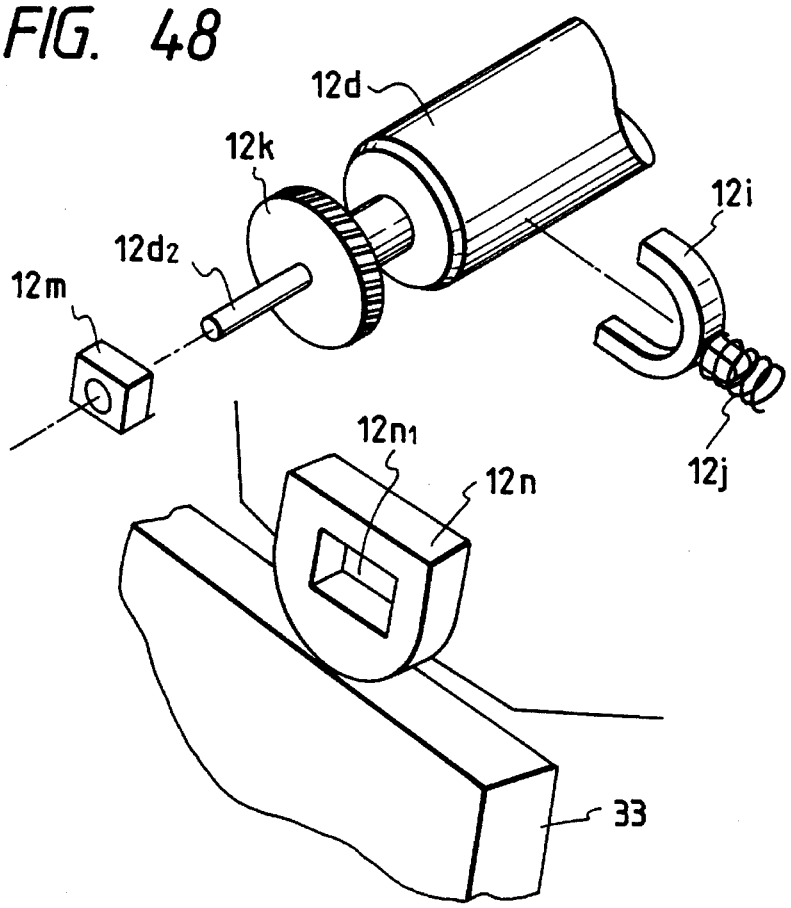
FIG. 48 is an exploded perspective view of a developing sleeve according to an embodiment wherein it can easily be slid.
Figure 49:
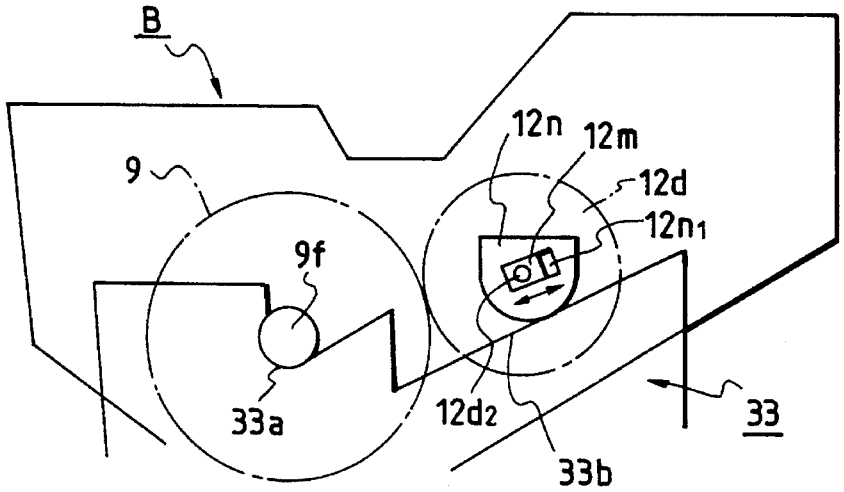
FIG. 49 is a schematic elevational view of the developing sleeve of FIG. 48.

Incidentally, as shown in FIG. 20 the developing sleeve 12*d* is biased against the photosensitive drum 9 by the springs 12*j* via the sleeve bearings 12*i*. In this case, the arrangement as shown in FIG. 48 may be adopted to facilitate the sliding movement of sleeve bearings 12*i*. That is to say, a bearing 12*m* for supporting the rotary shaft 12d2 of the developing sleeve is held in a bearing holder 12*n* in such a manner that the bearing 12*m* can slide along a slot 12n1 formed in the bearing holder. With this arrangement, as shown in FIG. 49, the bearing holder 12*n* is abutted against the abutment portion 33*b* of the shaft support member 33 and is supported thereby; in this condition, the bearing 12*m* can slide along the slot 12n1 in directions shown by the arrow. Incidentally, in the illustrated embodiment, an inclined angle θ (FIG. 47) of the abutment portion 33*b* is selected to have a value of about 40 degrees.

Figure 52A:
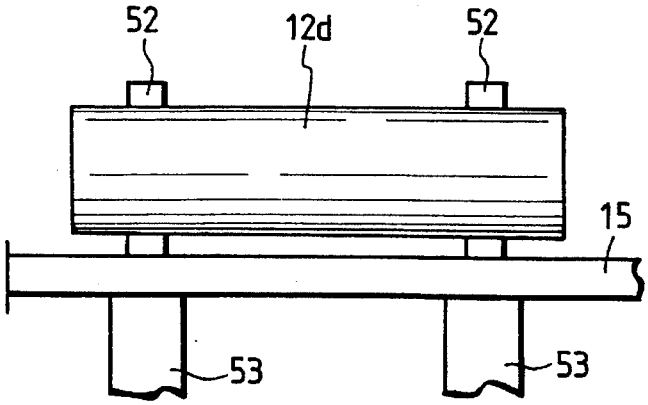
FIG. 52A is an elevational view a developing sleeve receiving member according to another embodiment.
Figure 52B:
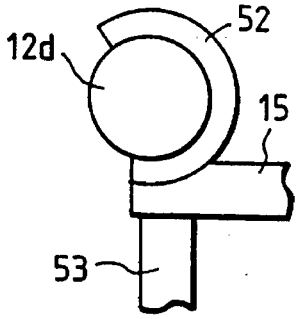
FIG. 52B is an end view of the receiving member of FIG. 52A.

Further, the developing sleeve 12*d* may be supported, not via the sleeve rotary shaft. For example, as shown in FIGS. 52A and 52B, it may be supported at its both ends portions by sleeve bearings 52 lower ends of which are supported by the lower frame 15 which is in turn supported by receiving portions 53 formed on the image forming system.

Further, in the illustrated embodiment, the flange gear 9*c* of the photosensitive drum 9 is meshed with the drive gear 41 for transmitting the driving force to the flange gear in such a manner that, as shown in FIG. 47, a line connecting a rotational center of the flange gear 9*c* and a rotational center of the drive gear 41 is offset from a vertical line passing through the rotational center of the flange gear 9*c* in an anti-clockwise direction by a small angle α (about 1° in the illustrated embodiment), whereby a direction F of the driving force transmission from the drive gear 41 to the flange gear 9*c* is directed upwardly. In general, although the floating of the process cartridge can be prevented by a downwardly directing force generated by setting the angle α to a value of 20° or more, in the illustrated embodiment, such angle α is set to about 1°.

By setting the above-mentioned angle α to about 1° when the upper opening/closing cover 19 is opened in a direction shown by the arrow j to remove the process cartridge B, the flange gear 9*c* is not blocked by the drive gear 41 and, thus, can be smoothly disengaged from the drive gear 41. Further, when the direction F of the driving force transmission is directed upwardly as mentioned above, the rotary shaft 9*f* of the photosensitive drum is pushed upwardly and, therefore, tends to be disengaged from the drum supporting portion 33*a*. However, in the illustrated embodiment, since the overlap portion 33*c* is formed on the supporting portion 33*a*, the drum rotary shaft 9*f* is not disengaged from the drum supporting portion 33*a*.

Re-cycle

The process cartridge-having the above-mentioned construction permits recycling. That is to say, the used-up process cartridge(s) can be collected from the market and the parts thereof can be re-used to form a new process cartridge. Such recycling will now be explained. Generally, the used-up process cartridge was disposed or dumped in the past. However, the process cartridge B according to the illustrated embodiment can be collected from the market after the toner in the toner reservoir has been used up, to protect the resources on the earth and the natural environment. Then, the collected process cartridge is disassembled into the upper and lower frames 14, 15 which are in turn cleaned. Thereafter, reusable parts and new parts are mounted on the upper frame 14 or the lower frame 15 at need, and then new toner is supplied into the toner reservoir 12*a* again. In this way, a new process cartridge is obtained.

Figure 50:
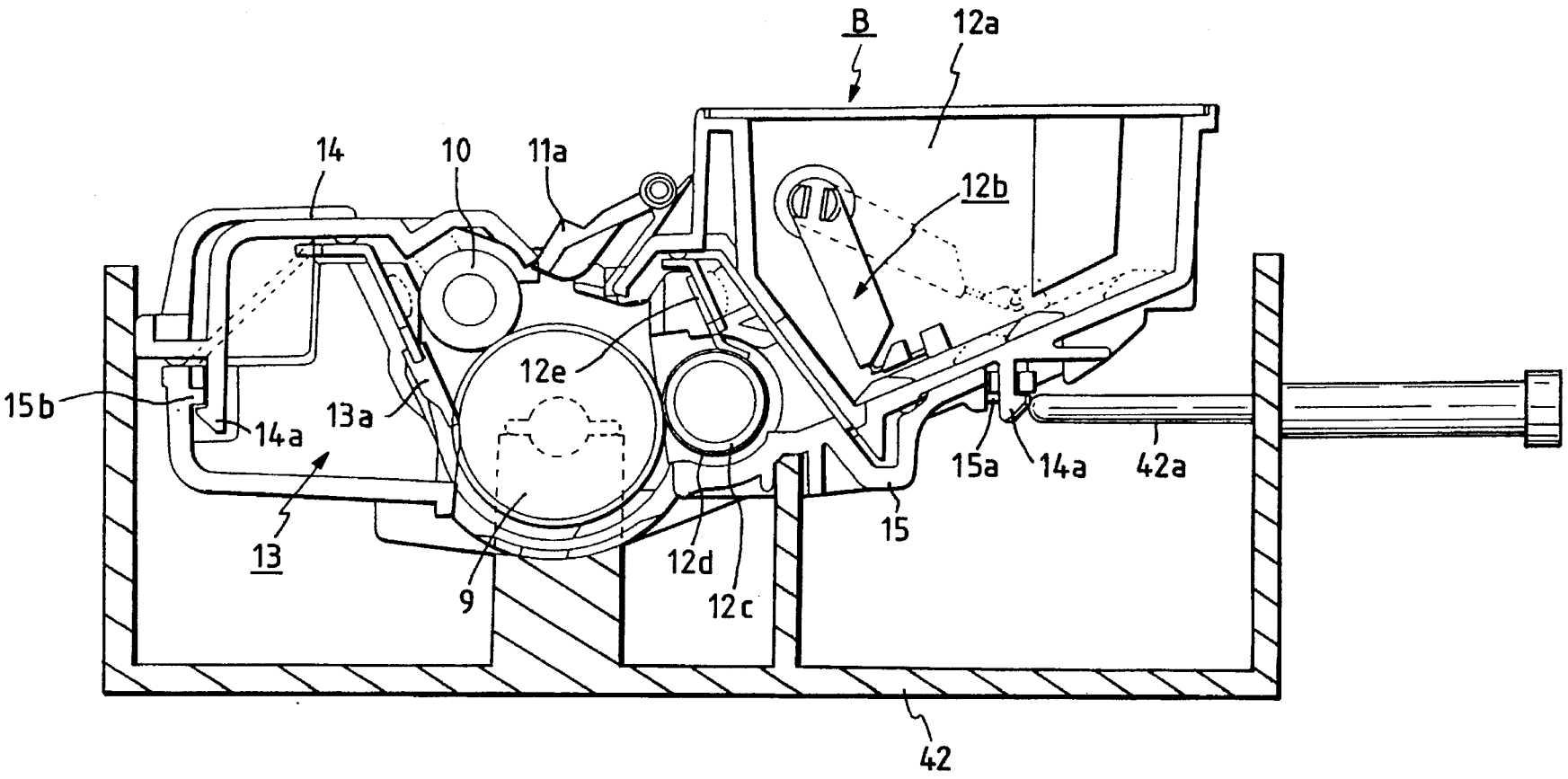
FIG. 50 is an elevational sectional view showing a condition that the upper frame and the lower frame are released.

More particularly, by releasing the connections between the locking pawls 14*a* and the locking openings 15*a*, the locking pawls 14*a* and the locking projection 15*b*, the locking pawl 14*c* and the locking opening 15*d*, and the locking pawl 15*c* and the locking opening 14*b* (FIGS. 4, 8 and 9) which interconnect the upper and lower frames 14, 15, the upper and lower frames 14, 15 can easily be disassembled from each other. Such disassembling operation can easily be performed, for example, by supporting the used-up process cartridge B on a disassembling tool 42 and by pushing the locking pawl 14*a* by means of a pusher rod 42*a*, as shown in FIG. 50. Even when the disassembling tool is not used, the process cartridge can be disassembled by pushing the locking pawls 14*a*, 14*c*, 15*c*.

After the upper frame 14 and the lower frame 15 are disconnected from each other as mentioned above (FIGS. 8 and 9), the frames are cleaned by removing the waste toner adhered to or remaining in the cartridge by an air blow technique. In this case, a relatively large amount of waste toner is adhered to the photosensitive drum 9, developing sleeve 12*d* and/or cleaning means 13 since they are directly contacted with the toner. On the other hand, the waste toner is not or almost not adhered to the charger roller 10 since it is not directly contacted with the toner. Accordingly, the charger roller 10 can be cleaned more easily than the photosensitive drum 9, developing sleeve 12*d* and the like. In this regard, according to the illustrated embodiment, since the charger roller 10 is mounted on the upper frame 14 other than the lower frame 15 on which the photosensitive drum 9, developing sleeve 12*d* and cleaning means 13 are mounted, the upper frame 14 separated from the lower frame 15 can easily be cleaned.

Figure 39B:
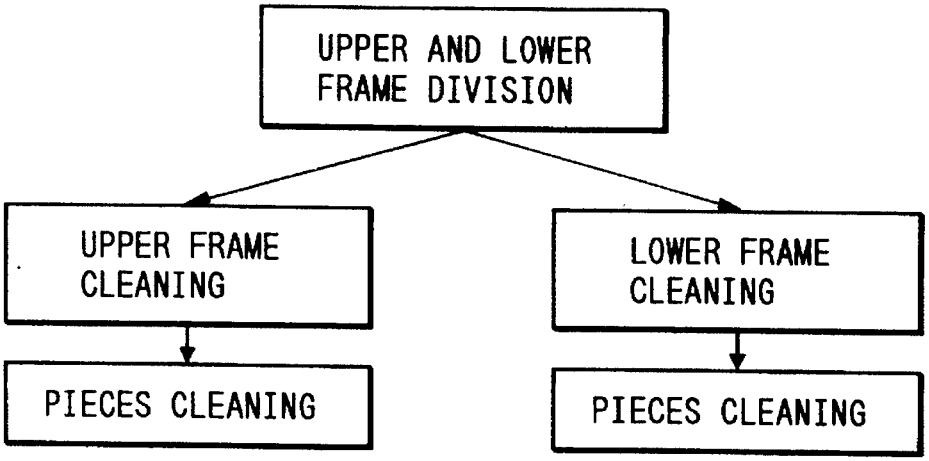
FIG. 39B is a flowchart showing the disassembling and cleaning line for the process cartridge.

In the disassembling and cleaning line as shown in FIG. 39B, first of all, the upper and lower frames 14, 15 are separated from each other as mentioned above. Then, the upper frame 14 and the lower frame 15 are disassembled and cleaned independently. Thereafter, as to the upper frame 14, the charger roller 10 is separated from the upper frame and is cleaned; and as to the lower frame 15, the photosensitive drum 9, developing sleeve 12*d*, developing blade 12*e*, cleaning blade 13*a* and the like are separated from the lower frame and are cleaned. Thus, the disassembling and cleaning line is very simple.

After the toner is cleared, as shown in FIG. 9, the opening 12a1 is sealed by a new cover film 28 again, and new toner is supplied into the toner reservoir 12*a* through the toner filling opening 12a3 formed in the side surface of the toner reservoir 12*a*, and then the filling opening 12*a*3 is closed by the lid 12*a*2. Then, the upper frame 14 and the lower frame 15 are interconnected again by achieving the connections between the locking pawls 14*a* and the locking openings 15*a*, the locking pawls 14*a* and the locking projection 15*b*, the locking pawl 14*c* and the locking opening 15*d*, and the locking pawl 15*c* and the locking opening 14*b*, thus assembling a process cartridge again in a usable condition.

Incidentally, when the upper and lower frames 14, 15 are interconnected, although the locking pawls 14*a* and the locking openings 15*a*, the locking pawls 14*a* and the locking projection 15*b* and the like are interlocked, when the same process cartridge is frequently re-cycled, it is feared that the locking forces between the locking pawls and the locking openings become weaker. To cope with this, in the illustrated embodiment, threaded holes are formed in the frames in the vicinity of four corners thereof. That is to say, through threaded holes are formed in the fitting recesses 14*d* and the fitting projections 14*e* of the upper frame 14 (FIG. 8) and in the fitting projections 15*e* (to be fitted into the recesses 14*d*) and the fitting recesses 15*f* (to be fitted onto the projections 14*e*) of the lower frame 15, respectively. Thus, even when the locking force due to the locking pawls become weaker, after the upper and lower frames 14, 15 are interconnected and-the fitting projections and fitting recesses are interfitted, by screwing screws in the mated threaded holes, the upper and lower frames 14, 15 can be firmly interconnected.

Image Forming Operation

Next, the image forming operation effected by the image forming apparatus A within which the process cartridge B is mounted will be explained.

First of all, the original 2 is rested on the original glass support 1*a* shown in FIG. 1. Then, when the copy start button A3 is depressed, the light source 1c1 is turned ON and the original glass support 1*a* is reciprocally shifted on the image forming apparatus in the left and right directions in FIG. 1 to read the information written on the original optically. On the other hand, in registration with the reading of the original, the sheet supply roller 5*a* and the pair of register rollers 5c1, 5c2 are rotated to feed the recording medium 4 to the image forming station. The photosensitive drum 9 is rotated in the direction d in FIG. 1 in registration of the feeding timing of the paired regist roller 5c1, 5c2, and is uniformly charged by the charger means 10. Then, the light image read by the reading means 1 is illuminated onto the photosensitive drum 9 via the exposure means 11, thereby forming the latent image on the photosensitive drum 9.

At the same time when the latent image is formed, the developing means 12 of the process cartridge B is activated to drive the toner feed mechanism 12*b*, thereby feeding out the toner from the toner reservoir 12*a* toward the developing sleeve 12*d* and forming the toner layer on the rotating developing sleeve 12*d*. Then, by applying to the developing sleeve 12*d* a voltage having the same charging polarity and same potential as that of the photosensitive drum 9, the latent image on the photosensitive drum 9 is visualized as the toner image. In the illustrated embodiment, the voltage of about 1.2 KVVpp, 1590 Hz (rectangular wave) is applied to the developing sleeve 12*d*. The recording medium 4 is fed between the photosensitive drum 9 and the transfer roller 6. By applying to the transfer roller 6 a voltage having a polarity opposite to that of the toner, the toner image on the photosensitive drum 9 is transferred onto the recording medium 4. In the illustrated embodiment, the transfer roller 6 is made of foam EPDM having the volume resistance of about $10^9$ Ωcm and has an outer diameter of about 20 mm, and the voltage of −3.5 KV is applied to the transfer roller as the transfer voltage.

After the toner image was transferred to the recording medium, the photosensitive drum 9 continues to rotate in the direction d. Meanwhile, the residual toner remaining on the photosensitive drum 9 is removed by the cleaning blade 13*a*, and the removed toner is collected into the waste toner reservoir 13*c* via the squeegee sheet 13*b*. On the other hand, the recording medium 4 on which the toner image was transferred is sent, by the convey belt 5*d*, to the fixing means 7 where the toner image is permanently fixed to the recording medium 4 with heat and pressure. Then, ,the recording medium is ejected by the pair of ejector rollers 5f1, 5f2. In this way, the information on the original is recorded on the recording medium.

Next, other embodiments will be explained.

Figure 53:
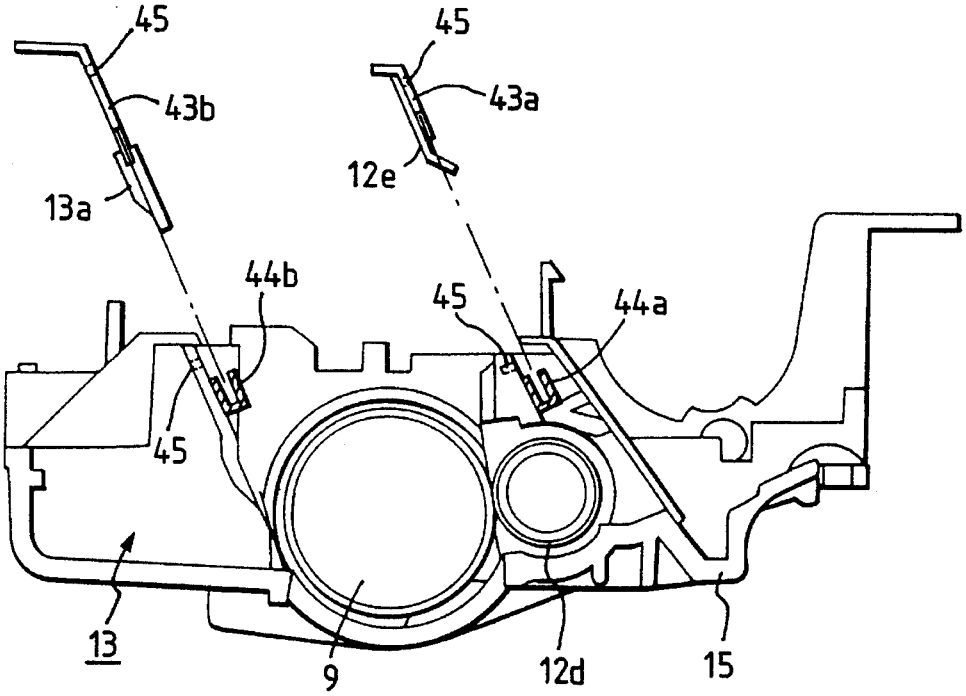
FIG. 53 is an elevational view showing an arrangement wherein the developing blade and the cleaning blade can be attached to the interior of the image forming system by pins.

In the above-mentioned first embodiment, while an example that the developing blade 12*e* and the cleaning blade 13*a* are attached to the frame by pins 24*a*, 24*b* was explained, as shown in FIG. 53, when the developing blade 12*e* and the cleaning blade 13*a* are attached to the lower frame 15 by forcibly inserting fitting projections 43*a*, 43*b* formed on both longitudinal ends of the developing blade 12*e* and the cleaning blade 13*e* into corresponding fitting recesses 44*a*, 44*b* formed in the body 16 of the image forming apparatus, pin holes 45 for receiving the pins for attaching the blades 12*e*, 13*a* may be formed in the-vicinity of the fitting projections 43*a*, 43*b*, and corresponding pin holes 45 may be formed in the body 16 of the image forming apparatus. (Incidentally, in place of the fitting projections 43*a*, 43*b*, half punches or circular bosses may be used.)

With this arrangement, when the fitting connections between the blades 12*e*, 13*a* and the lower frame are loosened by the repeated recycling of the process cartridge B, the blades 12*e*, 13*a* can be firmly attached to the lower frame by pins.

Figure 54:
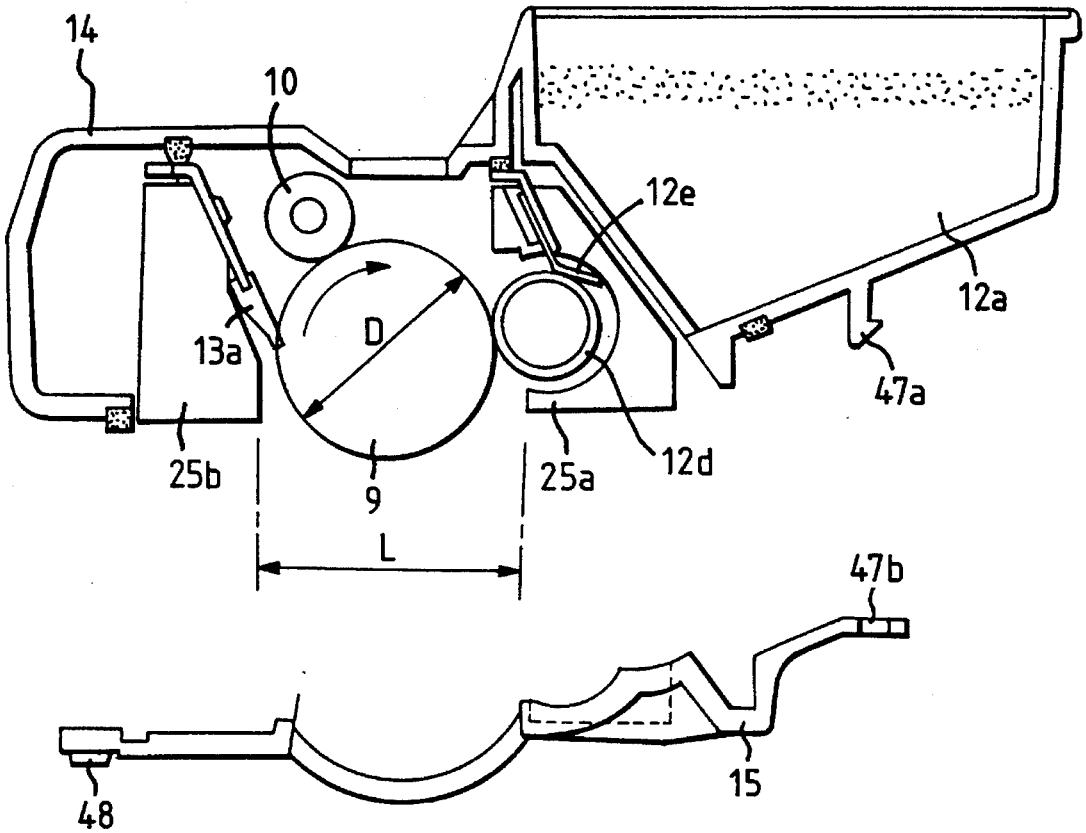
FIG. 54 an elevational view showing a condition that the photosensitive drum is being finally assembled, according to another embodiment.

Further, in the first embodiment, as shown in FIG. 29, while an example that the outer diameter D of the photosensitive drum 9 is smaller than the distance L between the drum guide members 25*a*, 25*b* to permit the final attachment of the photosensitive drum 9 to the lower frame 15 was explained, as shown in FIG. 54, even when the photosensitive drum 9 is incorporated into the upper frame 14, the outer diameter D of the photosensitive drum 9 may be smaller than the distance L between the drum guide members 25*a*, 25*b* so that the photosensitive drum can be lastly incorporated into the upper frame, thereby preventing the surface of the photosensitive drum 9 from damaging, as in the first embodiment. Incidentally, in FIG. 54, elements or parts having the same function as those in the first embodiment are designated by the same reference numerals. Further, the upper and lower frames 14, 15 are interconnected by interlocking locking projections 47*a* and locking openings 47*b* and by securing them by pins 48.

Figure 55:
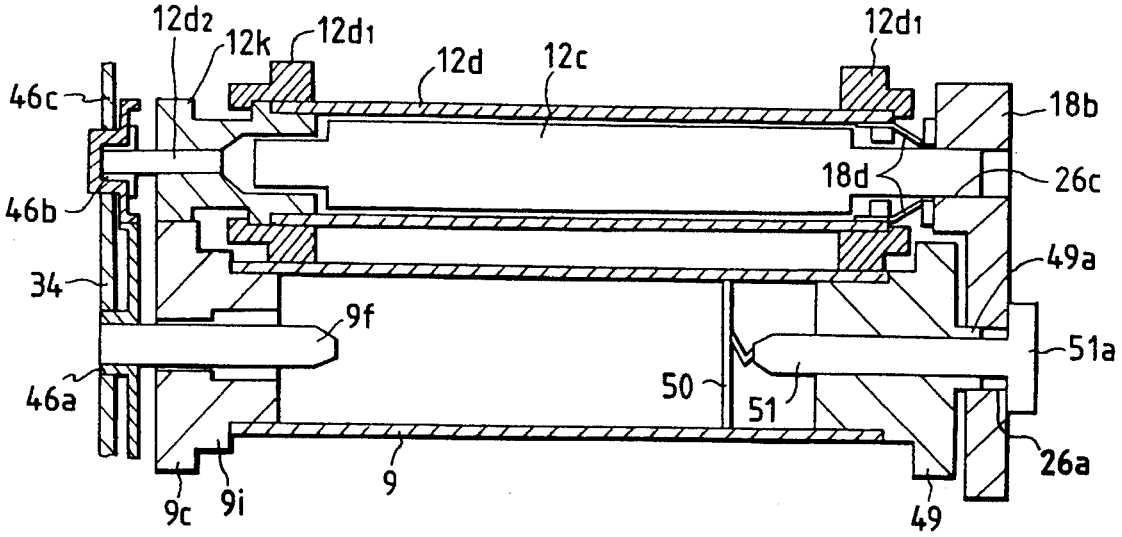
FIG. 55 is an elevational sectional view of bearing members for supporting the photosensitive drum and the developing sleeve, according to another embodiment.

Further, as shown in FIG. 35, in the first embodiment, while the photosensitive drum 9 and the developing sleeve 12*d* are supported by the bearing member 26, when the flange gear 9*c* is provided at one end of the photosensitive drum 9 and the transfer roller gear 49 is provided at the other end of the photosensitive drum, a structure as shown in FIG. 55 may be adopted. Incidentally, also in FIG. 55, elements having the same function as those in the first embodiment are designated by the same reference numerals.

More particularly, in FIG. 55, the flange gear 9*c* and the transfer roller gear 49 are secured to both ends of the photosensitive drum 9 by adhesive, press-fit or the like, respectively, the positioning of the drum is effected by rotatably supporting a central boss 49*a* of the transfer roller gear 49 by the bearing portion 33*a* of the bearing member 26. In this case, in order to earth the photosensitive drum 9, a drum earthing plate 50 having a central L-shaped contact portion is secured to and contacted with the inner surface of the drum, and a drum earthing shaft 51 passing through a central bore in the transfer roller gear 49 is always contacted with the drum earthing plate 50. The drum earthing shaft 51 is made of conductive metal such as stainless steel, and the drum earthing plate 50 is also made of conductive metal such as bronze phosphate, stainless steel or the like. When the process cartridge B is mounted within the image forming apparatus A, a head 51*a* of the drum earthing shaft 51 is supported by the bearing member 26. In this case, the head 51*a* of the drum earthing shaft 51 is contacted with the drum earthing contact pin of the image forming apparatus, the earthing the photosensitive drum. Also in this case, as in the first embodiment, the positional accuracy between the photosensitive drum 9 and the developing sleeve 12*d* can be improved by using the single bearing member 26.

Further, the process cartridge B according to the present invention can be used to not only form a mono-color image as mentioned above, but also form a multi-color image (two color image, three color image or full-color image) by providing a plurality of developing means 12. Furthermore, the developing method may be of known two-component magnetic brush developing type, cascade developing type, touchdown developing type or cloud developing type. In addition, in the first embodiment, while the charger means was of the so-called contact-charging type, for example, other conventional charging technique wherein three walls are formed by tungsten wires and metallic shields made of aluminium are provided on the three walls, and positive or negative ions generated by applying a high voltage to the tungsten wires are shifted onto the surface of the photosensitive drum 9, thereby uniformly charging the surface of the photosensitive drum 9 may be adopted.

Incidentally, the contact-charging may be, for example, of the blade (charging blade) type, pad type, block type, rod type or wire type, as well as the aforementioned roller type. Further, the cleaning means for removing the residual toner remaining on the photosensitive drum 9 may be of the fur brush type or magnetic brush type, as well as blade type.

Furthermore, the process cartridge B comprises an image bearing member (for example, an electrophotographic photosensitive member) and at least one process means. Therefore, as well as the above-mentioned construction, the process cartridge may incorporate integrally therein the image bearing member and the charger means as a unit which can be removably mounted within the image forming apparatus; or may incorporate integrally therein the image bearing member and the developing means as a unit which can be removably mounted within the image forming apparatus; or may incorporate integrally therein the image bearing member and the cleaning means as a unit which can be removably mounted within the image forming apparatus; or may incorporate integrally therein the image bearing member and two or more process means as a unit which can be removable mounted within the image forming apparatus. That is to say, the process cartridge incorporates integrally therein the charger means, developing means or cleaning means and the electrophotographic photosensitive member as a unit which can be removably mounted within the image forming apparatus; or incorporates integrally therein at least one of the charger means, developing means and cleaning means, and the electrophotographic photosensitive member as a unit which can be removably mounted within the image forming apparatus; or incorporates integrally therein the developing means and the electrophotographic photosensitive member as a unit which can be removably mounted within the image forming apparatus.

Further, in the illustrated embodiment, while the image forming apparatus is an electrophotographic copying machine, the present invention is not limited to the copying machine, but may be adapted to other various image forming apparatus such as a laser beam printer, a facsimile, a word processor and the like.

Figure 56:
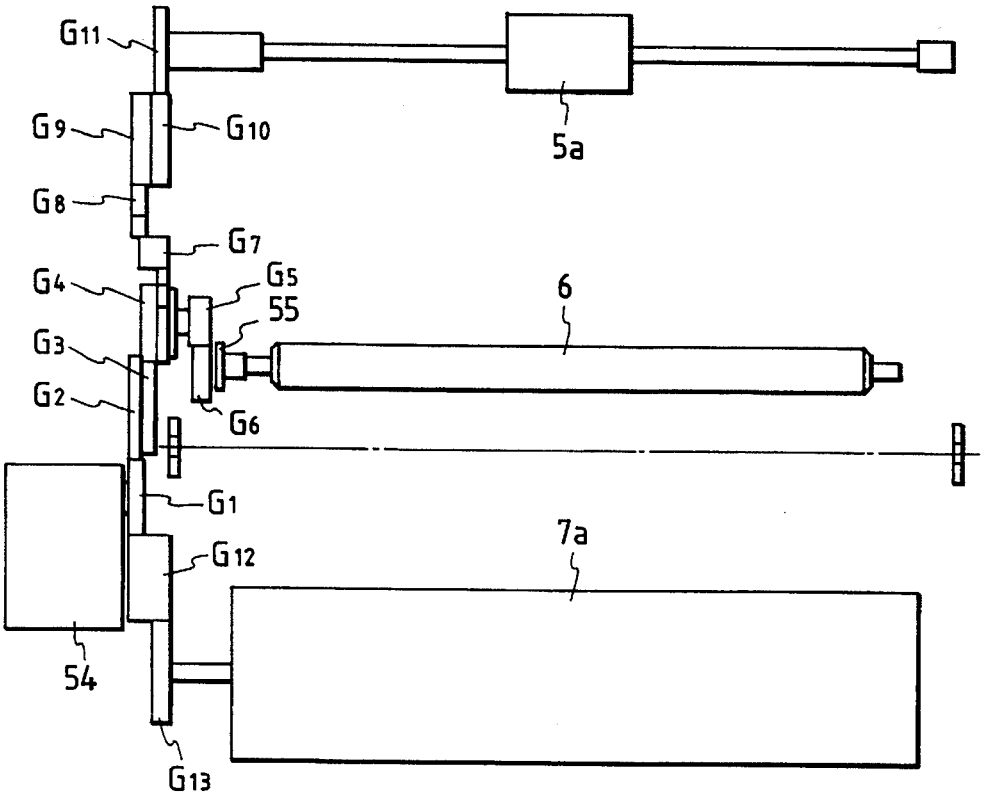
FIG. 56 is a schematic view of a transmission mechanism for transmitting a driving force from a drive motor of the image forming system to various elements.

Now, the above-mentioned driving force transmission to the photosensitive drum 9 will further explained with more detail. As shown in FIG. 56, the driving force is transmitted from the drive motor 54 attached to the body 16 of the image forming apparatus to a drive gear G6 via a gear train G1–G5, and from the drive gear G6 to the flange gear 9*c* meshed with the drive gear, thereby rotating the photosensitive drum 9. Further, the driving force of the drive motor 54 is transmitted from the gear G4 to a gear train G7–G11, thereby rotating the sheet supply roller 5*a*. Furthermore, the driving force of the drive motor 54 is transmitted from the gear G1 to the driving roller 7*a* of the fixing means 7 via gears G12, G13.

Figure 57:
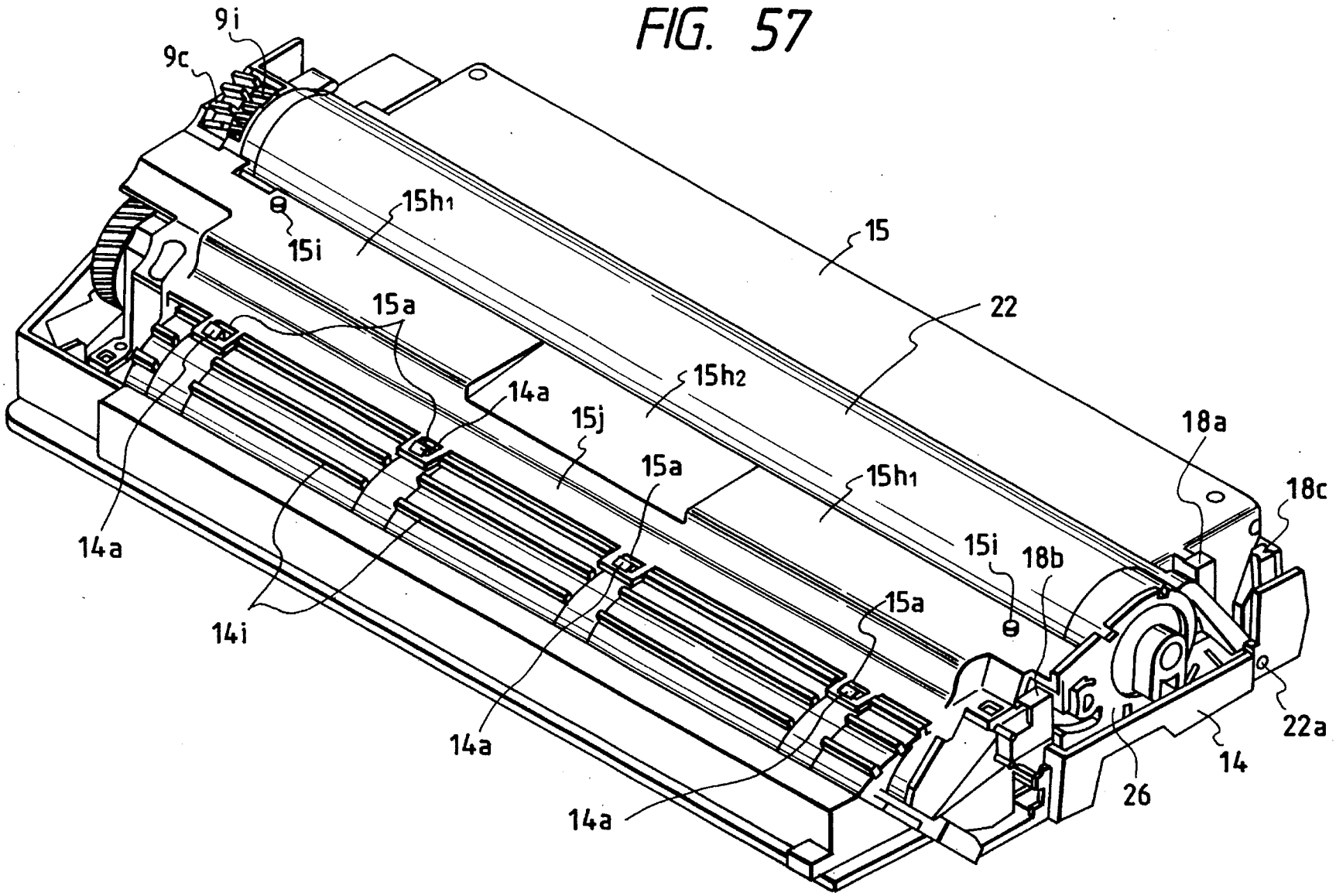
FIGS. 57 and 58 are perspective views showing a condition that the flange gear of the photosensitive drum and a gear integral with the flange gear are protruded from the lower frame.
Figure 58:
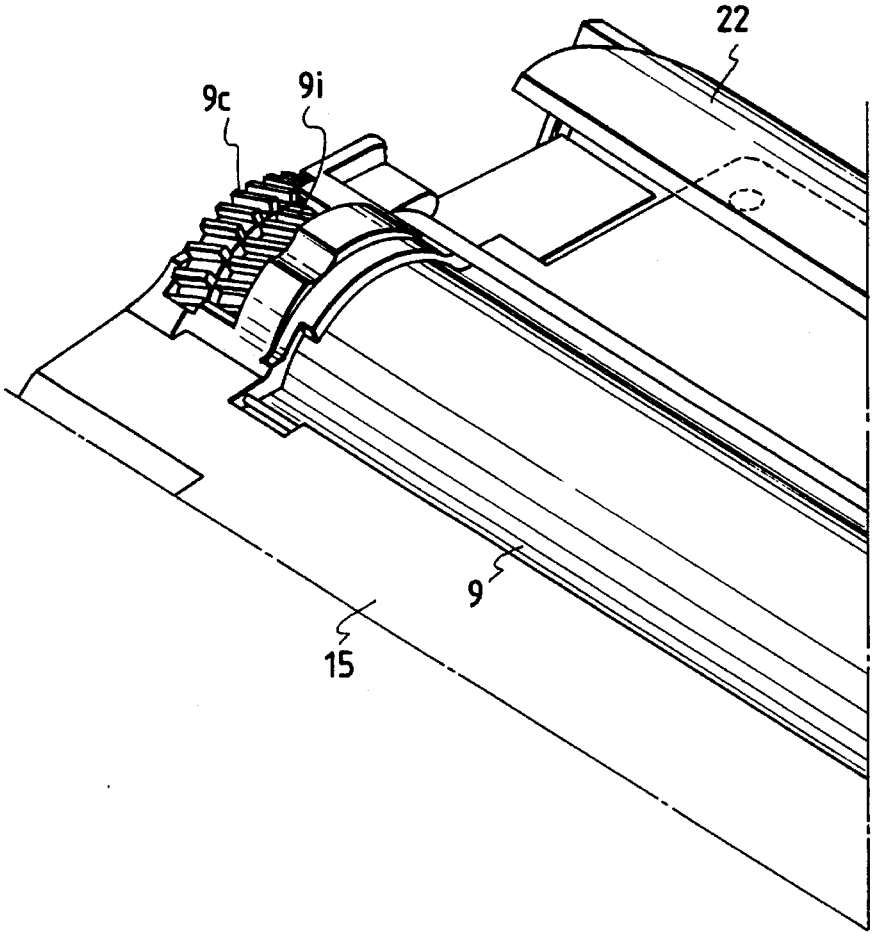
Figure 59:
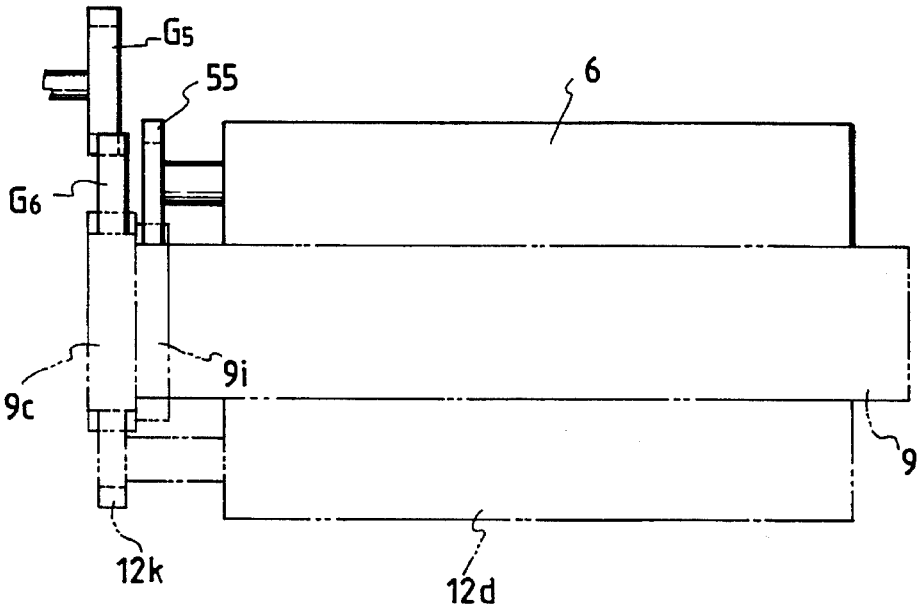
FIG. 59 is a view showing a gear train for transmitting a driving force from the drive gear of the image forming system to the photosensitive drum and the transfer roller.

Further, as shown in FIGS. 57 and 58, the flange gear (first gear) 9*c* and the gear (second gear) 9*i* are integrally formed and portions of the gears 9*c*, 9*i* are exposed from an opening 15*g* formed in the lower frame 15. When the process cartridge B is mounted within the image forming apparatus A, as shown in FIG. 59, the drive gear G6 is meshed with the flange gear 9*c* of the photosensitive drum 9 and the gear 9*i* integral with the gear 9*c* is meshed with the gear 55 of the transfer roller 6. Incidentally, in FIG. 59, the parts of the image forming apparatus are shown by a solid line, and the parts of the process cartridge are shown by a phantom line.

Figure 60A:
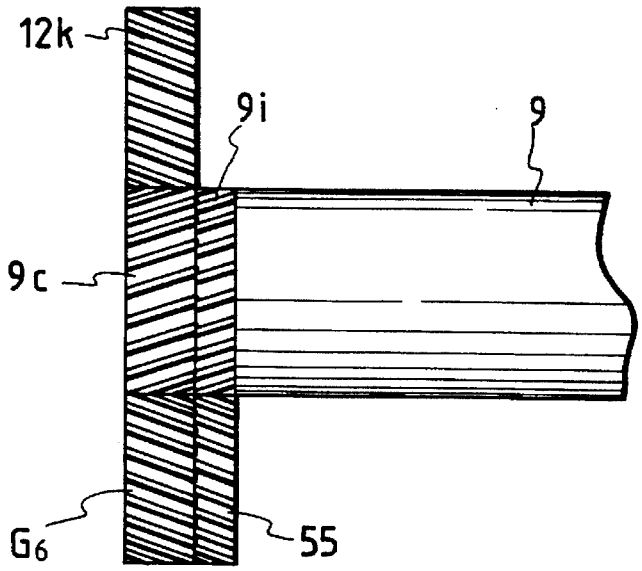
FIGS. 60A and 60B are views showing different drive transmitting mechanisms to developing sleeves, wherein magnetic toner is used and non-magnetic toner is used.
Figure 60B:
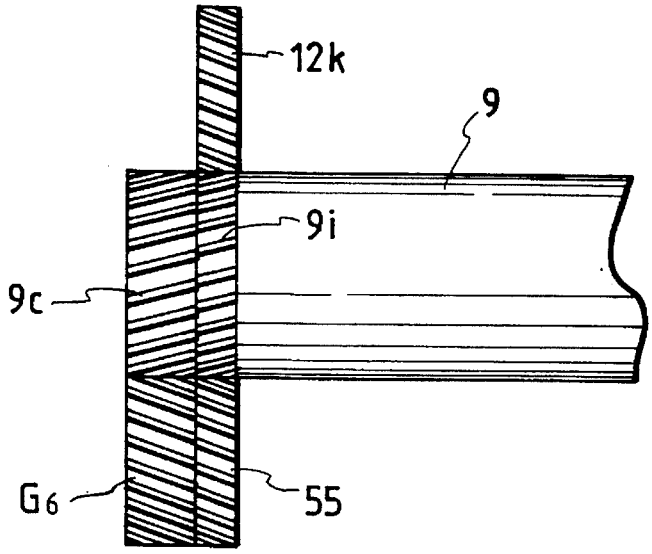

The number of teeth of the gear 9*c* is different from that of the gear 9*i*, so that the rotational speed of the developing sleeve 12*d* when the black image forming cartridge containing the magnetic toner is used is differentiated from the rotational speed of the developing sleeve when the color image forming cartridge containing the non-magnetic toner is used. That is to say, when the black image forming cartridge containing the magnetic toner is mounted within the image forming apparatus, as shown in FIG. 60A, the flange gear 9*c* is meshed with the sleeve gear 12*k* of the developing sleeve 12*d*. On the other hand, when the color image forming cartridge containing the non-magnetic toner is mounted within the image forming apparatus, as shown in FIG. 60B, the gear 9*i* is meshed with the sleeve gear 12*k* of the developing sleeve 12*d* to rotate the developing sleeve.

As mentioned above, since the gear 9*c* has a greater diameter and wider width than those of the gear 9*i* and has a number of teeth greater than that of the gear 9*i*, even when the greater load is applied to the gear 9*c*, the gear 9*c* can surely receive the driving force to rotate the photosensitive drum 9 surely and transmits the greater driving force to the developing sleeve 12*d* for the magnetic toner, thereby surely rotating the developing sleeve 12*d*.

Next, when the developing blade 12*e* and the cleaning blade 13*a* are forcibly fitted into the fitting portions 44*a*, 44*b* of the body 16 of the image forming apparatus as shown in FIG. 53, preferred embodiments of a cleaning blade will be explained. Incidentally, hereinbelow, although the cleaning blade 13*a* will be described, the developing blade 12*e* can be considered similarly.

Figure 61:
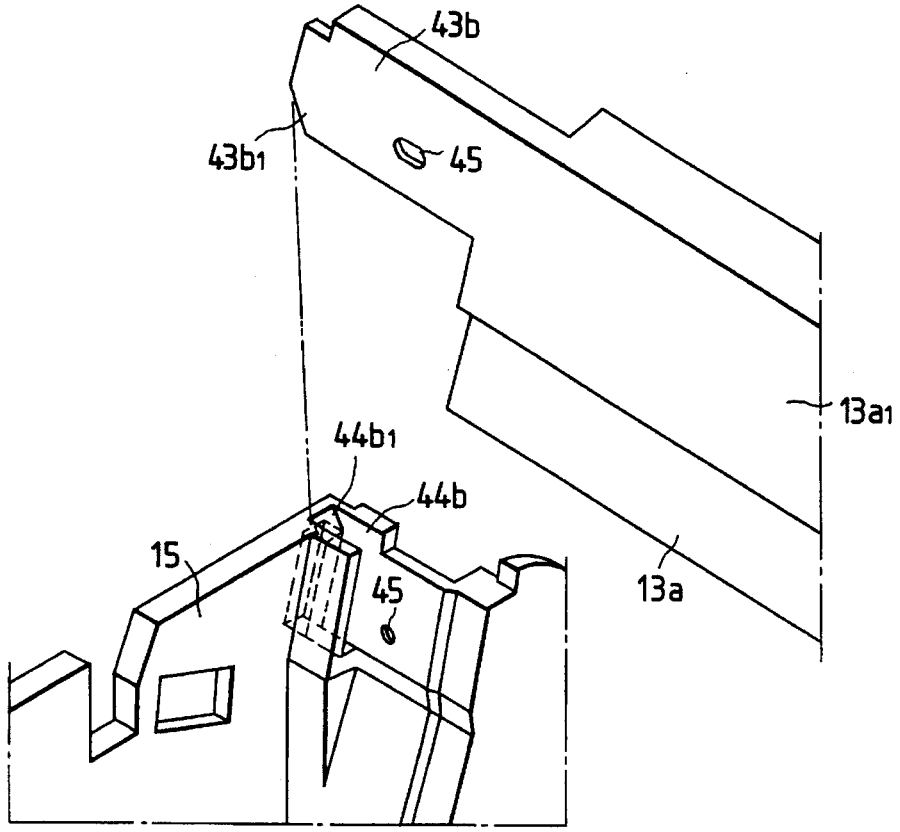
FIG. 61 is an exploded perspective view for explaining the attachment of the cleaning blade.
Figure 62:
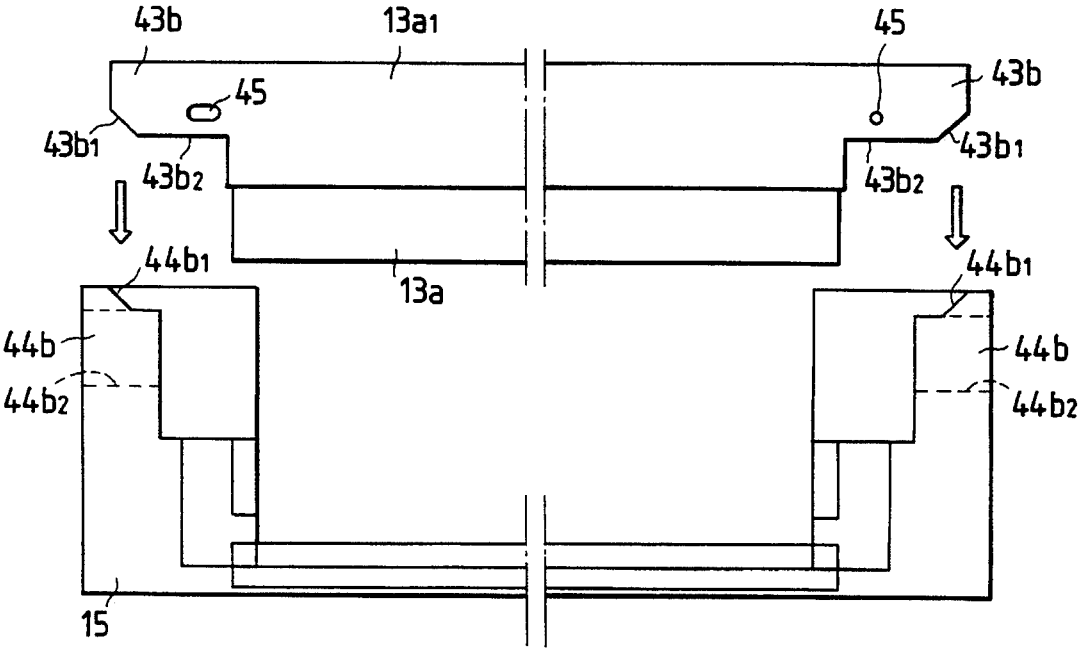
FIG. 62 is a partial plan view of the cleaning blade before attachment.
Figure 63:
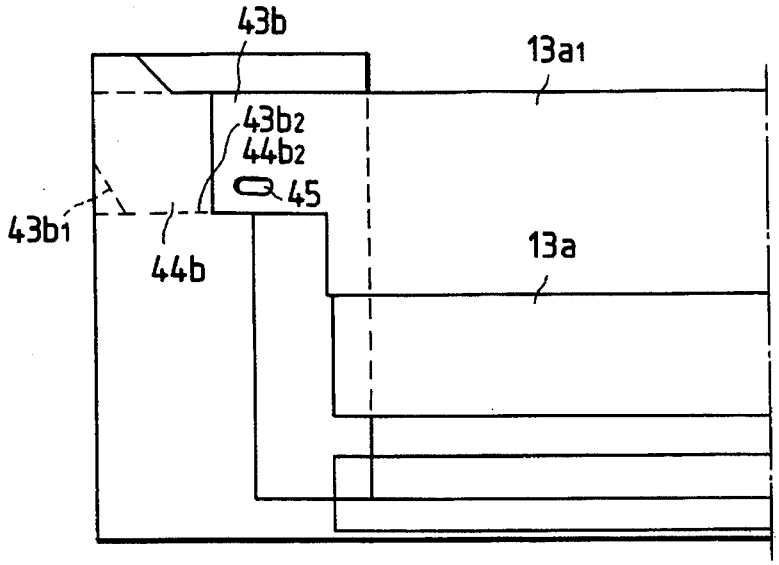
FIG. 63 is a partial plan view of the cleaning blade after attachment.

FIG. 61 is a perspective view showing a cleaning blade 13*a* and a fitting portion 44*b*, and FIGS. 62 and 63 are plan views thereof. As shown in FIGS. 61 to 63, a tapered portion 43b1 is formed by obliquely cutting a lower portion of a fitting projection 43*b* formed on a longitudinal end of the blade supporting member 13a1, and a tapered portion 44b1 is formed by obliquely cutting an upper portion of the fitting portion 44*b* of the body 16 of the image forming apparatus.

Thus, when the fitting projection **43*b* is being fitted into the fitting portion 44*b*, by engaging the tapered portions 43b1, 44b1 by each other, the projection 43*b* can smoothly be inserted into the fitting portion 44*b***.

Incidentally, as shown in FIG. 63, when the fitting projection **43*b* fitted into the fitting portion 44*b*, a lower end 43b2 of the projection 43*b* is abutted against a lower end 44b2 of the fitting portion 43*b*, thereby regulating an inserting amount of the cleaning blade 13*a*. Thus, when the tapered portion 43b1 is formed on the fitting projection 43*b*, it is preferable that the lower end 43b2** are left.

Figure 64:
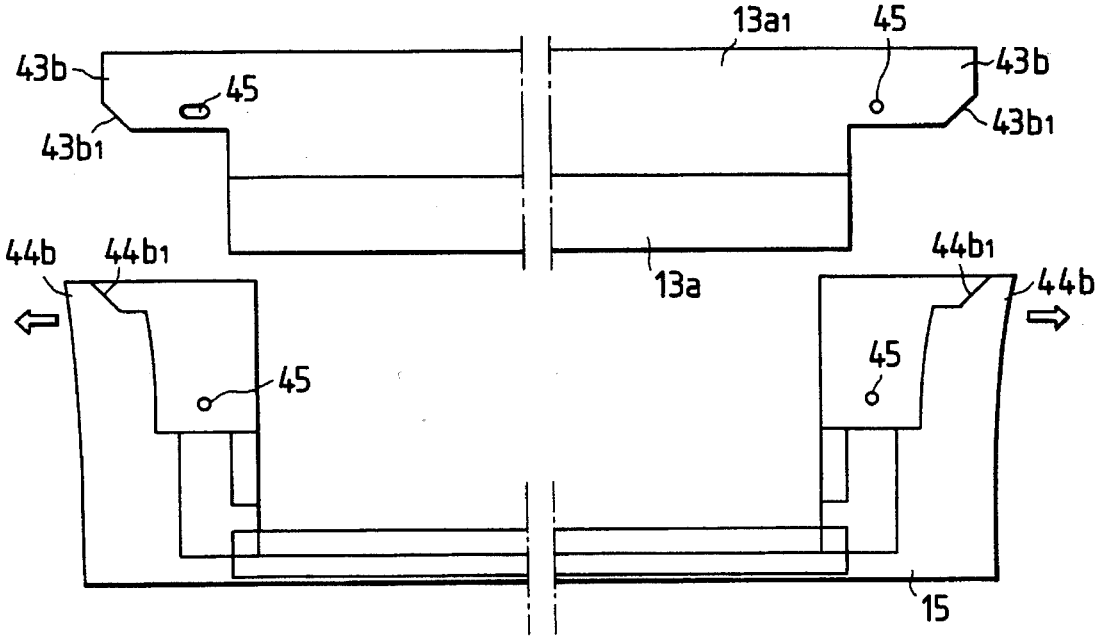
FIGS. 64, 65 and 66 are plan views for explaining the assembling of the cleaning blade.
Figure 65:
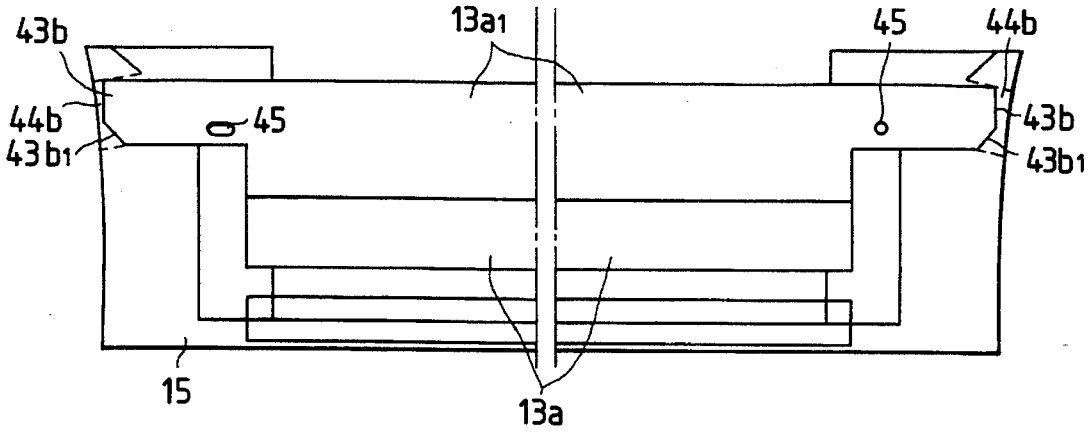
Figure 66:
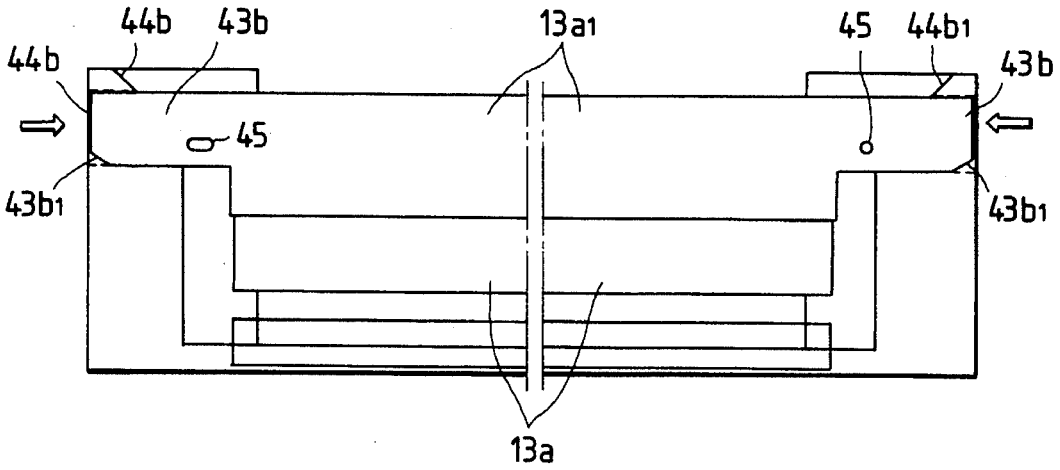

Further, although the fitting projection **43*b* is forcibly fitted into the fitting portion 44*b* as mentioned above when the blade supporting member 13a1 is fitted, in case of the automatic assembling operation, as shown in FIG. 64, the lower frame 15 is pulled by a suitable tool (not shown) in a direction shown by the arrow to elastically deform it so as to increase the distance between the fitting portions 44*b*, and then, as shown in FIG. 65, the blade supporting member 13a1 is fitted between the fitting portions 44*b*. In this case, as mentioned above, the fitting operation can be performed smoothly because of the existence of the tapered portions 43b1, 44b1. Then, when the tool is released, as shown in FIG. 66, the deformation of the lower frame 15 is elastically restored, thus fitting the fitting projections 43*b* into the fitting portions 44*b*. Further, the fitting portions 44b are pushed in directions shown by the arrows in FIG. 66, thereby interlocking the fitting projections 43*b* and the fitting portions 44*b*** without fail. In this way, the cleaning blade can easily be assembled.

Figure 67:
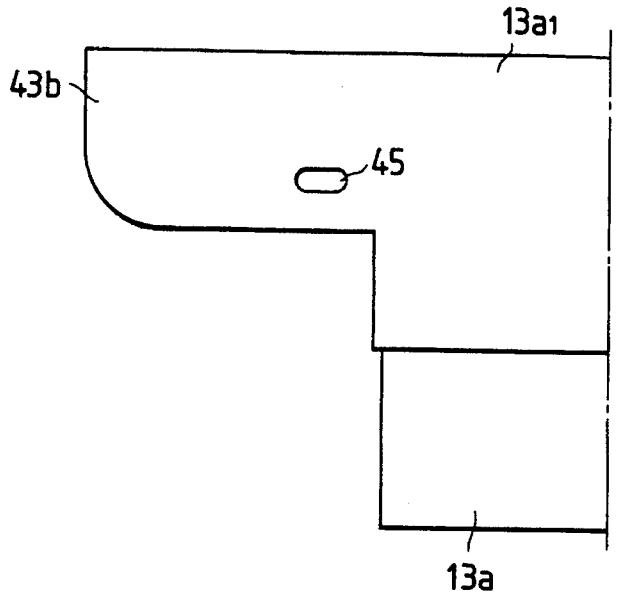
FIG. 67 is a partial plan view of a cleaning blade according to another embodiment wherein a fitting projection of the cleaning blade has a round end.

Further, in place of the inclined tapered portion 43b1 formed on the fitting projection **43*b*, as shown in FIG. 67**, the lower portion of the fitting projection may be rounded to have a certain curvature of radius. Also in this case, the same technical effect can be obtained.

Figure 68:
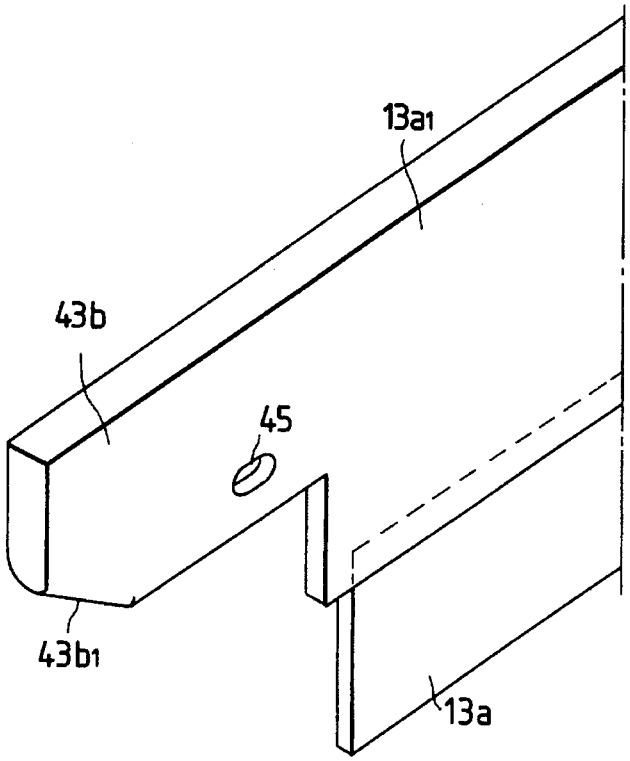
FIG. 68 is a partial perspective view of a cleaning blade according to a further embodiment wherein a fitting projection of the cleaning blade is rounded by chamferring a tapered portion thereof.

Further, as shown in FIG. 68, the tapered portion 43b1 formed on the fitting projection **43*b* may be rounded by chamferring a lower portion of the tapered portion 43b1. In this case, the fitting projection can be fitted into the fitting portion 44*b* more smoothly. Further, even if the tapered portion 43b1 is not formed, when the lower portion of the fitting projection 43*b*** is merely rounded as mentioned above, the fitting smoothness is improved to some extent.

Figure 69:
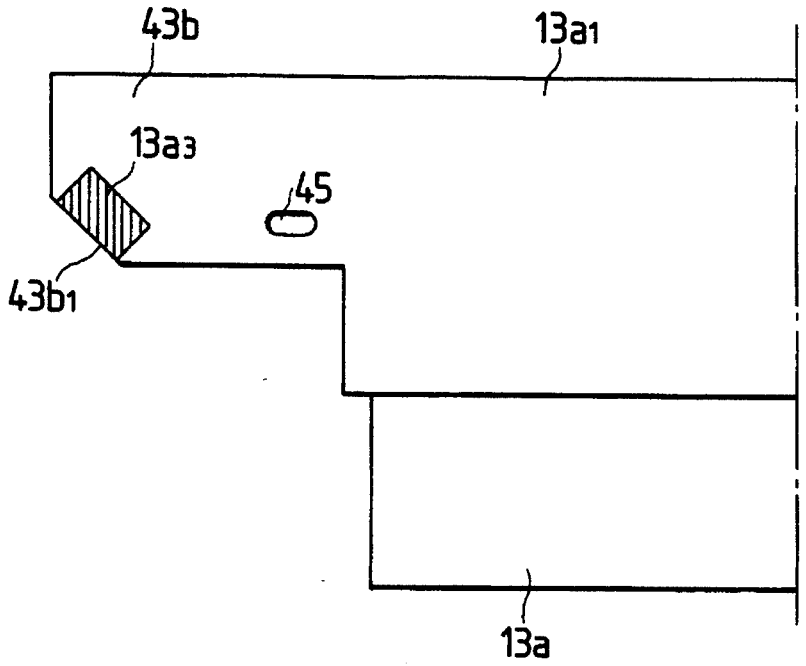
FIG. 69 is a partial plan view of a cleaning blade according to a still further embodiment wherein a tape is sticked to a tapered portion.
Figure 70:
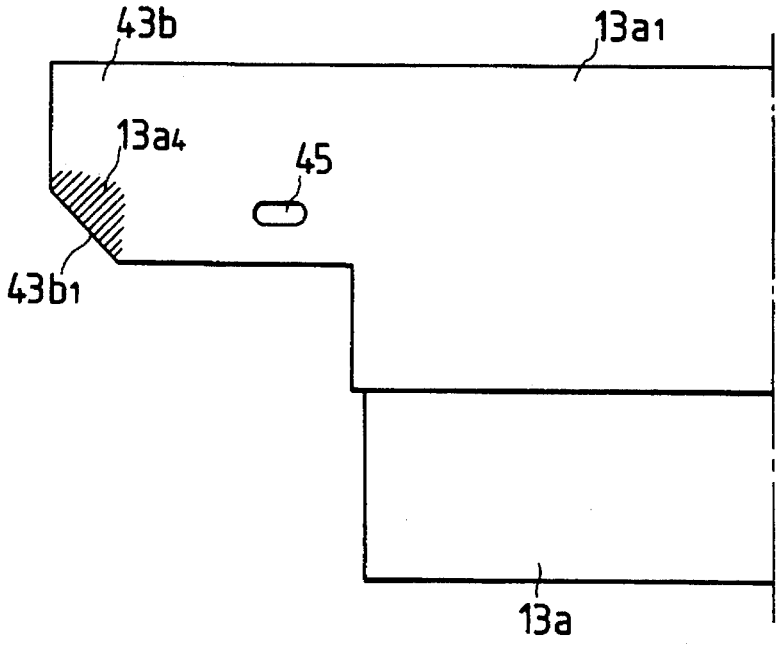
FIG. 70 is a partial plan view of a cleaning blade according to the other embodiment wherein oil is coated on a tapered portion.

In addition, FIG. 69 shows an embodiment wherein a PTFE tape 13a3 and the like is adhered to the tapered portion 43b1 of the blade supporting member 13a1, thereby permitting the smooth fitting of the projection into the fitting portion of the apparatus body. Furthermore, FIG. 70 shows another embodiment wherein lubricant 13a4 such as silicone oil, grease and the like is coated on the tapered portion 13b1 to lubricate the tapered portion, thereby improving the smooth fitting of the fitting projection into the fitting portion of the apparatus body.

Incidentally, when the tape 13a3 is adhered to the tapered portion or when the lubricant is coated on the tapered portion, although it is not necessary to form the tapered portion 43b1 in the fitting portion **43*b*, the tape or lubricant should not be provided on the lower end 43b2** which serves as the positioning reference, in order to maintain the attachment accuracy.

Further, a method for attaching the aforementioned blade will be explained with reference to FIGS. 64, 65 and 71A–75.

By the way, when the blade support member 13a1 is fitted, although the fitting projections **43*b* are forcibly fitted into the corresponding fitting portions 44*b* as mentioned above, as shown in FIGS. 64, 65 and 71A–75, automatic assembling may be effected by using tools 56, 57**.

Figure 71A:
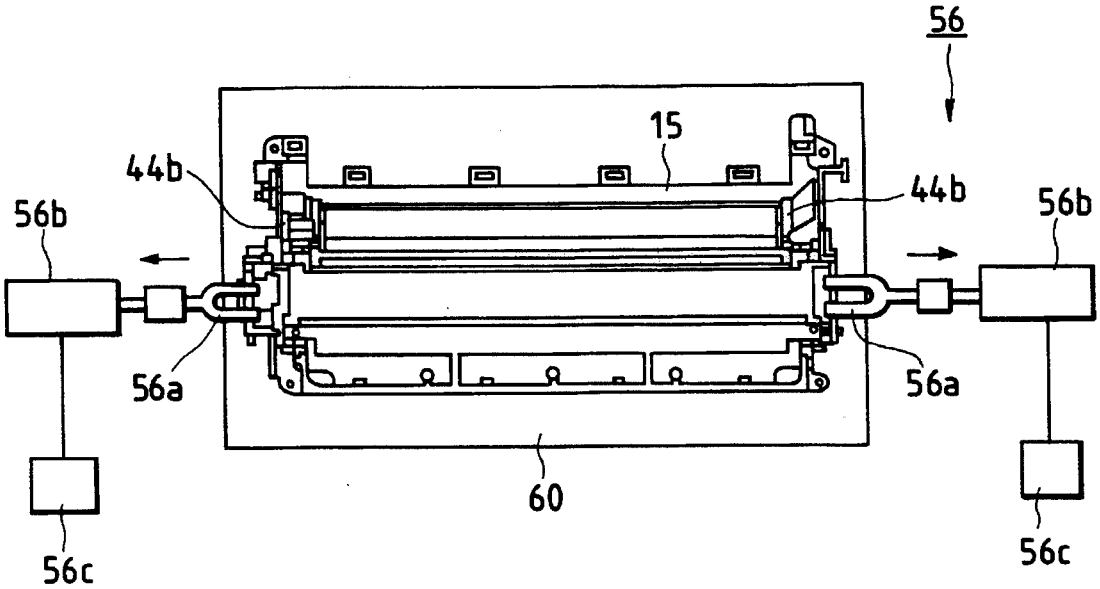
FIGS. 71A and 71B are explanatory views for showing a condition that fitting portions of a lower frame are widened by using a tool, in order to incorporate a cleaning blade therebetween.
Figure 71B:
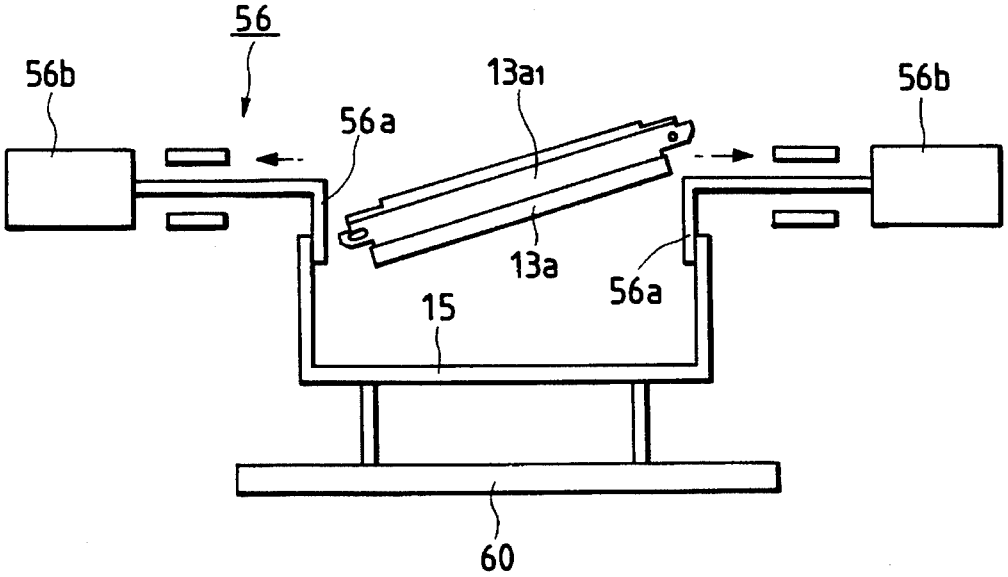

That is to say, as shown in a schematic plan view of FIG. 71A and a schematic front view of FIG. 71B, first of all, the lower frame 15 is rested on a cartridge supporting base 60, and hook portions **56*a* of tools 56 are locked on the blade fitting portions 44*b* which constitute a frame for supporting the blade support member 13a1. The hook portions 56*a* are connected to cylinders 56*b* which are in turn connected to pumps 56*c***.

After the hook portions **56*a* are locked on the blade fitting portions 44*b*, the pumps 56*c* are activated to generate a force of about 2–6 kgf for widening the distance between the opposed fitting portions 44*b*, thereby widening the distance between the opposed fitting portions 44*b* by about 0.5–2 mm. As a result, the distance between the fitting portions 44*b* is widened as shown in FIG. 64, so that the fitting projections 43*b* of the blade 13 can easily be inserted between the fitting portions 44*b* as shown in FIG. 65. Incidentally, in this case, the fitting operation is facilitated because of the presence of the aforementioned tapered portions 43b1, 44b1**.

Figure 72A:
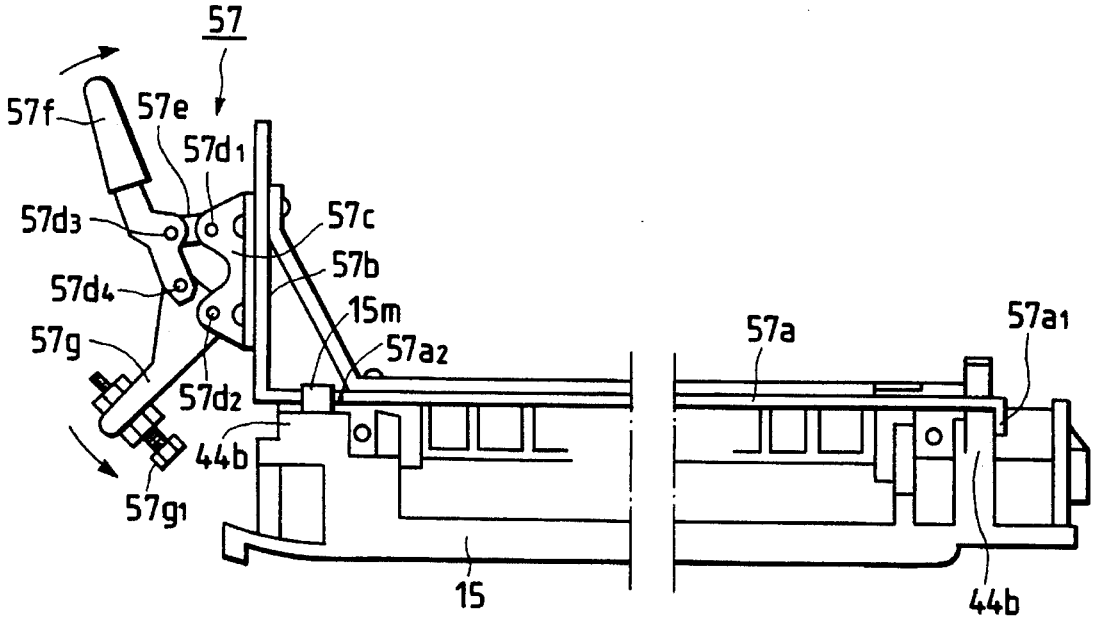
FIGS. 72A and 72B are explanatory views for showing a condition that the fitting portions of the lower frame are made narrower by using a tool.
Figure 72B:
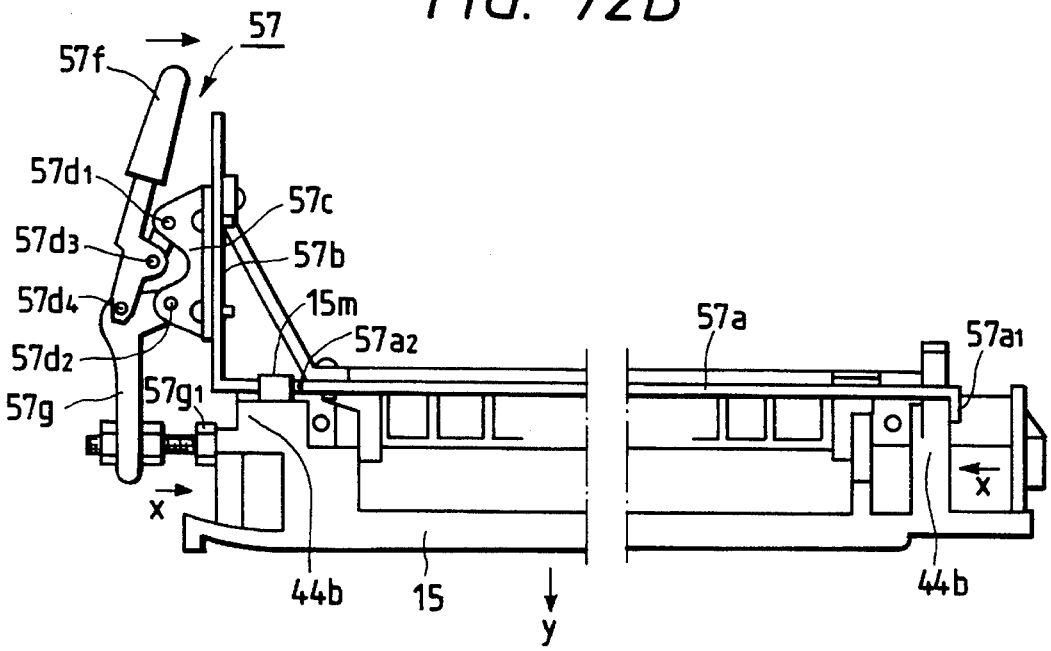

After the blade 13 is fitted, as shown in FIGS. 72A and 72B, by using a tool 57, a force for making the distance between the opposed fitting portions **44*b* narrower is generated. The tool 57 used in this embodiment comprises a toggle clamping tool which includes a plate member 57*a* having a locking hook portion 57a1 at its one end and an upright portion 57*b* at its other end, which upright portion has a fixed portion 57*c* secured thereto. An arm 57*e*, a handle 57*f* and an operation arm 57*g* are pivotally mounted on the fixed portion 57*c* via pivot pins 57d1, 57d2, 57d3, respectively. Now, the hook portion 57*a* is locked against an outer surface of one of the fitting portions 44*b* and a locking hole 57*a*2 formed in the plate member 57 at a predetermined position is engaged by a projection 15*m* of the lower frame 15. In this condition, when the handle 57*f* is rocked toward a direction shown by the arrow in FIG. 72A, the operation arm 57*g* is rotated, so that, as shown in FIG. 72B, an operation portion 57g1 urges the other fitting portion 44*b* in a direction shown by the arrow, thereby making the distance between the opposed fitting portions 44*b* narrower by the locking of the hook portion 57*a* and the urging of the operation portion 57g1. In this embodiment, by applying the force of about 1–4 kgf, the distance between the opposed fitting portions 44*b*** is made narrower by about 0.1–1.5 mm.

Figure 73:
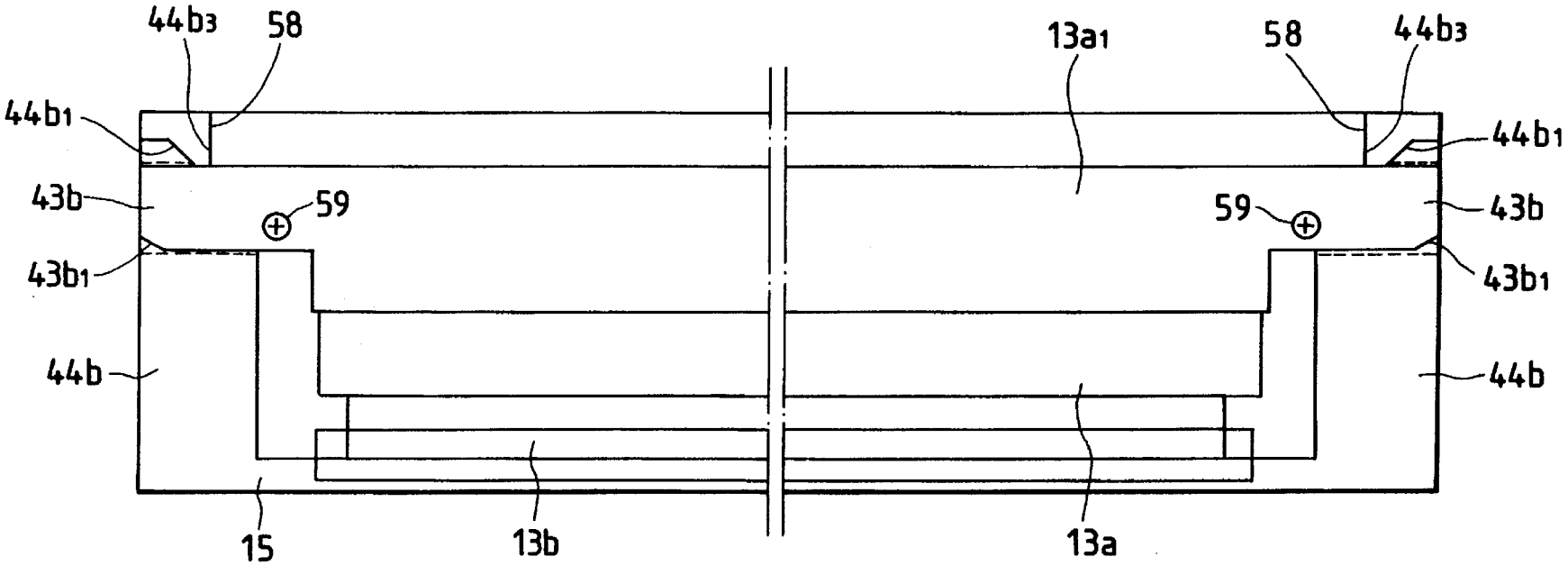
FIG. 73 is a view showing a condition that the fitting portions of the lower frame are abutted against both longitudinal ends of a blade support member for a cleaning blade.

In this way, as shown in FIG. 73, the abutment portions 44b3 of the fitting portions **44*b* are abutted against abutment portions 58 of the blade support member 13a1 (refer to a perspective view of the cleaning blade in FIG. 74), thereby maintaining the positional accuracy of the blade support member 13a1 to the lower frame 15. In this way, the fitting projections 43*b* are fitted into the fitting portions 44*b*. In this condition, when the blade 13*a* is secured by threading the screws 59 into the threaded holes 45, the blade 13*a*** is attached in place with high accuracy.

Incidentally, although the lower frame 15 made of plastic material is obtained by injecting synthetic resin into a mold and by picking up the molded part by decomposing the mold, it is feared that the fitting portions **44*b* are deformed to widen the distance therebetween due to the temperature of the mold and/or the temperature and pressure of the resin being injected. However, even when such deformation occurs, by urging the abutment portions 44b3 of the fitting portions 44*b* to abut them against the abutment portions 58 of the blade 13*a***, it is possible to correct such deformation, and, thus, to enhance the dimensional accuracy of the parts.

Therefore, the cleaning blade 13*a* attached to the lower frame 15 can be uniformly urged against the photosensitive drum 9 attached to the lower frame 15 along the whole longitudinal direction of the blade. Similarly, it is possible to accurately maintain the attaching position of the dip sheet 13*b* attached to the lower frame 15.

Further, when the lower frame 15 is subjected to the force for making the distance between the fitting portions 44*b* narrower from the direction X by the tool 57, it is subjected to a force by which the lower surface of the lower frame is deflected toward the outside of the cartridge (i.e., direction shown by the arrow Y). Accordingly, when the process cartridge B is gripped by the operator's hand as shown in FIG. 38, if the wall of the lower frame 15 is thin, the lower surface of the lower frame will easily be deflected inwardly, and, in an extreme case, the deflected lower frame will be contacted with the developing sleeve 12*d*, thus damaging the latter. However, by applying the force by which the lower surface of the lower frame is deflected toward the outside of the cartridge as mentioned above, it is possible to prevent the inward deflection of the lower frame 15. Accordingly, it is possible to reduce the thickness of the lower frame 15 and to arrange the developing sleeve 12*d* in the vicinity of the inner surface of the lower frame 15, thereby making the process cartridge B small-sized and light-weighted.

Figures 74, 75:
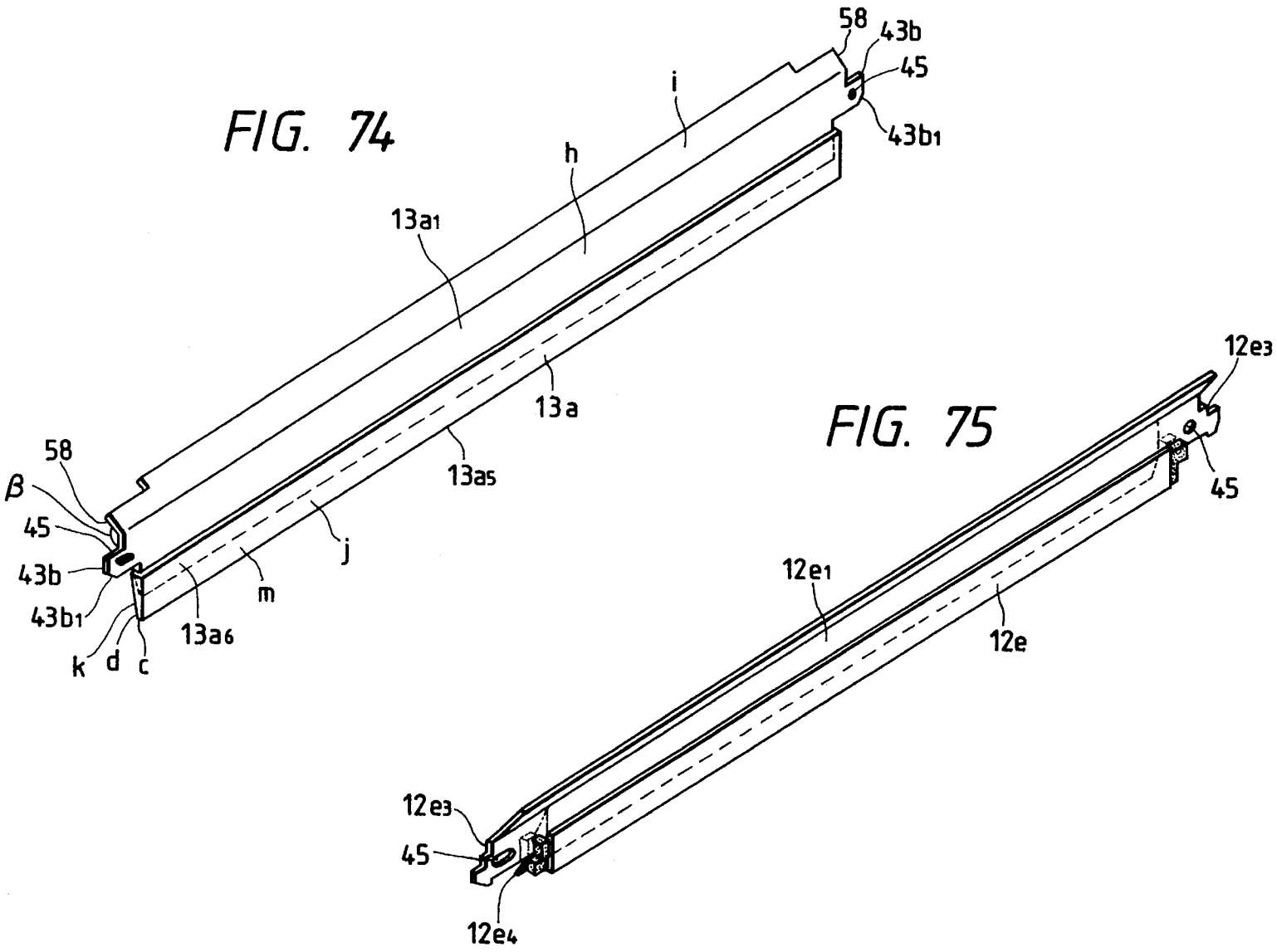
FIG. 74 is a perspective view of a cleaning blade.
FIG. 75 is a perspective view of a developing blade.

Incidentally, while an example that the cleaning blade 13*a* is attached was explained, the developing blade 12*e* may be attached similarly by using the tools 56, 57. In the case, when a developing sleeve 12*e* shown in FIG. 75 is attached, blade fitting portions formed on the lower frame are abutted against abutment portions 12e3 of a blade support member 12e1. Now, an L-shaped regulating plate 12e4 is attached to the blade support member 12e1. When the toner in the toner reservoir 12*a* is fed to the developing sleeve 12*d* or when the toner layer adhered to the developing sleeve 12*e* is rotated along with the rotation of the developing sleeve 12*d*, the toner is prevented from entering into a space (refer to FIG. 4) defined between the outer wall of the toner reservoir 12*a* and the developing blade support member, by the regulating plate 12e4.

As mentioned above, the cleaning blade 13*a* is attached to the lower frame 15, and then the developing blade 12*e* is attached to the lower frame. Then, the developing sleeve 12*d* is attached to the lower frame, and the photosensitive drum 9 is lastly attached to the lower frame.

In this way, in order to abut the fitting portions of the lower frame against both longitudinal ends of the blade support members 13a1, 12e1 of the cleaning blade 13*a* and the developing blade 12*e* by reducing the distance between the fitting portions by using the tool 57, it is preferable that the rigidity of the fitting portions is greater than the rigidity of the blade support members. To this end, in the illustrated embodiment, the lower frame 15 may be made of plastic and the blade support members 13a1, 12e1 may be formed from metal (for example, iron or the like) plates. Incidentally, the lower frame 15 is preferably made of polystyrene, acrylonitrile butadiene styrene, polyphenylene oxide, polyphenylene ether or the like.

Further, in the illustrated embodiment, while the elastic blades made of urethane rubber are used as the blades 13*a*, 12*e*, when these blades 13*a*, 12*e* are made of material having the greater rigidity (such as metal), the fitting portions of the lower frame may be abutted against the blades 13*a*, 12*e* directly, instead of the blade support members.

In the illustrated embodiment, the frame is swelled outwardly by applying to the frame the force for reducing the distance between the opposed frames after the blade support member is locked to the locking portions. Thus, even when the wall of the frame is thin, it is difficult to deflect the frame even if the frame if gripped by the operator's hand, thus preventing the frame from contacting with the developing sleeve, for example.

Further, when the force for reducing the distance between the opposed frames is applied, by abutting both longitudinal ends of the blade support member against the opposed frames, even if the frames are deflected, it is possible to easily maintain the attaching position of the blade with high accuracy.

Method for attaching the cleaning blade 13*a* and the developing blade 12*e* will be further described with reference to FIGS. 76A to 81. Incidentally, in various embodiments described hereinbelow, since a method for attaching the cleaning blade 13*a* is the same as a method for attaching the developing blade 12*e*, only the method for attaching the developing blade 12*e* will be explained.

As shown in FIGS. 76A to 81, protruded portions 62n1 are formed on both longitudinal ends of the developing blade 12*e*, and a tapered portion 62n2 extending inwardly and downwardly is formed on a lower portion of each protruded portion 62n1.

On the other hand, blade supporting portions 66, 67 are formed on the housing. The supporting portions 66, 67 are formed from elastically deformable material so that the supporting portions can be elastically deformed in directions shown by the arrows B. Further, the supporting portions 66, 67 are hollow and are provided at their lower ends with reference surfaces 66*a*, 67*a* and have hold-down portions 66*b*, 67*b* at their upper ends. Incidentally, the supporting portions 66, 67 are spaced apart from each other by a distance corresponding to a longitudinal length of the blade 12*e*, and a distance between the reference surfaces 66*a*, 66*b* and the hold-down portions 66*b*, 67*b* is slightly smaller than a width (dimension in an up-and-down direction) of the protruded portion 62n1.

Figure 76A:
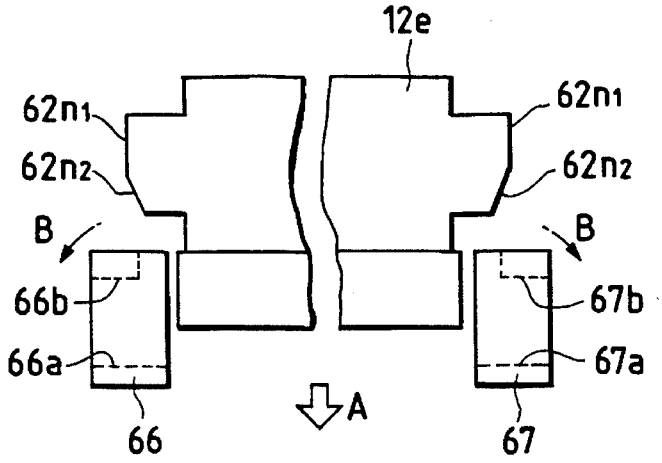
FIGS. 76A to 76D are views for explaining a manner that a developing blade is attached.
Figure 76B:
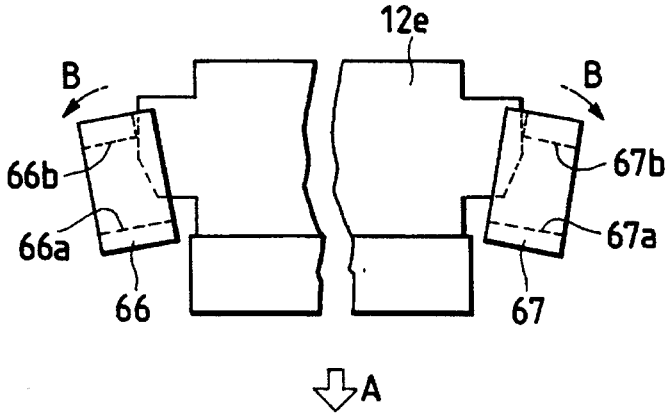
Figure 76C:
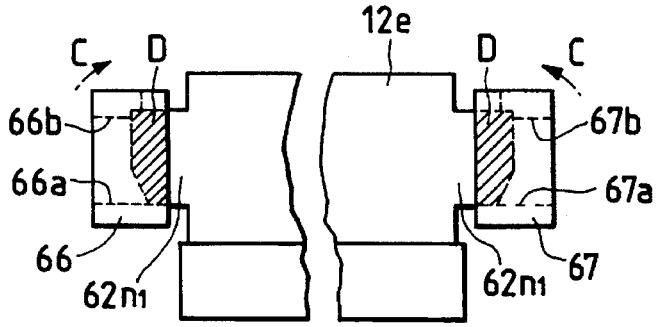
Figure 76D:
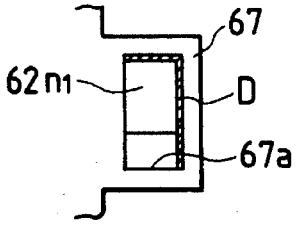

Accordingly, as shown in FIG. 76B, when the blade 12*e* is forcibly inserted toward a direction A, the tapered portions 62n1 are abutted against the hold-down portions 66*b*, 67*b*, thus elastically deforming the blade supporting portions 66, 67 toward the directions B. In a condition that the lower ends of the protruded portions 62n1 are abutted against the reference surfaces 66*a*, 67*a*, when the blade supporting portions 66, 67 are urged from the outside toward directions C as shown in FIG. 76C, the upper ends of the protruded portions 62n1 are press-fitted into the hold-down portions 66*b*, 67*b* (fitted areas D are shown by hatched zones in FIGS. 76C and 76D) and are secured, thereby attaching the blade 12*e* surely.

In this way, the blade 12*e* can easily be attached only by forcibly inserting the blade 12*e* while elastically deforming the blade supporting portions 66, 67. Further, since there is no need to secure the blade by screws, it is possible to reduce the number of parts, thus achieving the cost-down.

Figure 77A:
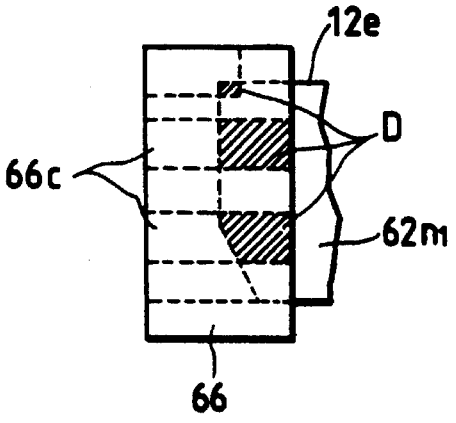
FIGS. 77A and 77B are views showing an embodiment wherein fitting margins are provided in a developing blade supporting portion.
Figure 77B:
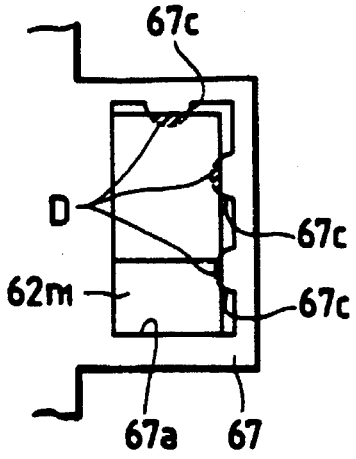

A further embodiment is shown in FIGS. 77A and 77B. In this embodiment, fitting margins 66*c*, 67*c* are provided on the inner surfaces of the blade supporting portions 66, 67 (in the illustrated embodiment, three fitting margins are provided). In this embodiment, when the blade 12*e* is attached, the protruded portions 62n1 are fitted into the blade supporting portions while cutting off the fitting margins 66*c*, 67*c*. The fitting margins 66*c*, 67*c* may be provided at a single position or at a plurality of positions in dependence upon the size of the protruded portions 62n1 of the blade. With this arrangement, it is possible to reduce the fitting force when the blade 12*e* is attached, thus improving the operability and the assembling ability.

Figure 78A:
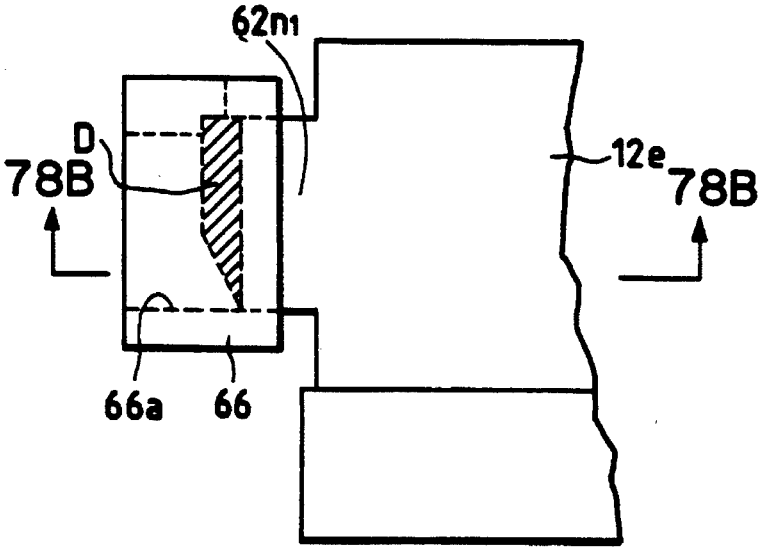
FIGS. 78A and 78B are views showing an embodiment wherein a developing blade supporting portion is tapered.
Figure 78B:
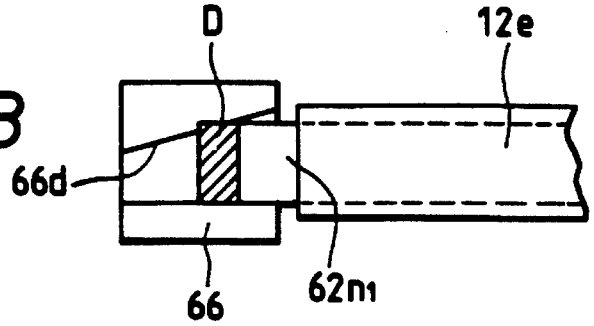

In the aforementioned embodiment, while the fitting margins are provided on the blade supporting portions 66, 67 in order to reduce the fitting force for the blade 12*e*, a further embodiment is shown in FIGS. 78A and 78B. Incidentally, FIG. 78A is a plan view, and FIG. 78B is a sectional view taken along the line J—J in FIG. 78A.

In this embodiment, tapered portions 66*d*, 67*d* (portions 67*d* are not shown) are formed on the blade supporting portions 66, 67. The tapered portions 66*d*, 67*d* define passages in the blade supporting portions 66, 67. Each passage has an inlet opening having a width greater than that of the protruded portion 62n1 of the blade and an outlet opening having a width smaller than that of the protruded portion, and the width of the passage is gradually decreased from the inlet opening to the outlet opening.

With this arrangement, when the blade 12*e* is attached to the blade supporting portions, the protruded portions 62n1 can easily be inserted into the tapered portions 66*d*, 67*d*, and the fitting force can be smaller than that in the previous embodiment.

Figure 79A:
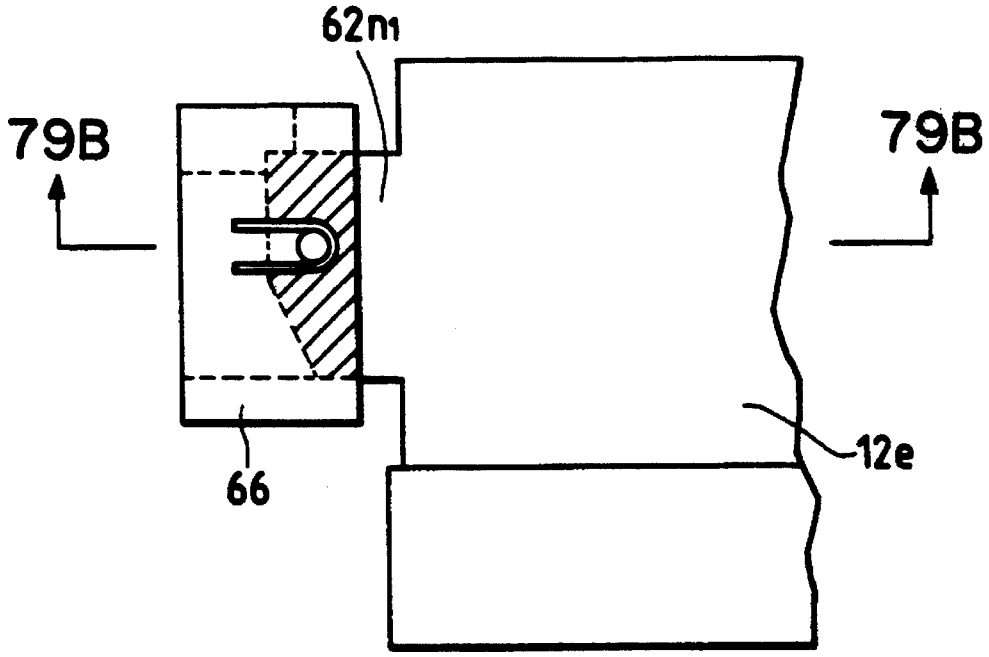
FIGS. 79A and 79B are views for explaining a manner that a protruded portion of a developing blade is fitted and supported.
Figure 79B:
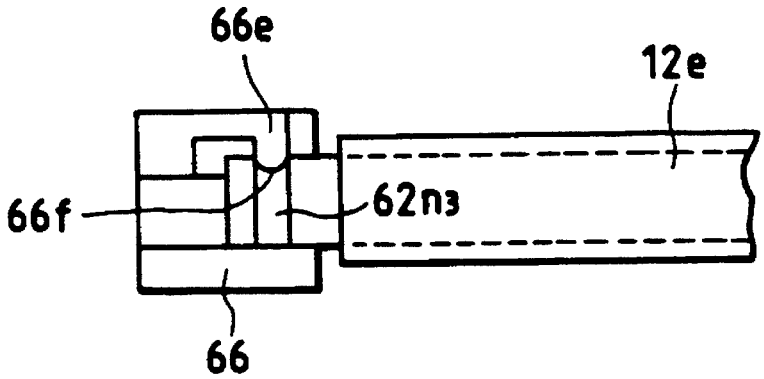

A still further embodiment is shown in FIGS. 79A and 79B. Incidentally, FIG. 79A is a plan view, and FIG. 79B is a sectional view taken along the line K—K in FIG. 78A. Further, in these Figures, only the blade supporting portion 66 is illustrated.

In this embodiment, a fitting bore 62n3 is formed in each protruded portion 62n1, and hinge portions 66*e*, 67*e* having projections 66*f*, 67*f* are formed on the blade supporting portions 66, 67 (67 is not shown). When the protruded portions 62n1 of the blade are inserted into the blade supporting portions 66, 67, the hinge portions 66*e*, 67*e* are elastically deformed so that the projections 66*f*, 67*f* formed on the ends of the hinge portions are fitted into the corresponding fitting holes 62n3.

With this arrangement, it is possible to reduce the fitting force when the blade 12*e* is attached and secured, and to ascertain the positioning of the blade 12*e* when it is inserted into the supporting portions. Accordingly, the assembling ability is further improved. Incidentally, as in the aforementioned embodiment, when the arrangement wherein the blade is fitted into the blade supporting portions while cutting off the latter is also used in this embodiment, the blade can be secured more surely.

Figure 80:
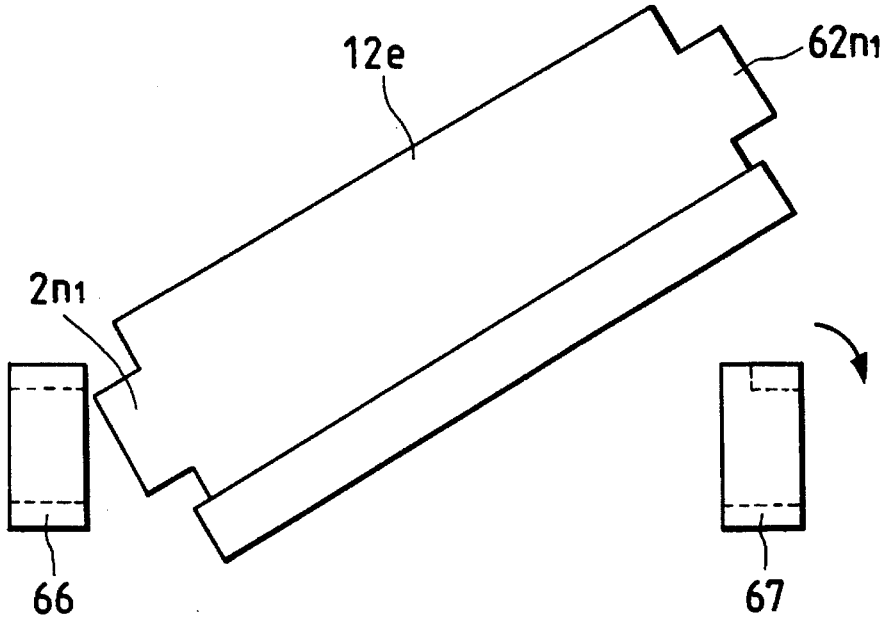
FIG. 80 is a view showing an embodiment wherein only one end of a developing blade is fitted into a blade supporting portion.
Figure 81:
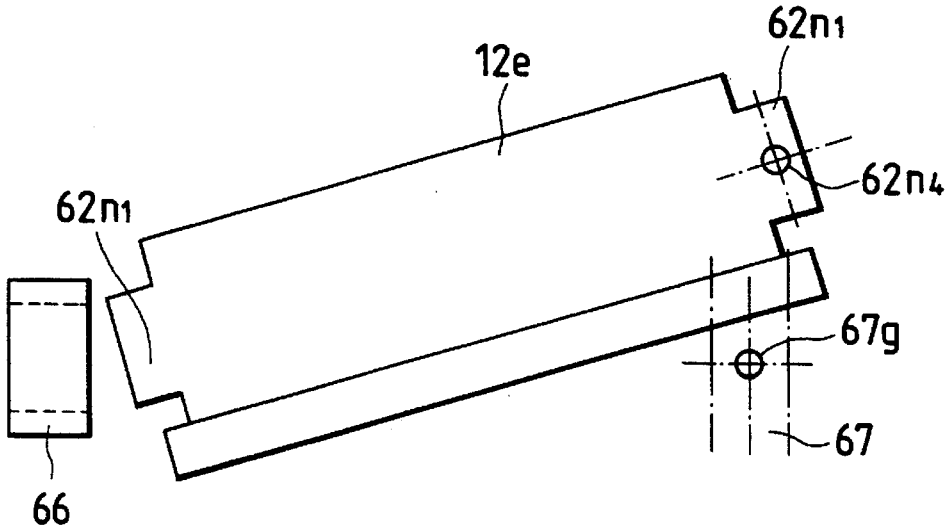
FIG. 81 is a view showing an embodiment wherein only one end of a developing blade is secured by a screw.

Further embodiments are shown in FIGS. 80 and 81. In an embodiment shown in FIG. 80, one of the protruded portions 62n1 is fitted into the blade supporting portion 66 and is supported by it, and the other protruded portion 62n1 is press-fitted into the blade supporting portion 67 while elastically deforming the supporting portion 67 in a direction shown by the arrow. With this arrangement, since the inner surface of only one of the blade supporting portions is required to be cut off when the protruded portions 62n1 of the blade are press-fitted, the assembling ability is still improved.

In an embodiment shown in FIG. 81, one of the protruded portions 62n1 of the blade is fitted into the blade supporting portion 66 and is supported by it. A threaded hole 62n4 is formed in the other protruded portion 62n1. By aligning the threaded hole 62n4 with a threaded hole 67*g* formed in the blade supporting portion 67 and by threading a screw into these aligned holes 62n4, 67*g*, the other protruded portion 62n1 is secured to and supported by the blade supporting portion 67. With this arrangement, unlike the conventional cases, since only one side of the blade is secured by the screw, it is possible to reduce the number of parts and to improve the assembling operability.

In the aforementioned embodiments, while an example that the cleaning means having the blade 13*a* attached thereto or the developing means having the blade 12*e* attached thereto is integrally incorporated into the cartridge together with the photosensitive drum was explained, the blade attaching techniques shown in the above-mentioned embodiments can be applied to an image forming apparatus wherein a photosensitive drum, cleaning device or developing device is attached to a frame of the apparatus.

In the above-mentioned embodiments, while an example that both of the developing blade 12*e* and the cleaning blade 13*a* are attached in the same manner is explained, even when either the blade 12*e* or the blade 13*a* is attached in the manner shown in one of the above-mentioned embodiments, the assembling ability is improved in comparison with the conventional cases.

Next, the cleaning blade 13*a* and the blade support member 13a1 will be further fully described with reference to FIGS. 82 to 88.

Figure 83:
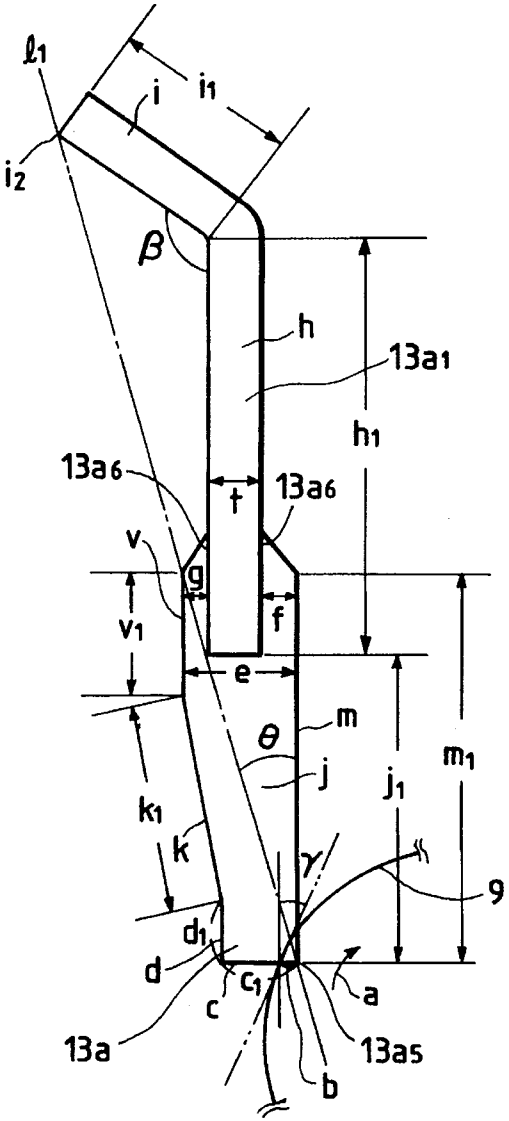
FIG. 83 is a side view of the blade support member and the cleaning blade of FIG. 82.
Figure 82:
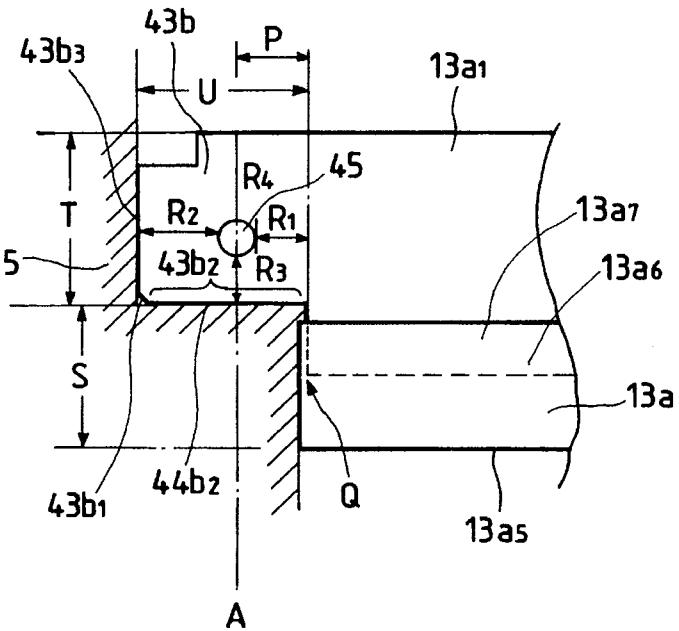
FIG. 82 is a plan view of a cleaning blade and a blade support member integrally formed therewith.

FIG. 82 is a partial plan view of the integrally formed blade support member 13a1 and cleaning blade 13*a*, and FIG. 83 is a side view thereof. As mentioned above, the cleaning blade 13*a* is made of polyurethane rubber having the hardness of 60°–73° and preferably 62°–68° (JIS A-hardness). Further, the blade support member 13a1 is formed from a cold rolled steel plate (SECC) having a flatness of 0.08 or less and a thickness of 1.0 mm–1.6 mm (preferably, 1.2 mm in consideration of the strength and the bending accuracy).

Incidentally, the support member 13a1 has a bending angle $\beta$ which has a relation $90° \leqq \beta \leqq 165°$ (FIG. 83). The blade 13*a* and the support member 13a1 are integrally interconnected via an adhesive 13a6. In this case, an edge portion 13a5 of the polyurethane rubber 13*a* is cut off by a cutter (not shown) to obtain the smoothness. Further, as mentioned above, the support member 13a1 according to this embodiment has a projection 43*b* as a protruded portion protruding longitudinally from a supporting portion 13a7 for supporting the polyurethane rubber blade 13*a*, and a lower end 43b2 of the projection is substantially parallel with the edge portion 13a5 of the blade 13*a*.

When the support member 13a1 is attached to a frame 15*a*, the edge portion 13a5 of the blade 13*a* is correctly positioned by abutting the lower end 43b2 against a lower end 44b2 of the frame 15*a*, so that the edge portion 13a5 can be uniformly abutted against the peripheral surface of the photosensitive drum 9. Further, a threaded hole 45 as an attaching hole is formed in the blade support member 13a1. The support member 13a1 is secured to the frame 15*a* by a screw 59 threaded into the threaded hole 45. Incidentally, the support member may be secured to the frame 15*a* by inserting a projection (same material as the frame 15*a*) formed on the frame into the hole 45 and then by heat-caulking the projection.

In this embodiment, the attaching hole 45 is formed in the protruded portion 43. That is to say, a center of the hole 45 is positioned at a location spaced apart longitudinally outwardly from a side edge Q of the supporting portion 13a7 of the support member 13a1 by a distance P, and a radius r of the attaching hole 45 is set to be smaller than the distance P ($r<P$).

More particularly, as an example, a diameter of the hole 45 was about 3.2 mm (r = about 1.6 mm) (Incidentally, in this embodiment, a most preferable example was shown when the blade support member is secured by the screw 59 (FIG. 73) having a diameter of 2.6 mm, but the diameter of the hole may be 2.7 mm–3.6 mm), the distance P was about 3.8 mm, the thickness of the steel plate was about 1.2 mm, and the blade 13*a* was formed from polyurethane rubber having a thickness of about 1.7 mm and a hardness of 65° ± 3°. Further, the following dimensions were used: (i) S = about 13.0 mm, (ii) T = about 9.7 mm, (iii) U = about 10.2 mm, (iv) R1 = about 2.2 mm, (v) R2 = about 4.8 mm, (vi) R3 = about 2.0 mm, and (vii) R4 = about 4.5 mm.

Where, S is a distance between the lower end 43b2 of the blade support member 13a1 and the edge portion 13a5 of the blade 13*a*, and T is a distance between the lower end 43b2 and a bent portion i.

In this way, by arranging the whole area of the hole 45 in the protruded portion 43*b*, in other words, by particularly providing areas R1, R2, R3 around the hole 45, the following advantages can be obtained:

(i) By providing the area R1, when the hole 45 is secured by the screw of heat-caulking, although the steel plate is distorted more or less by the tightening torque or heat, such distortion does not have an influence on the edge portion 13a5 of the blade, thereby maintaining the adequate cleaning ability; and (ii) By providing the areas R2, R3, when the hole 45 is formed, although the steel plate is distorted more or less, such distortion does not have an influence on the lower end 43b2 and the side end 43b3 which are used to position the attaching position, and thus, since the support member 13a1 can be correctly attached to the frame 15*a* at a predetermined position, it is possible to maintain adequate cleaning ability.

Incidentally, in the above description, while an example that a round or cylindrical hole is used as the attaching hole was explained, it is preferable that the same relationship should be satisfied even when an elongated slot hole is used (refer to FIGS. 63 to 70 and 74). Thus, as in the case of the support member according to this embodiment, when a round hole is formed in one end portion and an elongated hole is formed in the other end portion, if the round hole formed in one end portion satisfies the above relationship, the same advantage as mentioned above will be obtained. Incidentally, in this embodiment, a longitudinal dimension of the elongated hole is about 4.5 mm, and a widthwise dimension of the elongated hole is about 3.2 mm.

Furthermore, in this embodiment, the elongated hole is arranged to satisfy the relationship same as that of the round hole, and the whole area of the elongated hole is disposed in the protruded portion which has a length of about 9 mm–10 mm.

Figure 84:
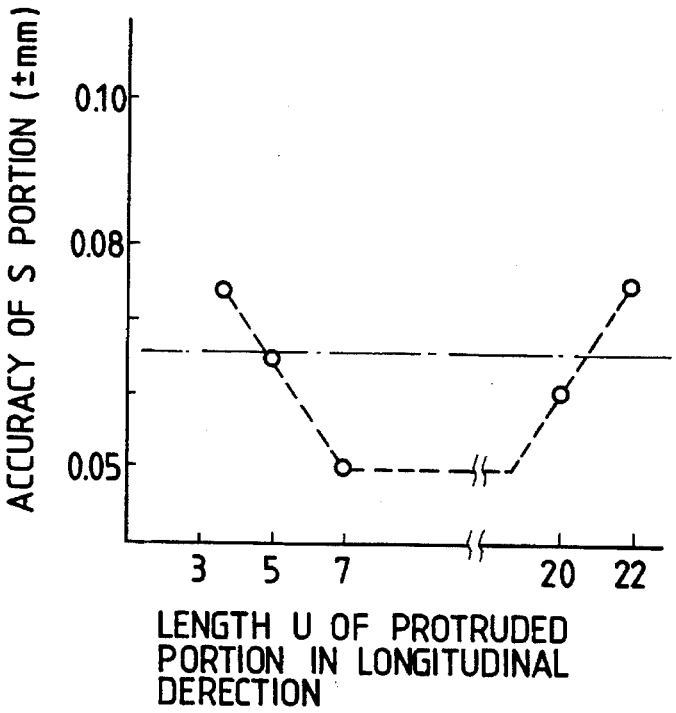
FIG. 84 is a graph showing a relation between a length of a protruded portion of the blade support member in a longitudinal direction and a length from a lower end of the protruded portion to a leading end of the blade.

Further, regarding the above-mentioned arrangement, a plurality of samples wherein the protruded portions 43*b* have various lengths within a range of 4 mm–22 mm were manufactured, and the attaching accuracy of the portion S was measured when each sample was attached to the frame 15*a*. The result is shown in FIG. 84. An area below the dot and chain line shown in FIG. 84 is a region within which the attaching accuracy that does not cause any problem in the practical use can be obtained. Thus, it was found that, when the length (U) of the protruded portion 43*b* was in a range of 5 mm–20 mm, the adequate attaching accuracy could be obtained.

It seems that, if the length (U) of the protruded portion 43*b* is smaller than 5 mm, a length of the lower end 43b2 as the positioning reference will become too small, with the result that the positioning accuracy regarding the frame 15*a* cannot be obtained sufficiently when the blade support member is attached to the frame 15, and that, if the length (U) of the protruded portion 43*b* is greater than 20 mm, the length of the lower end 43b2 will become too great, with the result that the straightness of the lower end 43b2 cannot be obtained sufficiently when the blade support member 13a1 is manufactured.

Now, the relation regarding the thickness and angle between the support member 13a1 and the blade 13*a* will be explained with reference to FIGS. 83 to 88.

First of all, sizes of various portions of the integrally formed support member 13a1 and blade 13*a* will be explained with reference to FIG. 83. Incidentally, FIG. 83 is a schematic side view, wherein the support member 13a1 and the blade 13*a* are illustrated in an enlarged scale with respect to the photosensitive drum 9 for clarify's sake:

| | |
|---|---|
| (i) Bending angle (β) of support member 13al | about 115 degrees; |
| (ii) Length (h1) of vertical portion h of support member 13al | about 15.5 mm; |
| (iii) Length (i1) of bent portion i of support member 13al | about 7.5 mm; |
| (iv) Thickness (t) of support member 13al | about 1.2 mm; |
| (v) Imaginary entry amount (b) of blade 13a with respect to photosensitive drum 9 | about 0.7–1.3 mm; |
| (vi) Width (c1) of tip end surface c of blade 13a (thickness of tip end of blade) | about 1.7 mm; |
| (vii) Length (d1) of vertical surface d of blade 13a | about 1.5 mm; |
| (viii) Length (k1) of inclined surface k of blade 13a | about 5.0 mm; |
| (ix) Length (v1) of root flat surface v of blade 13a | about 2.0 mm; |
| (x) Length (m1) of flat surface (abutment surface) m of blade 13a | about 9.5 mm; |
| (xi) Length (j1) of free end from tip end surface c of blade 13a to tip end of support member 13al | about 7.5 mm; |
| (xii) Thickness (e) of root of blade 13a | about 2.6 mm; |
| (xiii) Thickness (f) at one side of engagement portion of blade 13a against support member 13al | about 0.8 mm; |
| (xiv) Thickness (g) at the other side of engagement portion of blade 13a against support member 13al | about 0.6 mm; |
| (xv) Set abutment angle (a) of blade 13a against photosensitive drum 9 (angle between flat surface m of blade 13a and tangential line on photosensitive drum at point where blade 13a is contacted with | about 23–25 degrees; |

-continued

| | | |
|---|---|---|
| | photosensitive drum) | |
| (xvi) | Angle (θ) between flat surface (abutment surface) m and a straight line l1 connecting between edge portion 13a5 of blade 13a abutted against photosensitive drum 9 and rear end i2 of bent portion i of support member 13al | about 18 degrees; |
| (xvii) | Length of blade 13a in longitudinal direction | about 240 mm. |

First of all, the angle θ between the flat surface m and the straight line l1 (dot and chain line in FIG. 83) connecting between the edge portion 13a5 (apex between the front end surface c and the flat surface m of the elastic blade **13*a*) and the rear end i2 of the bent portion i of the support member 13a1**, according to the illustrated embodiment, will be explained. As mentioned above, in this embodiment, the angle θ was selected to about 18 degrees.

This angle θ will be explained. First of all, in order to perform the cleaning of the toner having small particles effectively, it is considered that the abutment pressure of the blade **13*a* against the photosensitive drum 9 may be increased. It means that the imaginary entry amount b (FIG. 83) of the edge portion 13a5 of the blade 13*a* regarding the photosensitive drum 9 is increased. When the abutment pressure is increased, the friction force F between the surface of the blade 13*a* and the surface of the photosensitive drum 9 is also increased. Thus, the blade 13*a* performing the cleaning of the toner while repeating the minute "stick-slip" in response to the rotation of the drum 9 increases the vibration of the tip end of blade due to the stick-slip, with the result that the support member 13a1 itself is vibrated. Accordingly, in the conventional case, the vibration of the tip end of the blade was enhanced by the vibration of the support member 13a1, thereby generating the undesirable noise (for example, at the angle θ less than 16 degrees, the undesirable noise occurred frequently). Incidentally, in this case, the angle β generally becomes 90° plus set abutment angle γ of the blade 13*a*** (i.e., γ>90°).

Therefore, in order to solve the above problem, the inventors paid attention to a relation between the abutment pressure of the blade **13*a* and the strength of the steel plate. First of all, the length of the free end j of the blade 13*a* is set to have a value of about 6 mm–9 mm in consideration of a relation between the abutment pressure and a space in which the cleaning device is installed. Now, in this condition, the inventors paid attention to the angle θ and test was effected. As a result, it was found that, when the angle θ was set greater than 18°, even if the abutment pressure was set to the required value, the support member 13a1** itself was not vibrated, thus preventing the undesirable noise. This will be further explained hereinbelow.

When it is assumed that the length j1 of the free end j of the blade **13*a* is substantially constant, the strength of the support member 13a1 (steel plate) is determined by a ratio between the length h1 of the vertical portion h and the length i1 of the bent portion i. Thus, in the illustrated embodiment, in consideration of the slight variation of the length j1 of the free end, such relation is defined by the angle θ between the flat surface (abutment surface) m of the blade 13*a* and the straight line connecting between the edge portion 13a5 of the blade and the rear end i2 of the bent portion of the support member 13a1**.

Now, in order to set the angle θ greater than 18°, it is considered that the angle β is decreased, or the bent portion i is lengthened and at the same time the vertical portion h is shortened. In any cases, it is possible to increase the strength of the support member 13a1 itself. Accordingly, in the illustrated embodiment, even if the stick-slip at the tip end of the blade is increased by increasing the abutment pressure of the blade, since the strength of the support member 13a1 was increased, it is possible to positively suppress the vibration. Thus, the vibration of the support member 13a1 does not occur and the undesirable noise is prevented. Now, it is not necessary that the angle θ is preferable as it becomes greater. That is, the greater the angle θ (for example, the longer the bent portion i) the greater the size of the cleaning blade as a single part, and, thus, the greater the cleaning device itself. To avoid this, in the illustrated embodiment, an upper limit of the angle θ is set or defined to achieve the compactness of the cleaning blade as the single part, and, thus, the cleaning device itself.

Considering the strength of the support member 13a1, it is preferable that the lengths of the vertical portion h and the bent portion i satisfy the following relation:

$$f>n\cdot g\ (n\geqq 0.38).$$

By satisfying this relation, the satisfied strength causing less vibration can be obtained. In this case, preferably, by selecting the value n to have a relation n<1, the cleaning device is prevented to become larger than necessary. Further, so long as the above relation f>n·g is satisfied, the thickness f can be reduced as the thickness g is decreased. Accordingly, both of the thickness f and the thickness g of the support member 13a1 can be reduced. Therefore, the flatness can be further improved. Thus, the blade **13*a*** can be set with high accuracy and the compactness of the cleaning device can be achieved.

Explaining in detail, it is preferable that the vertical portion h of the support member 13a1 and the free end j of the blade **13*a*** satisfy the following relation:

$$2\leqq h\leqq 2.2\ j.$$

Now, the reason why the vertical portion h is regulated more than 2 is the fact that the adhesion width 13a6 of at least 2 mm is required between the support member 13a1 and the blade **13*a*** (in consideration of the peeling strength) regardless of the length of the free end j, and the reason why the vertical portion h is regulated less than 2.2 j is the fact that, if the value h is more than 2.2 j, the flatness will be worsened extremely.

When the above conditions or relations are satisfied, the cleaning blade **13*a* and the support member 13a1 which are small-sized and light-weighted can be obtained. Further, even when the abutment pressure between the blade 13*a* and the photosensitive drum 9** is increased, the undesirable noise can be prevented, and the good cleaning can be achieved even in case of the toner having small diameter particles.

The test result will be described hereinbelow. The length j1 of the free end was set to 7.5 mm, the length h1 of the vertical portion was set to 15.5 mm, the length i1 of the bent portion was set to 7.5 mm, the bending angle β was set to 115 degrees and the angle θ was set to 18 degrees to satisfy the above-mentioned relations. In this condition, the cleaning blade comprising the integrally formed blade 13*a* and support member 13a1 was abutted against the photosensitive drum 9 with an abutment pressure greater than the normal abutment pressure, and the endurance test (wherein 4000 copies were to be obtained) was effected by using the above-mentioned apparatus with toner having small diameter particles under the normal environmental condition. As a result, it was found that there was no undesirable noise from the beginning to the end and the good cleaning ability was ascertained.

To the contrary, when the length i1 of the bent portion i is set to 5.5 mm, the angle θ becomes 15 degrees. By using a cleaning blade having such relation, the same test was effected. As a result, it was found that the undesirable noise was continued to occur from the beginning to several hundred copies.

Normally, the lubricant such as carbon fluoride was applied to the tip end of the blade. Nevertheless, the undesirable noise was generated. However, after several hundred copies, the undesirable noise was disappeared. This means that a large amount of toner is accumulated on the blade edge portion 13a5, thereby increasing the lubricating ability.

Further, in order to increase the strength of the support member 13a1, it is also considered that the thickness of the support member 13a1 itself is increased. However, if the thickness of the support member 13a1 is increased to 15 mm, for example, the flatness of the support member will be worsened during the manufacture of the support member.

Incidentally, in the above description, while an example that, in case of the toner having the small diameter particles, the undesirable noise is generated when the abutment pressure is increased to increase the friction force F was explained, the present invention is not limited to use the toner having the small diameter particles. For example, the friction force F greatly depends upon the coefficient of friction between the photosensitive drum and the abutment surface of the blade, and the matching of materials. Accordingly, it is feared that, in the cleaning of the toner having normal diameter particles, the undesirable noise is generated even when the normal abutment pressure (low abutment pressure) is used. Also in this case, by satisfying the aforementioned conditions according to the present invention, it is possible to prevent the undesirable noise.

As mentioned above, by selecting the angle θ (between the abutment surface of the blade, and the straight line connecting between the rear end of the bent portion of the support member and the edge portion of the blade contacting with the photosensitive drum) to 18°–22°, it is possible to increase the strength of the support member without making the support member large-sized, and to prevent the undesirable noise.

Next, the thickness of the blade 13*a* will be explained with reference to FIGS. 83 and 85 to 88.

In this embodiment, the thickness of the blade 13*a* at various locations satisfies the following relations:

$$c1<e<2c1,\ f>g,\ \text{and}\ c1>d1.$$

Where,

- c1: Width of the end surface c of the blade 13*a* (thickness of the tip end of the blade 13*a*);
- e: Thickness of the root of the blade 13*a;*
- d1: Length of the vertical portion d of the blade 13*a;*
- f: Thickness of the engagement portion (at the side of the flat surface m) of the blade 13*a* against the support member 13a1; and
- g: Thickness of the engagement portion (at the side of the inclined surface k) of the blade 13*a* against the support member 13a1.

Incidentally, the conventional integrally formed support member and blade generally had the following relations:

$$c1<d1,\ g>f,\ \text{and}\ 2c1<e.$$

The above relations according to this embodiment will be explained in order. First of all, by satisfying the relation c1<e, the concentration of stress at a portion of the blade 13*a* is prevented, and the permanent deformation is suppressed to the utmost. Further, by satisfying the relations e≦2cl and f>g, the hardened contraction of rubber is suppressed to the utmost, thereby maintaining the parallelism of the edge portion 13a5 in the longitudinal direction accurately to the utmost. In this way, the parallelism of the edge portion can be improved. Further, even if only the parallelism is improved, the cleaning of the toner having the small diameter particles will be insufficient, so that the toner having particles smaller than the average particle diameter cannot sometimes be cleaned. Thus, in this embodiment, in order to improve the cleaning ability, regarding the abutment pressure of the blade 13*a* against the photosensitive drum 9, the relation c1>d1 is satisfied as mentioned above. In this way, the rigidity of the blade 13*a* is improved and increased. That is to say, the tip end of the blade 13*a* is prevented from shifting in the rotation direction of the photosensitive drum 9, thus preventing the so-called "turn-up" of the blade. This seems that the rigidity of the blade 13*a* in the longitudinal direction can be increased by designing the end portion of the blade to have the relation c1>d1.

Now, the so-called "turn-up" phenomenon of the blade will be explained with reference to FIG. 85.

Figure 85:
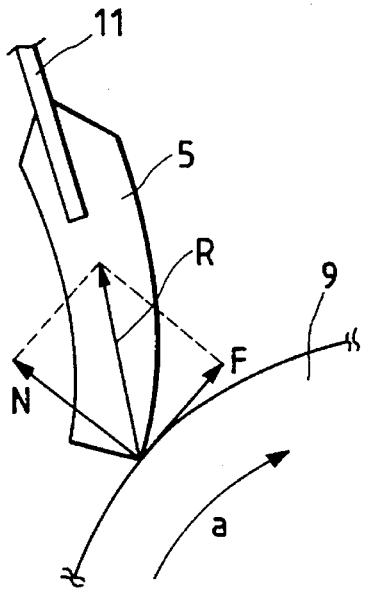
FIG. 85 is a schematic view showing a force acting on the blade.

As shown in FIG. 85, the blade 13*a* is subjected to a normal (vertical) drag N from the photosensitive drum 9, a friction force F between the drum 9 and the blade 13*a*, and a resultant drag force R resulting from the drag N and the friction force F. Thus, when the abutment pressure is increased, the normal drag N is increased and the friction force F is more increased, with the result that the tip end of the blade 13*a* is shifted in the rotation direction of the drum 9, thus causing the so-called "turn-up" phenomenon. However, in this embodiment, as mentioned above, since the rigidity of the blade 13*a* is increased, the "turn-up" phenomenon can be prevented.

Further, in this embodiment, with the arrangement as mentioned above, the permanent deformation amount can be reduced. This will be explained hereinbelow.

Figures 86, 87:
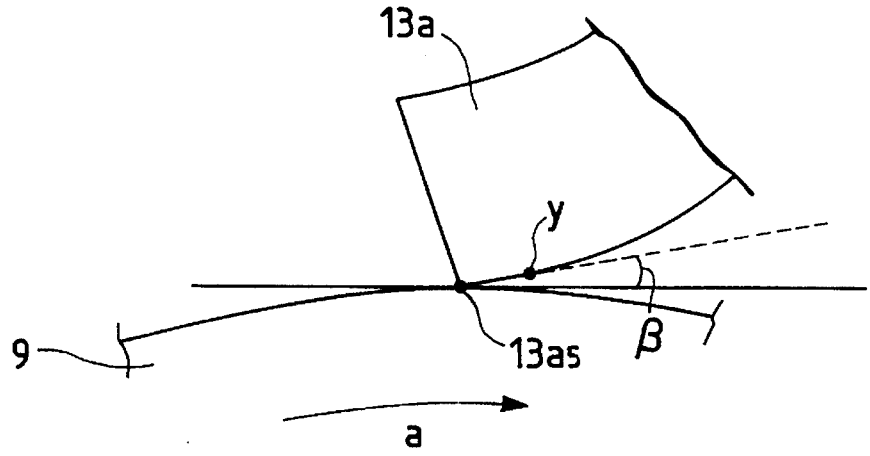
FIG. 86 is a table showing an amount of the permanent deformation.
FIG. 87 is a schematic view showing an abutment angle.

A table shown in FIG. 86 indicates the relationship between the entry amount b of the blade and the permanent deformation amount, regarding the above-mentioned conventional blade and the blade according to the aforementioned embodiment of the present invention. That is to say, the table shows the result of test wherein, after the blades 13*a* were abutted against the photosensitive drum 9 with the entry amounts of 0.8 mm and 1.1 mm, respectively, for 5 hours at a temperature of 45° C. (for promotion), the permanent deformation amounts of the blades 13*a* were measured. As apparent from the table, in the conventional blade, the percentage of the permanent deformation was about 10%. To the contrary, in the blade according to the above-mentioned embodiment of the present invention, the percentage of the permanent deformation was reduced to about 5%. The reason seems that, according to this embodiment of the present invention, the rigidity of the end portion of the blade is increased (due to c1>d1) and the elasticity of the blade at the side of the flat surface (abutment surface) m abutted against the support member 13a1 is increased (due to f>g).

Incidentally, in the blade configuration, the length d1 of the vertical surface d must be at least 1 mm, because, after the blade is molded with rubber, the end portion of the blade should be cut to form the edge portion 13a5 with high accuracy. That is to say, when the blade is cut, since a cutter is moved from the side of the abutment surface of the blade in the longitudinal direction while holding the vertical portion d, the vertical portion of at least 1 mm must be maintained as the held portion. If the cutting portion cannot be held directly, it is feared that the edge portion 13a5 cannot be cut with high accuracy.

Further, when it is desired to further reduce the permanent deformation amount, the thickness of the whole blade may be increased in accordance with the above-mentioned relations. Since the percentage of the permanent deformation is determined by the configuration of the blade, if the entry amount b is small, when the abutment pressure is increased, the permanent deformation amount can be further reduced.

Next, the abut angle in accordance with the above-mentioned embodiment will be explained.

Now, as a factor required to stably maintain the high cleaning ability, there is the abut angle at the tip end of the blade, as well as the aforementioned factors. As shown in FIG. 87, the abutment angle is defined as an angle β between a tangential line at a contacting point between the edge portion 13a5 of the blade and the surface of the photosensitive drum 9, and a straight line connecting between a point y spaced apart from the contacting point 13a5 by 0.5 mm along the blade abutment surface m and the contacting point 13a5. That is to say, the abut angle is an angle of the blade abutting against the photosensitive drum 9. Incidentally, the abutment angle was determined by actually abutting the blade 13*a* against the photosensitive drum 9 with a certain entry amount and by visually measuring an abutment angle with the aid of a microscope.

Figure 88:
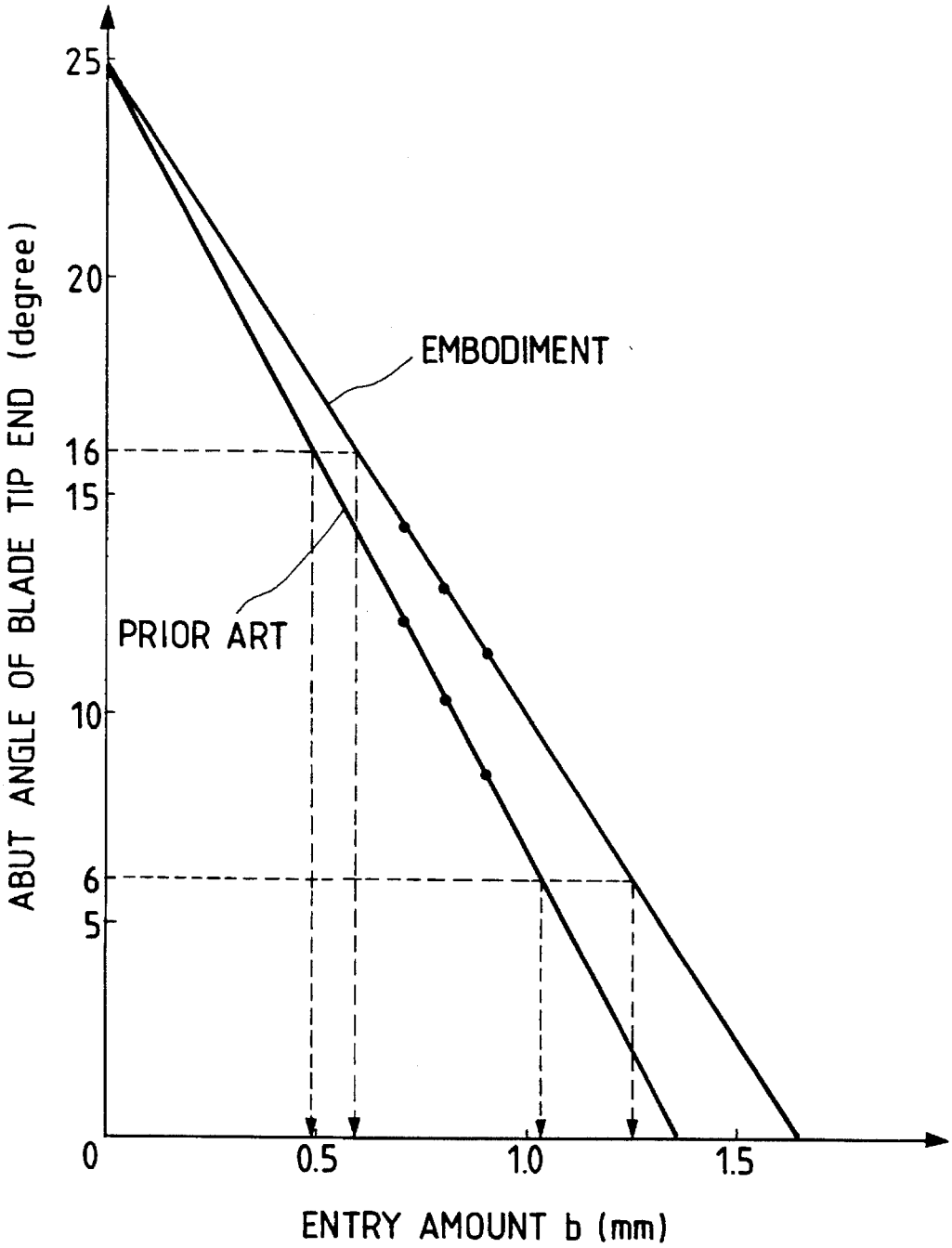
FIG. 88 is a graph showing a relation between the abut angle and the entry amount.

Now, regarding the above-mentioned conventional blade configuration and the above-mentioned blade configuration according to the present invention, a relation between the abut angle of the edge portion of the blade and the blade entry amount b is shown in FIG. 88. According to the inventors' investigation, it was found that a range of the abut angle β for stably maintaining the cleaning ability was $6° \leqq \beta \leqq 16°$. Further, in consideration of various vibrations, the eccentricity of the photosensitive drum 9 and the like, the range of the abut angle is preferably $8° \leqq \beta \leqq 14°$. In consideration of the above, comparing the conventional blade configuration with the blade configuration according to this embodiment of the present invention, it is apparent that the abut acceptable range of the blade according to this embodiment is wider than that of the conventional blade in reference to the entry amount b. For example, as shown in FIG. 88, in order to keep the abutment angle of the blade tip end within the range of 6°–16°, it is apparent that, in the conventional blade, the blade entry amount must be 0.5–1.03 mm (0.53 mm in range). To the contrary, in the blade according to this embodiment, the entray amount may be 0.6–1.26 mm (0.66 mm in range). Thus, setting range for the entry amount can be widened. Accordingly, even when the range for the entry amount b is set wider, the assembling ability can be improved and the total cost can be reduced. Further, when the range for the entry amount b is set narrower as in the conventional case, the range of the abutment angle of the blade end tip can be made narrower, thus maintaining the good cleaning ability stably for a long time and improving the reliability.

Incidentally, after the blade shown in FIGS. 82 and 83 was incorporated into the above-mentioned process cartridge B and 4000 copies were obtained by the image forming apparatus A using such process cartridge under the normal environmental condition, it was found that the good cleaning ability could be maintained without damaging the photosensitive drum.

Further, in the aforementioned embodiments, in case of the toner having the small diameter particles, while an example that the friction force is increased by increasing the abutment angle of the blade was explained, the present invention is not limited to the toner having the small diameter particles, but may be applied to any cases so long as the above-mentioned relations or conditions are satisfied regardless of the particle diameter of the toner, because it is apparent that the advantages of the present invention as mentioned above can be achieved so long as the above relations are satisfied.

As mentioned above, according to the cleaning blades and the blade support members in accordance with the aforementioned embodiments, it is possible to provide a blade member which can be made small-sized, can improve the positioning accuracy when it is attached to the process cartridge or to the cleaning device, can reduce the permanent deformation amount after attachment, can prevent the turn-up, can prevent the undesirable noise and can maintain good performance for a long time.

What is claimed is:

1. A blade member, mountable onto an electrophotographic image forming apparatus, for removing residual matter from an electrophotographic photosensitive member, comprising:

an elastic blade, one side surface of which is flat in a longitudinal direction thereof and the other side surface of which has a vertical portion perpendicular to an end surface of said elastic blade, and an inclined portion inclined with respect to said vertical portion, said inclined portion having a larger thickness than said vertical portion; and a support member for supporting said elastic blade;

wherein a thickness (f) of a portion of said elastic blade which is engaged by said support member at a side of said one side surface is greater than a thickness (g) of a portion of said elastic blade which is engaged by said support member at a side of said other side surface.

2. A blade member according to claim 1, wherein said elastic blade is made of polyurethane rubber.

3. A blade member according to claim 1, wherein said support member is formed from a cold rolled steel plate.

4. A blade member according to claim 1, wherein said elastic blade is adhered to said support member by adhesive.

5. A blade member, mountable onto an electrophotographic image forming apparatus, for removing residual matter from an electrophotographic photosensitive member, comprising:

an elastic blade, one side surface of which is flat in a longitudinal direction and the other side surface of which has a vertical portion perpendicular to an end surface of said elastic blade, and an inclined portion inclined with respect to said vertical portion; and a support member for supporting said elastic blade and having a supporting portion for supporting said elastic blade, a protruded portion protruding from said supporting portion in a longitudinal direction thereof, and a hole formed in said protruded portion;

wherein a length of said protruded portion in said longitudinal direction is more than 5 mm and less than 20 mm; and wherein a thickness of a portion of said elastic blade which is engaged by said support member at a side of said one side surface is greater than that of a portion of said elastic blade at a side of said other side surface.

6. A blade member, mountable onto an electrophotographic image forming apparatus, for removing residual matter from an electrophotographic photo sensitive member, comprising:

an elastic blade, one side surface of which is flat in a longitudinal direction and the other side surface of which has a vertical portion perpendicular to an end surface of said elastic blade, and an inclined portion inclined with respect to said vertical portion; and a support member for supporting said elastic blade;

wherein a thickness of a portion of said elastic blade which is engaged by said support member at a side of said one side surface is greater than that of a portion of said elastic blade at a side of said other side surface; and wherein a thickness of a portion of said elastic blade which is engaged by said support member is greater than a thickness of a tip end of said elastic blade by twice or less.

7. A blade member, mountable onto an electrophotographic image forming apparatus, for removing residual matter from an electrophotographic photosensitive member, comprising:

an elastic blade, one side surface of which is flat in a longitudinal direction and the other side surface of which has a vertical portion perpendicular to an end surface of said elastic blade, and an inclined portion inclined with respect to said vertical portion; and a support member for supporting said elastic blade and having a bent portion at its rear end;

wherein an angle between the flat surface of said elastic blade, and a straight line connecting the rear end of said support member to an apex between said end surface and said flat surface is more than 18 degrees and less than 22 degrees; and wherein a thickness of a portion of said elastic blade which is engaged by said support member at a side of said one side surface is greater than that of a portion of said elastic blade at a side of said other side surface.

8. A blade member according to claim 1, wherein a width of said end surface is greater than a length of said vertical portion.

9. A blade member according to claim 1, the length of said vertical portion is more than 1 mm.

10. A blade member according to claim 5, wherein said elastic blade is made of polyurethane rubber.

11. A blade member according to claim 5, wherein said support member is formed from a cold rolled steel plate.

12. A blade member according to claim 5, wherein said protruded portion is provided on a longitudinal end of said supporting portion on both ends of said support member, and a single hole is formed in said supporting portion.

13. A blade member according to claim 5, wherein said elastic blade is adhered to said support member by adhesive.

14. A blade member according to claim 5, wherein, when said blade member is attached to a member to which the blade member is attached, said protruded portion is locked on said member to which the blade member is attached.

15. A blade member according to claim 5, wherein the hole is round.

16. A blade member according to claim 5, wherein the hole is an elongated slot.

17. A blade member according to claim 5, wherein the hole is one of a round hole and an elongated slot.

18. A blade member according to claim 5, wherein a round hole is formed in said protruded portion provided on a longitudinal end of said supporting portion on one end of said support member, and an elongated slot is formed in said protruded portion provided on a longitudinal end of said supporting portion on the other end of said support member.

19. A blade member according to claim 18, wherein the round hole has a diameter of about 3.2 mm.

20. A blade member according to claim 5, wherein a width of said end surface is greater than a length of said vertical portion.

21. A blade member according to claim 20, wherein the length of said vertical portion is more than 1 mm.

22. A blade member according to claim 6, wherein a width of said end surface is greater than a length of said vertical portion.

23. A blade member according to claim 22, wherein the length of said vertical portion is more than 1 mm.

24. A blade member according to claim 6, wherein said elastic blade is made of polyurethane rubber.

25. A blade member according to claim 6, wherein said support member is formed from a cold rolled steel plate.

26. A blade member according to claim 6, wherein said elastic blade is adhered to said support member by adhesive.

27. A blade member according to claim 7, wherein said elastic blade is made of polyurethane rubber.

28. A blade member according to claim 7, wherein said support member is formed from a cold rolled steel plate.

29. A blade member according to claim 7, wherein said elastic blade is adhered to said support member by adhesive.

30. A blade member according to claim 7, wherein a width of said end surface is greater than a length of said vertical portion.

31. A blade member according to claim 30, the length of said vertical portion is more than 1 mm.

* * * * *

UNITED STATES PATENT AND TRADEMARK OFFICE

CERTIFICATE OF CORRECTION

PATENT NO. : 5,470,635 Page 1 of 7

DATED : November 28, 1995

INVENTOR(S) : Hiroyuki SHIRAI, et al.

It is certified that error appears in the above-indentified patent and that said Letters Patent is hereby corrected as shown below:

SHEET 57:

Fig. 84, "DERECTION" should read --DIRECTION--.

COLUMN 1:

Line 27, "cannot" should read --can--;
Line 28, "inconvenience" should read --inconvenienced--;
Line 50, "view point" should read --viewpoint--; and,
Line 59, "recycle" should read --recycling--.

COLUMN 3:

Line 43, "sticked" should read --adhered--.

COLUMN 4:

Line 55, "view a" should read --view of a--; and
Line 62, "54an" should read --54 is an--.

COLUMN 5:

Line 33, "sticked" should read --adhered--.

COLUMN 9:

Line 11, "at" should read --as--.

UNITED STATES PATENT AND TRADEMARK OFFICE

CERTIFICATE OF CORRECTION

PATENT NO. : 5,470,635 Page 2 of 7

DATED : November 28, 1995

INVENTOR(S) : Hiroyuki SHIRAI, et al.

It is certified that error appears in the above-indentified patent and that said Letters Patent is hereby corrected as shown below:

COLUMN 10:

Line 14, "as (both occurrences" should be deleted; and
Line 60, "respect" should read --respect to--.

COLUMN 11:

Line 6, "9 min." should read --9 mm.--.

COLUMN 12:

Line 21, "equipments." should read --equipment--;
Line 52, "an" should read --a--;
Line 54, "comprise" should read --comprises--; and,
Line 58, "detached" should read --be detached--.

COLUMN 13:

Line 11, "along" should read --alone--; and,
Line 43, "VVDC" should read --$VV_{DC}$--.

COLUMN 14:

Line 66, "buthy methacrylate" should read --butyl methacrylate--.

UNITED STATES PATENT AND TRADEMARK OFFICE

CERTIFICATE OF CORRECTION

PATENT NO. : 5,470,635 Page 3 of 7

DATED : November 28, 1995

INVENTOR(S) : Hiroyuki SHIRAI, et al.

It is certified that error appears in the above-indentified patent and that said Letters Patent is hereby corrected as shown below:

COLUMN 16:

Line 6, "the" should read --a--.

COLUMN 18:

Line 10, "a secured to" should read --and secured to--.

COLUMN 19:

Line 51, "the serves" should read --serves--; and

Line 64, "sticked" should read --adhered--.

COLUMN 20:

Line 66, "by-the" should read --by the--.

COLUMN 23:

Line 22, "the-rotational" should read --the rotational--; and,

Line 66, "palyurethane" should read --polyurethane--.

COLUMN 24:

Line 1, "sticked" should read --adhered--; and,

Line 22, "the costdown" should read --lower costs--.

UNITED STATES PATENT AND TRADEMARK OFFICE

CERTIFICATE OF CORRECTION

PATENT NO. : 5,470,635 Page 4 of 7

DATED : November 28, 1995

INVENTOR(S) : Hiroyuki SHIRAI, et al.

It is certified that error appears in the above-indentified patent and that said Letters Patent is hereby corrected as shown below:

COLUMN 25:

Line 36, "ends" should read --end--; and,
Line 39, "rum" should read --drum--.

COLUMN 27:

Line 46, "that, when" should read --that--; and
Line 58, "recess 14Zj," should read --recess 15j,--.

COLUMN 28:

Line 19, after "guided" insert --by--; and
Line 53, "rotaty" should read --rotary--.

COLUMN 29:

Line 44, "Contact 18b" should read --contact 18b--; and,
Line 63, "the" should read --a--.

COLUMN 30:

Line 14, "up" should be deleted.

COLUMN 31:

Line 9, "teeth-greater" should read --teeth greater--.

UNITED STATES PATENT AND TRADEMARK OFFICE

CERTIFICATE OF CORRECTION

PATENT NO. : 5,470,635 Page 5 of 7

DATED : November 28, 1995

INVENTOR(S) : Hiroyuki SHIRAI, et al.

It is certified that error appears in the above-indentified patent and that said Letters Patent is hereby corrected as shown below:

COLUMN 33:

Line 6, "is" should read --may be--;
Line 8, "=aboutment" should read --abutment--; and,
Line 28, "ends" should read --end--.

COLUMN 35:

Line 14, "become" should read --becomes--; and,
Line 16, "and-the" should read --and the--.

COLUMN 36:

Line 6, ",the" should read --the--; and
Line 21, "the-vicinity" should read --the vicinity--.

COLUMN 37:

Lines 10-11, "the earthing" should read --thereby earthing--; and
Line 31, "drum 9" should read --drum 9,--.

COLUMN 39:

Line 11, "are" should read --is--.

COLUMN 42:

Line 57, "the cost-down" should read --lower-costs--.

UNITED STATES PATENT AND TRADEMARK OFFICE

CERTIFICATE OF CORRECTION

PATENT NO. : 5,470,635 Page 6 of 7

DATED : November 28, 1995

INVENTOR(S) : Hiroyuki SHIRAI, et al.

It is certified that error appears in the above-indentified patent and that said Letters Patent is hereby corrected as shown below:

COLUMN 44:

Line 34, "$90^\circ \leqq \beta \leqq 165^\circ$" should read --$90^\circ \leqq \beta < 165^\circ$--.

COLUMN 46:

Line 42, "clarify's sake" should read --for the sake of clarity--; and,

Line 64, "angle (a)" should read --angle ($\alpha$)--.

COLUMN 47:

Line 18, "to" should read --to be--.

COLUMN 51:

Line 58, "entray" should read --entry--.

UNITED STATES PATENT AND TRADEMARK OFFICE

CERTIFICATE OF CORRECTION

PATENT NO. : 5,470,635 Page 7 of 7

DATED : November 28, 1995

INVENTOR(S) : Hiroyuki SHIRAI, et al.

It is certified that error appears in the above-indentified patent and that said Letters Patent is hereby corrected as shown below:

COLUMN 53:

Line 51, "the" should read --wherein the--.

COLUMN 54:

Line 52, "the" should read --wherein the--.

Signed and Sealed this

Eighteenth Day of June, 1996

Bruce Lehman

*Attest:*

BRUCE LEHMAN

*Attesting Officer*

*Commissioner of Patents and Trademarks*